US010231598B2

(12) United States Patent
Cho et al.

(10) Patent No.: US 10,231,598 B2
(45) Date of Patent: Mar. 19, 2019

(54) DISH WASHING MACHINE

(71) Applicant: SAMSUNG ELECTRONICS CO., LTD., Suwon-si (KR)

(72) Inventors: Hwang Mook Cho, Suwon-si (KR); Jun Hong Park, Yongin-si (KR); Eung Ryeol Seo, Suwon-si (KR); Gun Ung Lee, Hwaswong-si (KR); Seung-Mok Lee, Suwon-si (KR); Chang Wook Lee, Seoul (KR); Nam Soo Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 250 days.

(21) Appl. No.: 14/870,472

(22) Filed: Sep. 30, 2015

(65) Prior Publication Data

US 2016/0095498 A1 Apr. 7, 2016

(30) Foreign Application Priority Data

Oct. 2, 2014 (KR) ..... 10-2014-0133208
Jun. 4, 2015 (KR) ..... 10-2015-0078919

(51) Int. Cl.
*A47L 15/16* (2006.01)
*A47L 15/50* (2006.01)
*A47L 15/42* (2006.01)

(52) U.S. Cl.
CPC ..... *A47L 15/504* (2013.01); *A47L 15/16* (2013.01); *A47L 15/4282* (2013.01)

(58) Field of Classification Search
CPC .. A47L 15/16; A47L 15/4223; A47L 15/4221; A47L 15/4282; A47L 2301/04;
(Continued)

(56) References Cited

U.S. PATENT DOCUMENTS 2,236,791 A * 4/1941 Forsberg ..... A47L 15/18 134/172
3,915,182 A 10/1975 Payne
(Continued)

FOREIGN PATENT DOCUMENTS

EP 2 671 494 A1 6/2013
EP 2 786 691 A2 3/2014
(Continued)

OTHER PUBLICATIONS

International Search Report dated Dec. 17, 2015 in PCT Patent Application No. PCT/KR2015/010061.
(Continued)

*Primary Examiner* — David G Cormier
(74) *Attorney, Agent, or Firm* — Staas & Halsey LLP

(57) ABSTRACT

A dish washing machine having a structure improved to increase washing efficiency is provided. The dish washing machine includes a washing tub for washing dishes, an injection unit to inject washing water into the washing tub, and a deflection unit to move inside the washing tub to deflect the washing water injected from the injection unit toward the dishes. The deflection unit includes a first vane to be linearly movable in a direction in which the washing water is injected and a second vane to interwork with the first vane.

33 Claims, 68 Drawing Sheets

(58) Field of Classification Search
CPC ..... A47L 2501/36; A47L 2501/20; A47L 2401/06; A47L 2401/34
See application file for complete search history.

(56) References Cited

U.S. PATENT DOCUMENTS

| | | | | |
|---|---|---|---|---|
| 2008/0186170 | A1* | 8/2008 | Schleifer | A47L 15/0049 340/540 |
| 2012/0031432 | A1* | 2/2012 | Beaudet | A47L 15/0021 134/18 |
| 2013/0319487 | A1 | 12/2013 | Hong et al. | |

FOREIGN PATENT DOCUMENTS

| | | | |
|---|---|---|---|
| EP | 2 786 691 | A3 | 3/2014 |
| JP | 2002-238825 | | 8/2002 |
| JP | 2008-279137 | | 11/2008 |
| JP | 2010-263941 | | 11/2010 |

OTHER PUBLICATIONS

European Office Action dated Sep. 1, 2017 in corresponding European Patent Application No. 15 846 763.9.
European Search Report dated Aug. 10, 2017 in corresponding European Patent Application No. 15 846 763.9.
European Office Action dated Apr. 5, 2018 in European Patent Application No. 15846763.9.

* cited by examiner

DISH WASHING MACHINE

CROSS-REFERENCE TO RELATED APPLICATIONS

This application is related to, and claims the priority benefit to, Korean Patent Application Nos. 10-2014-0133208 and 10-2015-0078919, filed on Oct. 2, 2014 and Jun. 4, 2015, respectively, in the Korean Intellectual Property Office, the disclosures of which are incorporated herein by reference.

BACKGROUND

1. Field

Embodiments of the disclosure relate to a dish washing machine, and more particularly, to a dish washing machine having a structure improved to increase washing efficiency.

2. Description of the Related Art

Dish washing machines wash dishes by spraying high-pressure washing water to the dishes and each include a washing tub for washing the dishes, a dish basket mounted in the washing tub to store the dishes, a sump for collecting the washing water for washing the dishes, and a pump and nozzle for injecting the washing water into the washing tub.

Generally, dish washing machines employ a rotor-type injection structure having a rotating injection nozzle. A rotating nozzle injects washing water while rotating due to water pressure.

However, since such rotating nozzle injects the washing water only within a range in a radius of rotation, an area to which the washing water is not injected may occur. Accordingly, to prevent the area to which the washing water is not injected from occurring, so-called linear type injection structures have been provided.

Linear type injection structures each include a fixed nozzle fixed to one side of a washing tub and a vane that moves inside the washing tub and deflects washing water injected from the fixed nozzle toward dishes, thereby injecting the washing water to areas of the washing tub according to the movement of a deflection plate.

The fixed nozzle includes a plurality of injection holes arranged to the left and right in the washing tub and is fixed to a rear wall of the washing tub. The vane extends to the left and right in the washing tub to deflect the washing water injected from the plurality of injection holes and may be provided to linearly reciprocate between the front and rear of the washing tub.

Also, linear type injection structures each include a driving device capable of driving the vane. The driving device may be implemented in various ways but may be provided to, for example, include a motor, a belt that is connected to the motor and transfers a driving force to the vane, and a rail that guides the movement of the vane in such a way that, when the motor is driven, the belt rotates to move the vane on the rail.

In the case of such linear type injection structures, to allow a water stream injected from the fixed nozzle to hit the vane, it is necessary to maintain more than a certain height of the vane, and the height of the vane reduces an internal volume, thereby reducing a maximum size of loadable plates.

Meanwhile, dish baskets are mounted on a top and bottom of the washing tub to be slidable forward and backward. It is necessary to adjust a height of dish baskets to store and wash various types and sizes of dishware such as bowls and plates.

SUMMARY

Therefore, it is an aspect of the disclosure to provide a dish washing machine including a linear type injection unit.

It is an aspect of the disclosure to provide a dish washing machine having a structure improved to increase washing efficiency.

It is an aspect of the disclosure to provide a dish washing machine including a vane unit and a flow channel switching device.

It is an aspect of the disclosure to provide a dish washing machine having a linear type injection structure, and that can be providing in a linear type compact size by lowering a height of a vane through a reduction of a nozzle hit distance to enlarge a dishware and cookware loading volume.

It is an aspect of the disclosure to provide a dish washing machine including a height-adjustable linear type injection unit of a basket to store various types of dishware and cookware.

It is an aspect of the disclosure to provide a dish washing machine including a driving device for a height-adjustable linear type injection unit.

Additional aspects of the invention will be set forth in part in the description which follows and, in part, will be obvious from the description, or may be learned by practice of the invention.

In accordance with an aspect of the disclosure, a dish washing machine includes a washing tub for washing dishes, an injection unit to inject washing water into the washing tub, and a deflection unit to move inside the washing tub to deflect the washing water injected from the injection unit toward the dishes, in which the deflection unit includes a first vane linearly movable and a second vane disposed in parallel with the first vane in a moving direction of the first vane.

The first vane may be linearly movable in a first direction and a second direction opposite to the first direction, and the second vane interworkable with the first vane.

The injection unit may include an injection nozzle to inject the washing water in the first direction toward one side from the center of the washing tub and the second direction toward the other side from the center of the washing tub.

The dish washing machine may include a rail assembly that guides the movement of the deflection unit, and the rail assembly may include a rail that extends in the first direction and the second direction and a holder unit configured such that the rail is installed.

The holder unit may include a holder frame configured such that the rail is connected, a front holder installed on one end of the holder frame, and a rear holder installed on the other end of the holder frame.

The dish washing machine may include a dish basket to store the dishes, and at least one of the front holder and the rear holder may be coupled with the dish basket.

The deflection unit may include a moving rail that connects the first vane with the second vane and a rail coupling portion configured such that the first vane and the second vane are movably coupled with the rail.

The dish washing machine may include a motor assembly to move the deflection unit. The motor assembly may include a motor that generates torque, a first gear connected to a shaft of the motor, and a second gear connected to the first gear and to transfer a driving force of the motor to the deflection unit.

The second gear may be formed on at least a part of the moving rail.

The deflection unit may further include a vane holder configured such that the first vane and the second vane are movably coupled with the rail. The vane holder may include a coupling protrusion formed such that the first vane and the second vane are rotatably coupled, and the first vane and the second vane each may include a coupling groove that is rotatably coupled with the coupling protrusion.

The injection unit may include a fixed nozzle provided in the rear of the washing tub and to inject the washing water and an injection case provided to be connected to the fixed nozzle and including an injection nozzle formed to extend forward and rearward in the washing tub and to inject the washing water.

The injection nozzle may include a first nozzle formed on one end of the injection case to inject the washing water in the first direction and a second nozzle formed on the other end of the injection case to inject the washing water in the second direction.

The injection case may include a first injection flow channel to inject the washing water through the first nozzle and a second injection flow channel to inject the washing water through the second nozzle, and the first injection flow channel and the second injection flow channel may be divided by a partition.

The injection case may include a rotation guide to rotate the first vane and the second vane.

The dish washing machine may include a flow channel switching unit to supply the washing water to at least any one of the first injection flow channel and the second injection flow channel.

The flow channel switching unit may include a motor that generates a driving force.

The flow channel switching unit may include a flow channel switching holder movable in the first direction and the second direction and to switch a flow channel, and the flow channel switching holder may switch a moving direction of the deflection unit to an opposite direction upon being pressurized in the moving direction of the deflection unit.

The dish washing machine may include a sensor unit to limit a moving distance of the deflection unit.

In accordance with an aspect of the disclosure, a dish washing machine includes a washing tub for washing dishes, an injection unit configured to inject washing water in a first direction toward one side from the center of the washing tub and a second direction opposite to the first direction, a first vane linearly movable inside the washing tub to deflect the washing water to at least a part of the washing tub, and a second vane movable in parallel with the first vane to deflect the washing water to another part of the washing tub.

The dish washing machine may include a rail that extends in the first direction and the second direction to guide the movement of the first vane and the second vane.

The dish washing machine may include a moving rail that connects the first vane with the second vane and a vane holder movably coupled to the rail.

The first vane and the second vane may be rotatably coupled with the vane holder.

The injection unit may include a fixed nozzle provided in the rear of the washing tub and to inject the washing water and an injection case provided to be connected to the fixed nozzle and including an injection nozzle formed to extend forward and rearward in the washing tub to inject the washing water.

The injection nozzle may include a first nozzle formed on one end of the injection case to inject the washing water in the first direction and a second nozzle formed on the other end of the injection case to inject the washing water in the second direction.

The injection case may include a first injection flow channel to inject the washing water through the first nozzle and a second injection flow channel to inject the washing water through the second nozzle, and the first injection flow channel and the second injection flow channel may be divided by a partition.

The first flow channel and the second flow channel each may be sealed using a sealing member.

The injection case may include a rotation guide configured to rotate the first vane and the second vane.

The dish washing machine may include a flow channel switching unit to supply the washing water to at least any one of the first injection flow channel and the second injection flow channel.

The flow channel switching unit may include a motor that generates a driving force.

The flow channel switching unit may include a flow channel switching holder to be movable in the first direction and the second direction and to switch a flow channel, and the flow channel switching holder may switch moving directions of the first vane and the second vane to opposite directions upon being pressurized in the moving directions of the first vane and the second vane.

The dish washing machine may include a sensor unit to limit moving distances of the first vane and the second vane.

The dish washing machine may include a dish basket to store the dishes in the washing tub with a variable installation position. The first vane and the second vane may be provided below the dish basket and may include a holder unit couplable with the dish basket.

The washing tub may include at least one guide rail supporting the dish basket with the variable installation position.

In accordance an aspect of the disclosure, a dish washing machine includes a washing tub for washing dishes, a first nozzle to inject washing water in a first direction toward one side from the center of the washing tub, a second nozzle to inject the washing water in a second direction opposite to the first direction, a first vane movable to deflect the washing water injected from the first nozzle toward the dishes, a second vane movable in a moving direction of the first vane to deflect the washing water injected from the second nozzle toward the dishes, and a flow channel switching unit to supply the washing water to at least any one of the first nozzle and the second nozzle The injection unit may include a fixed nozzle provided in the rear of the washing tub and to inject the washing water and an injection case provided to be connected to the fixed nozzle and including an injection nozzle formed to extend forward and rearward in the washing tub to inject the washing water.

The injection case may include a first injection flow channel to inject the washing water through the first nozzle and a second injection flow channel to inject the washing water through the second nozzle, and the first injection flow channel and the second injection flow channel may be divided by a partition.

The first flow channel and the second flow channel each may be sealed using a sealing member.

The flow channel switching unit may include a flow channel switching holder movable in the first direction and the second direction and to switch a flow channel, and the flow channel switching holder may switch moving directions of the first vane and the second vane to opposite directions upon being pressurized in the moving directions of the first vane and the second vane.

The dish washing machine may include a sensor unit to limit moving distances of the first nozzle and the second nozzle.

The flow channel switching unit may include a motor that generates a driving force.

The injection unit, the first vane, and the second vane may be installed in the dish basket.

The dish washing machine may include a dish basket to store the dishes in the washing tub with a variable installation position, and the first vane and the second vane may include a holder unit couplable with the dish basket.

In accordance with yet another aspect of the disclosure, a dish washing machine includes a cabinet forming an exterior, a washing tub provided in the cabinet and to wash dishes, an injection unit to inject washing water into the washing tub, a dish basket to store the dishes in the washing tub with a variable installation position, a deflection unit provided below the dish basket, on a path of the washing water injected from the injection unit to switch a direction of the injected washing water, and a power transmission device that transfers power such that the deflection unit is movable below the dish basket. The power transmission device includes a motor fixed to one side of the washing tub and to generate a driving force and a gear unit to transfer the driving force of the motor to the deflection unit and including a plurality of gears formed at different heights to correspond to a variable position of the dish basket.

The gear unit may include a first gear, a second gear disposed spaced from the first gear, and a plurality of connection gears to connect the first gear with the second gear.

The deflection unit may include a vane movable inside the washing tub to deflect the washing water injected from the injection unit toward the dishes, a rail guiding the movement of the vane, a belt that rotates while connected to a driving pulley and an idle pulley to transfer the driving force of the motor to the vane, a rear holder rotatably supporting the driving pulley and coupled with one end of the rail due to the tension of the belt, and a front holder rotatably supporting the idle pulley and coupled with the other end of the rail due to the tension of the belt.

One of the plurality of connection gears may be connected to the driving pulley.

The plurality of connection gears may include a first connection gear connected to the first gear, a second connection gear connected to the second gear, and at least one reduction gear horizontally connected to the second connection gear.

The dish washing machine may include a connection shaft that vertically connects the first connection gear with the second connection gear.

The gear unit may be integrated with one side of the dish basket.

The washing tub may include at least one guide rail supporting the dish basket such that a height of the dish basket is variable, and the at least one guide rail may include a first guide rail supporting the dish basket in a first position and a second guide rail supporting the dish basket in a second position spaced from the first rail.

The first gear may be connected to the motor when the dish basket is in the first position, and the second gear may be connected to the motor when the dish basket is in the second position.

The motor may be provided in the rear of the washing tub.

The injection unit may include a fixed nozzle provided in the rear of the washing tub and to inject the washing water and an injection case provided to be connected to the fixed nozzle and including a plurality of connection openings formed at different heights to correspond to a variable position of the dish basket and an injection nozzle to inject the washing water supplied through the connection openings.

The injection case may include a valve to open and close the plurality of connection openings therein.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
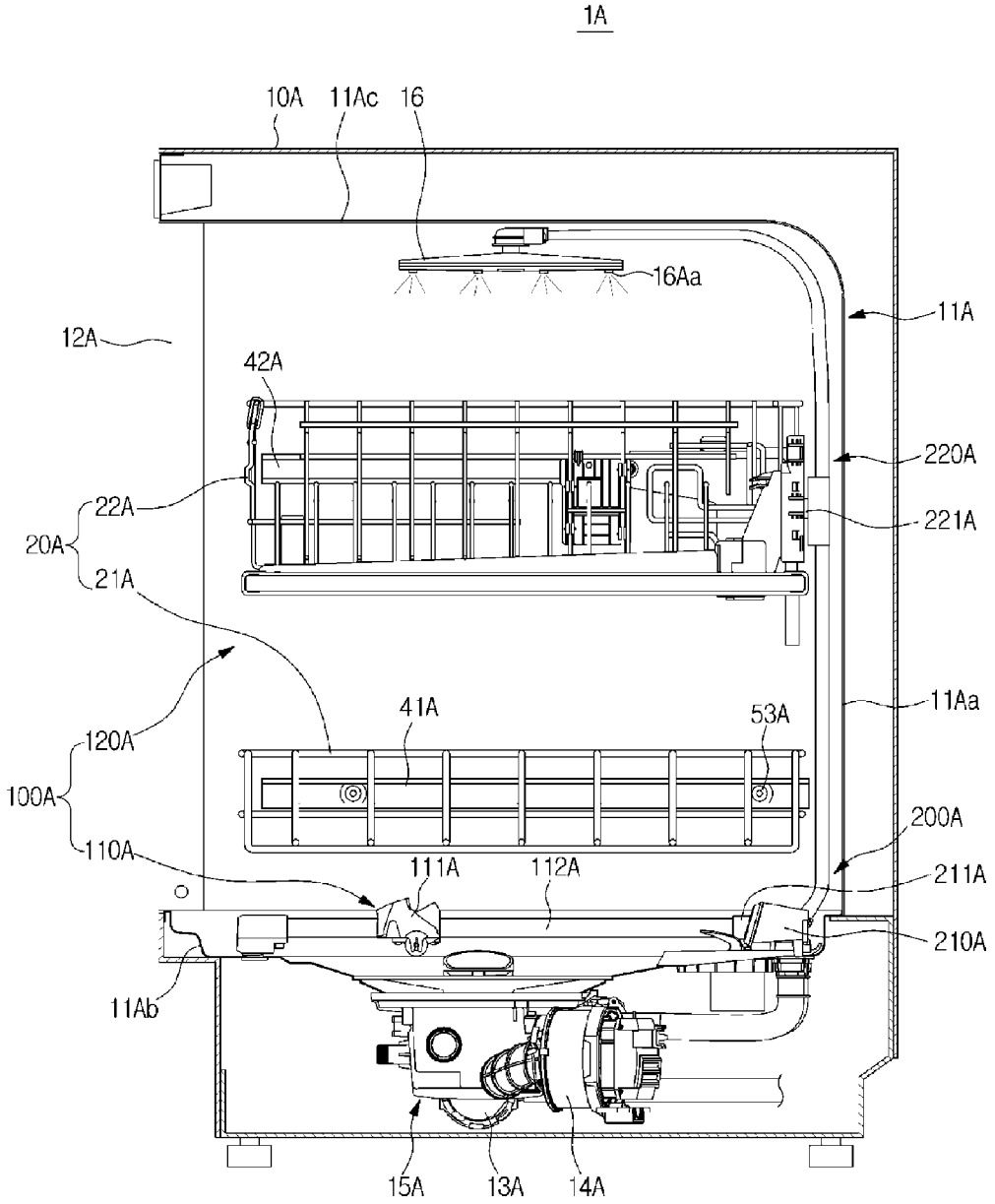
FIG. 1 is a cross-sectional view illustrating a configuration of a dish washing machine according to a first embodiment of the disclosure.

Reference will now be made in detail to the embodiments of the disclosure, examples of which are illustrated in the accompanying drawings, wherein like reference numerals refer to like elements throughout.

The term "dish" is used herein to refer to an item washable by the "dish" washing machine, and includes, for example, dishware and cookware. Hereinafter, exemplary embodiments of the disclosure will be described in detail with reference to the attached drawings. Terms used herein "a front end", "a rear end", "a top", "a bottom", "a top end", and "a bottom end" may be defined based on the drawing. However, shapes and positions of respective components will not be limited thereto.

Hereinafter, exemplary embodiments of the disclosure will be described in detail with reference to the attached drawings.

Figure 2:
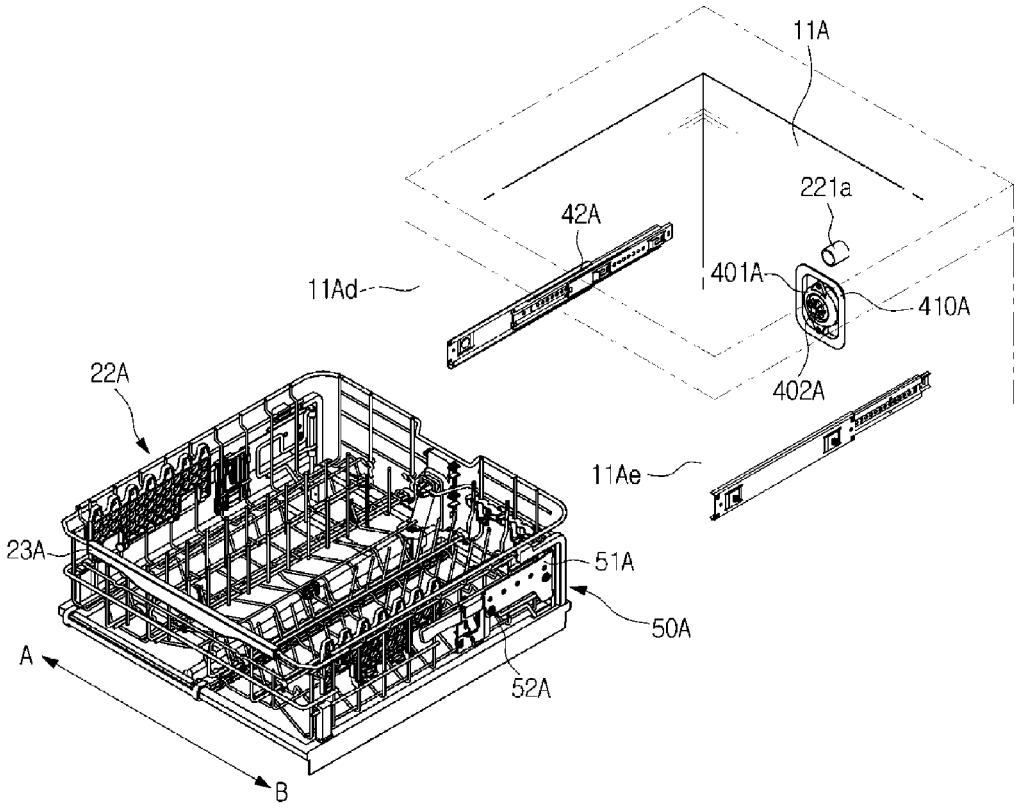
FIG. 2 is a view of a dish basket mounted in a washing tub of the dish washing machine according to the first embodiment of the disclosure.
Figure 3:
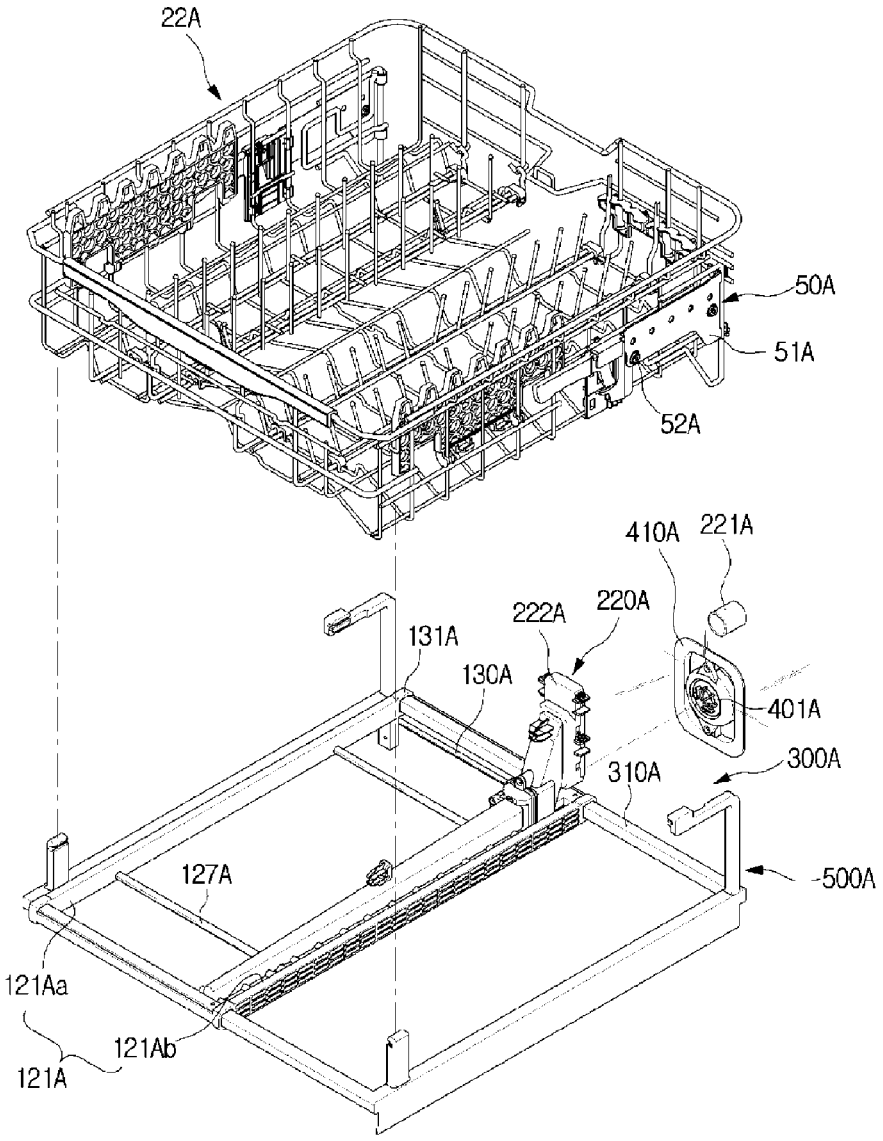
FIG. 3 is a view illustrating an injection unit and a deflection unit of the dish washing machine according to the first embodiment of the disclosure.

Referring to FIGS. 1 and 2, an exemplary dish washing machine 1A according to a first embodiment of the disclosure is described.

The dish washing machine 1A includes a cabinet 10A, a washing tub 11A provided inside the cabinet 10A, dish baskets 20A provided inside the washing tub 11A to hold, e.g., store dishes, an injection unit 200A provided inside the washing tub 11A to inject washing water, and a deflection unit 100A movable inside the washing tub 11A to deflect the washing water (e.g., deflect the washing water toward the dishes).

A side (e.g., front side) of the cabinet 10A may be openable to allow a user of the washing machine to place the dishes in the washing tub 11A or to withdraw the dishes from the washing tub 11A. A door 12A may be included to open and close the washing tub 11A.

The door 12A may be hinge-coupled (e.g., with a bottom of the front side of the cabinet 10A and rotatable, and to open and close the washing tub 11A). The washing tub 11A may include a top wall 11Ac, a rear wall 11Aa, left and right walls 11Ad and 11Ae, and a bottom plate 11Ab.

A sump 15A to store the washing water, a circulating pump 14A to pump the washing water from the sump 15A, and a drainage pump 13A to discharge washing water from the sump 15A to the outside of the cabinet 10A, for example, together with waste are provided (e.g., below the washing tub 11A of the cabinet 10A).

The dish baskets 20A may be racks, for example, wire racks formed of wires to allow the washing water to pass therethrough without ponding. The dish baskets 20A may be detachably provided inside the washing tub 11A. A handle 23A to allow a user to detach, for example, smoothly detach, the dish basket 20A may be provided on a top of a front side of the dish basket 20A.

The dish baskets 20A may include a first dish basket 21A disposed, for example, on a bottom of the washing tub 11A and a second dish basket 22A disposed, for example, in the middle of the washing tub 11A.

The first dish basket 21A may be coupled, for example, slidably coupled by a fixed rail 41A provided above the bottom plate 11Ab of the washing tub 11A.

The fixed rails 41A may be on the left and right walls 11Ad and 11Ae of the washing tub 11A, for example, in forward and rearward positions in the washing tub 11A. Rollers, for example, fixed rollers 53A may be installed on sides, for example, both sides of the first dish basket 21A to be coupled, e.g., rotatably coupled with the fixed rails 41A.

Accordingly, the fixed rollers 53A of the first dish basket 21A may be coupled with the fixed rails 41A to slidably move the first dish basket 21A, for example, in a forward and rearward direction so that the first dish basket may be attachable or detachable from the washing tub 11A.

The second dish basket 22A may be disposed in the middle of the washing tub 11A and may be coupled, e.g., slidably coupled by a guide rail 42A disposed. for example, in the middle of the washing tub 11A.

The guide rails 42A may be formed on the left and right walls 11Ad and 11Ae of the washing tub 11A, for example, in forward and rearward positions.

Guide units 50A couplable with the guide rails 42A may be provided, for example, on both sides of the second dish basket 22A. The guide units 50A may each include a guide bracket 51A coupled, e.g., fixedly coupled with the second dish basket 22A and a guide roller 52A formed on the guide bracket 51A.

Accordingly, the guide rollers 52A of the second dish basket 22A may be coupled with the guide rails 42A to move, e.g., slidably move the second dish basket 22A, e.g., in a forward and a rearward direction in the washing tub 11A so that the second basket is attachable or detachable from the washing tub 11A.

The injection unit 200A may be provided such that the dishes are able to be washed by injecting the washing water, for example, at a high pressure. The injection unit 200A may include a nozzle, e.g., a rotating nozzle 16 provided on the top wall 11Ac of the washing tub 11A to inject the washing water while rotating, a first injection unit 210A provided on the bottom of the washing tub 11A, and a second injection unit 220A disposed, for example, in a position spaced apart from the first injection unit 210A, e.g., the middle of the washing tub 11A and installable, for example, on a bottom of the second dish basket 22.

The rotating nozzle 16A may rotate above the second dish basket 22A, for example, due to water pressure, and may inject washing water downward. A plurality of injection holes 16Aa may be provided, for example, on a bottom end of the rotating nozzle 16A. The rotating nozzle 16A may inject the washing water directly toward the dishes stored in the second dish basket 22A.

The first injection unit 210A may be fixed to a side of the washing tub 11A and may be disposed adjacent to the rear wall 11Aa of the washing tub 11A to inject the washing water, for example, toward a front of the washing tub 11A. Accordingly, at least a part of the washing water injected by the first injection unit 210A may not move directly toward the dishes.

The washing water injected by the first injection unit 210A may deflect toward the first dish basket 21A, for example, due to a first deflection unit 110A. The first injection unit 210A may include a first fixed nozzle 211A, for example, provided forward on the rear wall 11Aa of the washing tub 11A.

The first deflection unit 110A includes a vane 111A to deflect the washing water, for example, injected from the first fixed nozzle 211A toward the dishes in the first dish basket 21A. The vane 111A may extend, for example, between left and right sides of the washing tub 11A. That is, a longitudinal one end of the vane 111A may be formed adjacent to the left wall 11Ad of the washing tub 11A and a longitudinal other end of the vane 111A may be formed adjacent to the right wall 11Ae of the washing tub 11A.

The vane 111A may be provided such that it is able to linearly reciprocate, for example, in an injection direction of the washing water injected by the first fixed nozzle 211A. The vane 111A may be provided to move along a first lane 112A. Accordingly, a linear injection structure including the first fixed nozzle 211A and the vane 111A may wash a large area of the washing tub 11A upward from a bottom end of the washing tub 11A, for example, without a blind spot. Such a washing may be differentiated from injecting washing water, for example, only within a radius of rotation of the rotating nozzle 16A.

As illustrated in FIGS. 3 to 8, the second dish basket 22A may be located in washing tub 11A a distance away from the first dish basket, e.g., in a middle portion of the washing tub 11A.

A second injection unit 220A to inject washing water and a second deflection unit 120A may be provided at the second dish basket 22A to deflect the washing water injected from the second injection unit 220A toward the dishes.

The second injection unit 220A may include a second nozzle, e.g., a second fixed nozzle 221A provided on the rear wall 11Aa of the washing tub 11A and an injection case 222A installed, for example, in the rear of the second dish basket 22A and connected to the second fixed nozzle 221A.

The second fixed nozzle 221A may be provided to be fixed to the rear wall 11Aa of the washing tub 11A to inject the washing water to the washing tub 11A. A fixed nozzle connection portion 224A to connect the second fixed nozzle 221A may be formed in a rear side of the injection case 222A. The injection case 222A may be fixedly disposed in the rear of the second dish basket 22A.

The injection case 222A may include an injection body 240A formed, for example, to extend forward and injection nozzles 230A formed, for example, on a side of the injection body 240A, for example, on the left and right sides of the injection body 240A.

An injection body connection portion 223A having an open front to be connected with the injection body 240A may be provided, for example, below the injection case 222A.

The injection nozzles 230A may each include a first nozzle 231A protruding from the left of the injection body 240A and a second nozzle 232A protruding from the right of the injection body 240A. A direction from the left of the injection body 240A, that is, the center of the washing tub 11A toward the left wall 11Ad is referred to as a first direction "A" and a direction from the right of the injection body 240A, that is, the center of the washing tub 11A toward the right wall 11Ae is referred to as a second direction "B".

Accordingly, the injection nozzle 230A may include the first nozzle 231A formed in a first direction A and the second nozzle 232A formed in a second direction B. The first nozzle 231A and second nozzle 232A may be formed on the left and the right of the injection body 240A and may be mutually symmetrically disposed.

An injection flow channel 700A (see, for example, FIG. 8) may be formed inside the injection body 240A including the injection nozzles 230A.

The second injection unit 220A may include a flow channel switching unit 600A provided to inject the washing water through at least one of the first nozzle 231A and the second nozzle 232A.

The flow channel switching unit 600A may be located between the injection case 222A and the injection body 240A.

An injection case connection portion 241A corresponding to the injection body connection portion 223A of the injection case 222A may be formed in a rear stage of the injection body. The flow channel switching unit 600A may be disposed between the injection case connection portion 241A of the injection body 240A and the injection body connection portion 223A of the injection case 222A.

Figure 5:
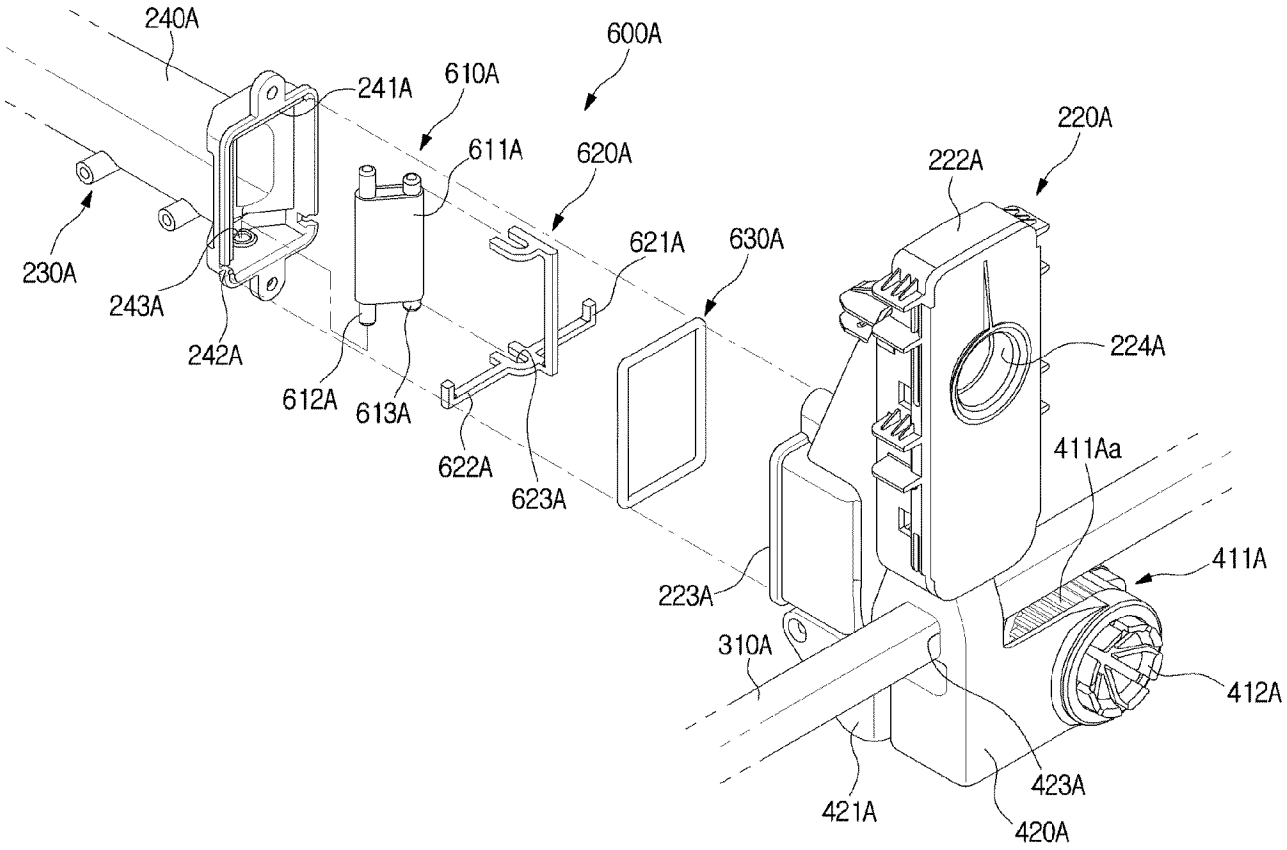
FIG. 5 is an exploded perspective view a flow channel switching unit of the injection unit according to the first embodiment of the disclosure.

As illustrated in FIG. 5, the flow channel switching unit 600A of the second injection unit 220A may include a flow channel switching member 610A, a flow channel switching holder 620A, and a sealing member 630A.

The flow channel switching member 610A may be installed, e.g., rotatably installed to open and close the injection flow channel 700A. The flow channel switching member 610A may be formed in a panel shape. The outside of the flow channel switching member 610A may be formed of a sealing material, for example, including rubber to seal, for example, fully seal the injection flow channel 700A.

A flow channel switching rotation shaft 612A may be provided on one end of the flow channel switching member 610A. A flow channel switching movement shaft 613A may be provided on the other end thereof.

The flow channel switching rotation shaft 612A of the flow channel switching member 610A may be supported, e.g., rotatably supported by a rotation shaft fixing groove 243A of the injection body 240A.

The flow channel switching member 610A may move to open and close the injection flow channel 700A, for example, while the flow channel switching movement shaft 613A rotates about the flow channel switching rotation shaft 612A.

The flow channel switching movement shaft 613A of the flow channel switching member 610A may be fixed to the flow channel switching holder 620A. The flow channel switching holder 620A may include a first pressurized portion 621A formed to protrude with respect to the first direction A based on a movement slit 623A in the center and a second pressurized portion 622A formed to protrude with respect to the second direction B.

The flow channel switching movement shaft 613A may slidably move in the first direction A or the second direction B, for example, due to the first pressurized portion 621A and the second pressurized portion 622A. Due to the movement of the flow channel switching movement shaft 613A, the flow channel switching member 610A may be rotated about the flow channel switching rotation shaft 612A.

For example, when the first pressurized portion 621A of the flow channel switching holder 620A is pressurized in the second direction B, the flow channel switching movement shaft 613A may be rotated towards the second direction B on the flow channel switching rotation shaft 612A, thereby moving the flow channel switching member 610A. Upon the second pressurized portion 622A being pressurized in the first direction A, the flow channel switching movement shaft 613A may be rotated towards the first direction A on the flow channel switching rotation shaft 612A, thereby moving the flow channel switching member 610A.

A holder installation portion 242A, for example, for installing the flow channel switching holder 620A may be formed in the injection case connection portion 241A of the injection body 240A. The holder installation portion 242A may be formed on each of the left and right sides of the injection body 240A, for example, while being incised.

A sealing member 630A for sealing, e.g., fully sealing the injection flow channel 700A may be provided between the injection body 240A and the injection case 222A.

The second injection unit 220A may be disposed below the second dish basket 22A.

The washing water injected toward the first direction A and the washing water injected toward the second direction B of the washing tub 11A through the second injection unit 220A may deflect toward the dishes on the top through the second deflection unit 120A installed below the second dish basket 22A.

The second deflection unit 120A includes a vane unit 121A provided to reciprocate in a direction in which the washing water is injected. The vane unit 121A may include a first vane 121Aa disposed to deflect the washing water injected through the first nozzle 231A of the injection nozzle 230A and a second vane 121Ab disposed to deflect the washing water injected through the second nozzle 232A.

One end of each of the first vane 121Aa and the second vane 121Ab, in a longitudinal direction, may be adjacent to a front side of the washing tub 11A and the other ends thereof may be formed adjacent to a rear side of the washing tub 11A.

The first vane 121Aa and the second vane 121Ab may be disposed in parallel. The first vane 121Aa and the second vane 121Ab may be interconnected to interwork with each other.

The first vane 121Aa and the second vane 121Ab may include deflection surfaces 122A and 123A to allow the washing water injected through the first nozzle 231A and the second nozzle 232A to deflect, respectively. The first vane 121Aa may include a first deflection surface 122A, and the second vane 121Ab may include a second deflection surface 123A.

The first vane 121Aa and the second vane 121Ab may be disposed to be spaced from each other at a certain interval due to a vane connection portion 124A. The vane connection portion 124A may be provided to connect ends of the first vane 121Aa and the second vane 121Ab. According to an embodiment of the disclosure, as an example, the vane connection portion 124A connects the ends of the first vane 121Aa and the second vane 121Ab, but is not limited thereto.

The first vane 121Aa may be installed to be able to linearly reciprocate in the first direction A of the washing tub 11A and the second direction B opposite to the first direction A. The second vane 121Ab may be installed to linearly reciprocate in the first direction A and the second direction B of the washing tub 11A according to the first vane 121Aa.

Supporting ribs 127A spaced with a certain interval may be installed between the first vane 121Aa and the second vane 121Ab. The supporting ribs 127A may be provided to connect the first vane 121Aa with the second vane 121Ab. The supporting ribs 127A may be provided to maintain the interval and to reinforce the intensity while the first vane 121Aa and the second vane 121Ab are moving. According to an embodiment of the disclosure, as an example, two supporting ribs may be spaced with a certain interval, but it is not limited thereto. For example, the number of supporting ribs may be variously modified according to a size of a vane unit.

The second deflection unit 120A may include a motor assembly 400A provided to move the vane unit 121A.

Figure 6:
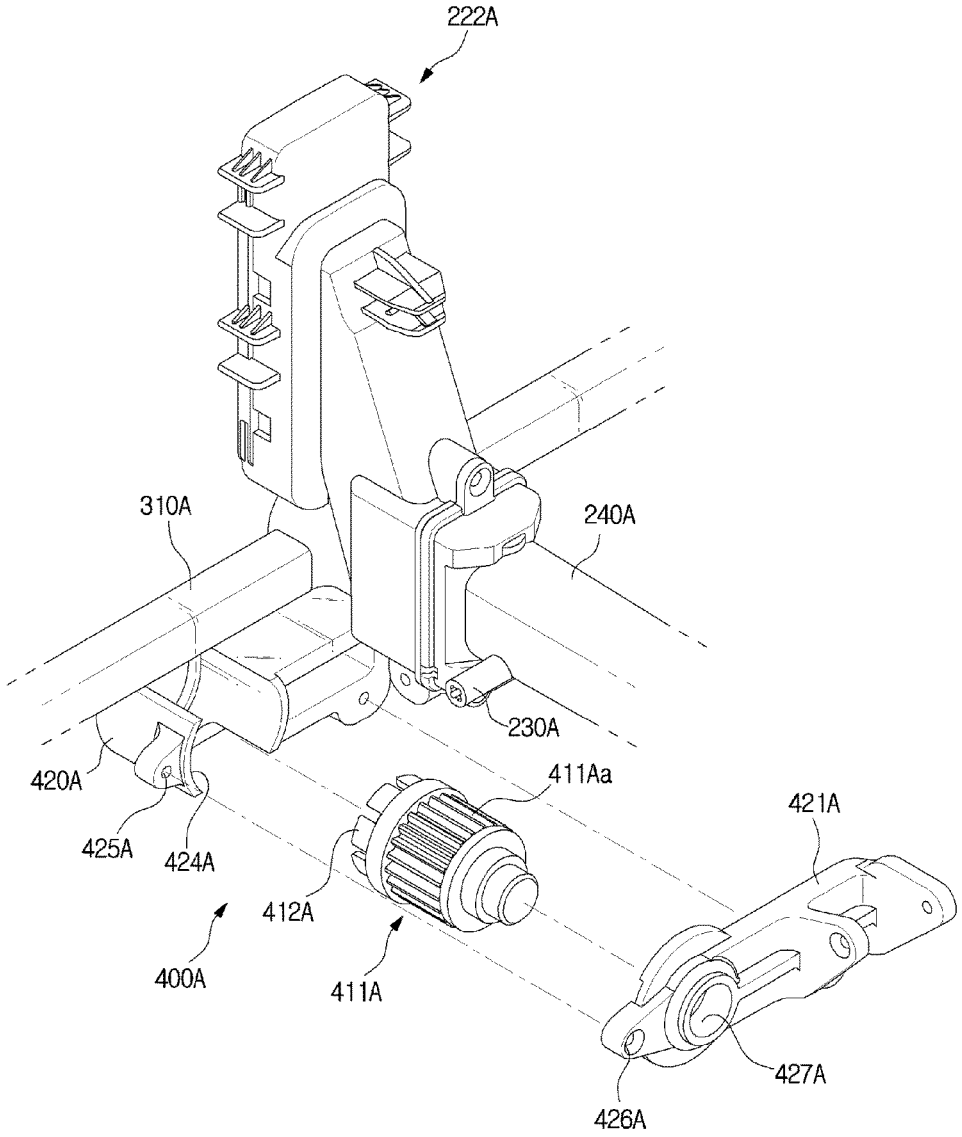
FIG. 6 is an exploded perspective view a motor assembly of the injection unit according to the first embodiment of the disclosure.
Figure 7:
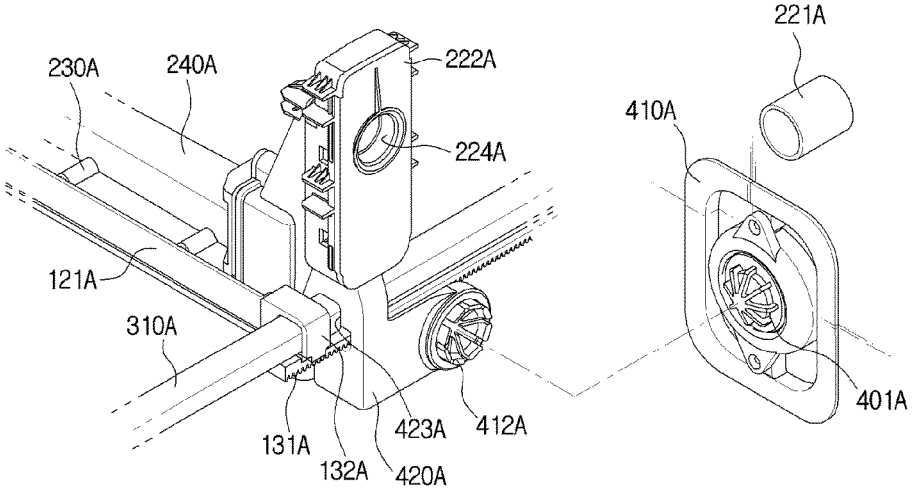
FIG. 7 is a view illustrating the motor assembly and the injection unit according to the first embodiment of the disclosure.

As illustrated in FIGS. 6 and 7, the motor assembly 400A may be disposed below the injection case 222A.

The motor assembly 400A may include a motor 401A fixed to the rear wall 11Aa of the washing tub 11A to generate a driving force, a first gear portion 411A connected to a motor shaft 402A of the motor 401A, and a second gear 131A coupled with the first gear portion 411A to transfer the driving force of the motor 401A to the vane unit 121A of the second deflection unit 120A.

The first gear portion 411A may have a cylindrical shape, and a first gear 411Aa may be formed on an outer circumferential surface thereof. A motor connection portion 412A to couple with the motor 401A fixed to the washing tub 11A may be formed on a rear end of the first gear portion 411A.

A motor installation portion 410A to install the motor 401A may be provided on the rear wall 11Aa of the washing tub 11A.

The motor installation portion 410A may be located in the rear wall, for example, the middle of the rear wall 11Aa of the washing tub 11A and may be located below the second fixed nozzle 221A. The motor installation portion 410A may be disposed below the second fixed nozzle 221A while being spaced therefrom with a certain interval.

Accordingly, the motor connection portion 412A of the first gear portion 411A may be coupled with the motor 401A at the motor installation portion 410A formed on the rear wall 11Aa of the washing tub 11A to transfer the torque of the motor 401A.

The first gear 411Aa of the first gear portion 411A may be coupled with the second gear 131A to allow the first vane 121Aa and the second vane 121Ab to be movable.

The second gear 131A of the motor assembly 400A may be formed at the second deflection unit 120A.

A mobile rail 130A to receive power from the motor assembly 400A and to move the first vane 121Aa and the second vane 121Ab may be installed at rear ends of the first vane 121Aa and the second vane 121Ab. The second gear 131A may be formed on the mobile rail 130A. The second gear 131A may be formed on at least a part of a bottom side of the mobile rail 130A.

The second deflection unit 120A may include a rail assembly 300A to guide the movement of the first vane 121Aa and the second vane 121Ab. The rail assembly 300A may be coupled with a bottom of the injection case 222A of the second injection unit 220A.

Figure 4:
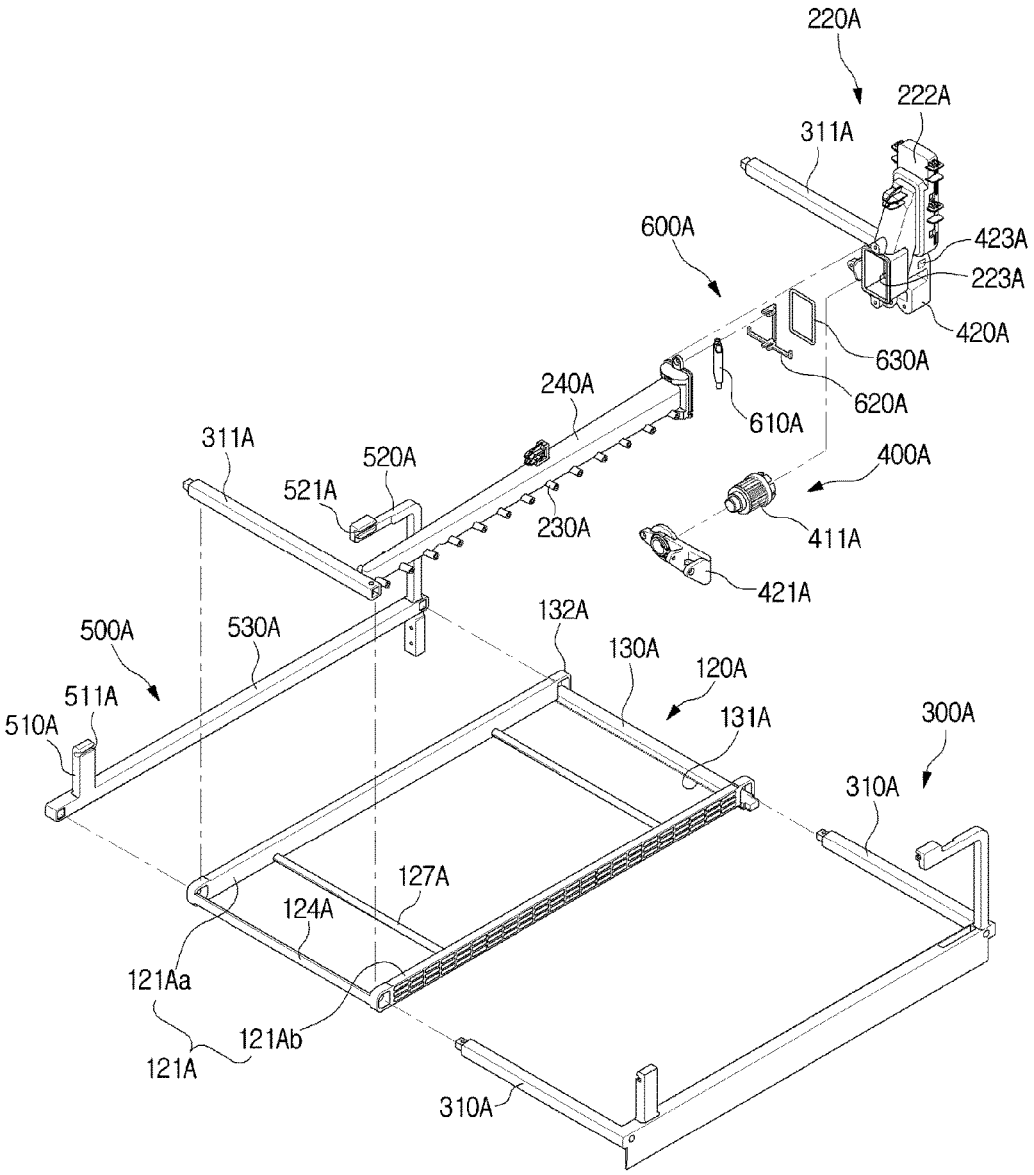
FIG. 4 is an exploded perspective view illustrating the injection unit and the deflection unit according to the first embodiment of the disclosure.

The rail assembly 300A may include a rail 310A and a holder unit 500A provided to allow the rail 310A to be installed (see, for example, FIG. 4).

The rail 310A may include an extension rail 311A connected to the holder unit 500A and provided to extend a length thereof.

The rail 310A may extend in the first direction A and the second direction B of the washing tub 11A. The rail 310A may movably connect the first vane 121Aa with the second vane 121Ab of the second deflection unit 120A.

The rail 310A may be provided at each of a front end portion and a rear end portion of the washing tub 11A. The holder unit 500A allows the rail 310A to be connected, for example, with a bottom side of the second dish basket 22A. The holder unit 500A may include a holder frame 530A that connects the rail 310A located at the front end portion with the rail 310A located at the rear end portion, a front holder 510A located at a front end of the holder frame 530A, and a rear holder 520A located at a rear end of the holder frame 530A.

The front holder 510A and the rear holder 520A may extend upward from the both ends of the holder frame 530A. Coupling grooves 511A and 521A to couple with the second dish basket 22A may be formed on top ends of the front holder 510A and the rear holder 520A, respectively.

Accordingly, the front holder 510A of the holder unit 500A may be connected with a front end of the second dish basket 22A through the coupling groove 511A and the rear holder 520A may be connected to a rear end of the second dish basket 22A through the coupling groove 521A.

The injection case 222A may include a gear bracket 420A provided therebelow and a gear bracket cover 421A provided to be coupled with the gear bracket 420A. In the embodiment of the disclosure, as an example, the gear bracket 420A is integrated with the injection case 222A but is not limited thereto. For example, the gear bracket 420A may be separately installed below the injection case 222A.

The gear bracket 420A may be provided to allow the first gear portion 411A of the motor assembly 400A to be installed. The gear bracket 420A may include a first gear accommodating groove 424A to rotatably accommodate the first gear portion 411A.

The gear bracket 420A and the gear bracket cover 421A may be coupled with a fixed groove 425A and a fixed protrusion 426A. According to an exemplary embodiment, as an example, a fixed groove may be formed at a gear bracket and a fixed protrusion may be formed at a gear bracket cover but is not limited thereto. For example, a gear bracket and a gear bracket cover may be assembled using a fixing member such as a bolt, a hook, etc.

The gear bracket cover 421A includes a rotation supporting portion 427A formed to allow the first gear portion 411A to be rotatable.

A rail installation portion 423A to allow the rail 310A to be installed may be formed at the gear bracket 420A (see, for example, FIG. 7).

The vane unit 121A of the second deflection unit 120A may be assembled with the rail 310A installed at the rail installation portion 423A to slidably move.

The rail 310A of the rail assembly 300A may be installed at the injection case 222A of the second injection unit 220A and the second deflection unit 120A may be installed below the second dish basket 22A due to the holder unit 500A of the rail assembly 300A.

The fixed nozzle connection portion 224A of the injection case 222A corresponds to the second fixed nozzle 221A, and the gear bracket 420A provided below the injection case 222A and the motor connection portion 412A correspond to the motor 401A installed at the motor installation portion 410A of the washing tub 11A.

Figure 8:
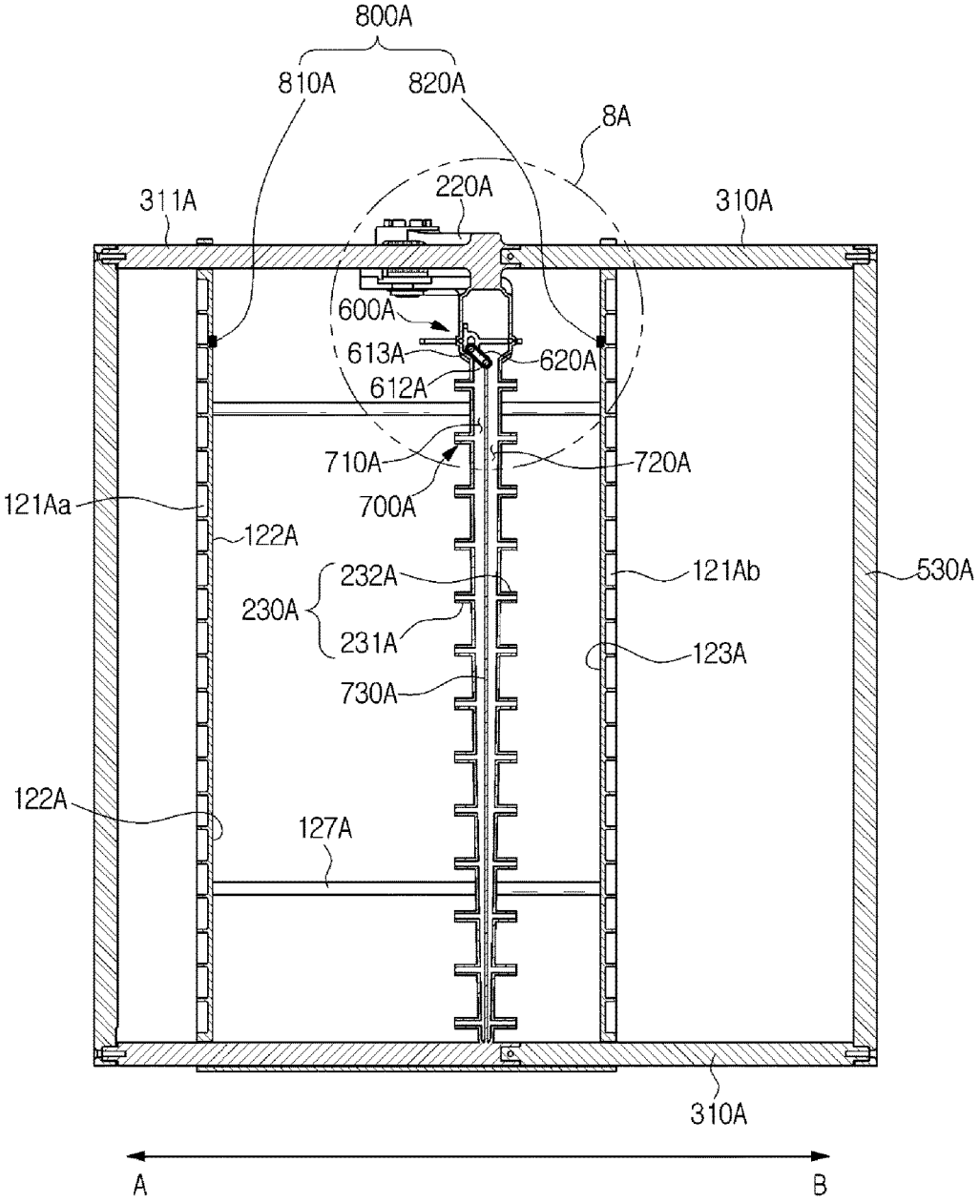
FIG. 8 is a view illustrating the injection unit and the flow channel switching unit according to the first embodiment of the disclosure.

An exemplary injection flow channel 700A of the second injection unit 220A is illustrated in FIG. 8.

The injection flow channel 700A of the second injection unit 220A may be formed inside the injection body 240A connected to the injection case 222A.

A first injection flow channel 710A and a second injection flow channel 720A may be provided inside the injection body 240A. The first injection flow channel 710A may be provided to allow the washing water supplied to the injection flow channel 700A to be injected through the first nozzle 231A. The second injection flow channel 720A may be provided to allow the washing water supplied to the injection flow channel 700A to be injected through the second nozzle 232A.

The first injection flow channel 710A and the second injection flow channel 720A may be divided by a partition 730A.

The partition 730A that extends frontward and rearward in the washing tub 11A may be provided inside the injection body 240A.

Accordingly, based on the partition 730A, the first injection flow channel 710A may be formed on the side of the first nozzle 231A and the second injection flow channel 720A may be formed on the side of the second nozzle 232A.

The flow channel switching unit 600A may be provided to allow the washing water to be supplied through one of the first injection flow channel 710A and the second injection flow channel 720A of the injection flow channel 700A.

The flow channel switching unit 600A may be disposed at a rear end of the injection body 240A, that is, at a rear end of the partition 730A. The flow channel switching unit 600A may include the flow channel switching member 610A and the flow channel switching holder 620A.

The flow channel switching member 610A may be rotatably installed to open and close the injection flow channel 700A. The flow channel switching rotation shaft 612A may be provided on the one end of the flow channel switching member 610A, and the flow channel switching movement shaft 613A may be provided on the other end thereof.

The flow channel switching rotation shaft 612A of the flow channel switching member 610A may be rotatably supported by the rotation shaft fixing groove 243A of the injection body 240A.

The rotation shaft fixing groove 243A of the flow channel switching member 610A may be located at an end of the partition 730A.

Accordingly, the flow channel switching member 610A may be provided to allow the flow channel switching movement shaft 613A to open and close one of the first injection flow channel 710A and the second injection flow channel 720A while rotating on the flow channel switching rotation shaft 612A.

The flow channel switching movement shaft 613A of the flow channel switching member 610A may be fixed to the flow channel switching holder 620A. The flow channel switching holder 620A may include the first pressurized portion 621A formed to protrude toward the first direction A based on the movement slit 623A in the center and the second pressurized portion 622A formed to protrude toward the second direction B.

The flow channel switching movement shaft 613A may slidably move in one of the first direction A and the second direction B, for example, due to the first pressurized portion 621A and the second pressurized portion 622A. Due to the movement of the flow channel switching movement shaft 613A, for example, the flow channel switching member 610A may rotate on the flow channel switching rotation shaft 612A.

The first pressurized portion 621A and the second pressurized portion 622A of the flow channel switching holder 620A may be pressurized by the movement of the first vane 121Aa and the second vane 121Ab to move.

For example, when the first pressurized portion 621A of the flow channel switching holder 620A is pressurized in the second direction B, the flow channel switching movement shaft 613A may be rotated in the second direction B on the flow channel switching rotation shaft 612A, thereby moving the flow channel switching member 610A. When the second pressurized portion 622A is pressurized in the first direction A, the flow channel switching movement shaft 613A may be rotated in the first direction A on the flow channel switching rotation shaft 612A, thereby moving the flow channel switching member 610A.

A sensor unit 800A may be provided between the first vane 121Aa and the second vane 121Ab. The sensor unit 800A may be provided to sense positions of the first vane 121Aa and the second vane 121Ab.

Figure 9:
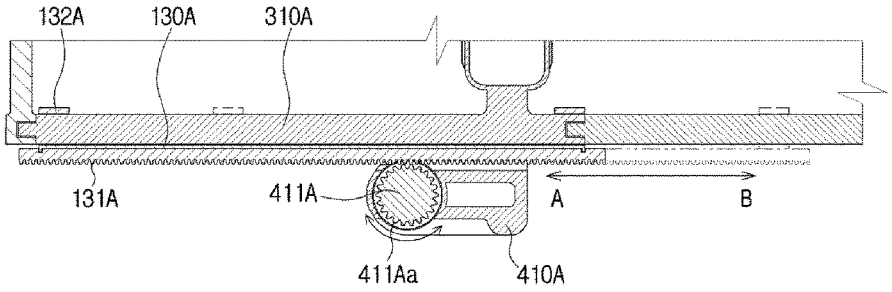
FIG. 9 is a view illustrating the movement of a vane operated by a second gear connected to a first gear of the motor assembly according to the first embodiment of the disclosure.
Figure 10:
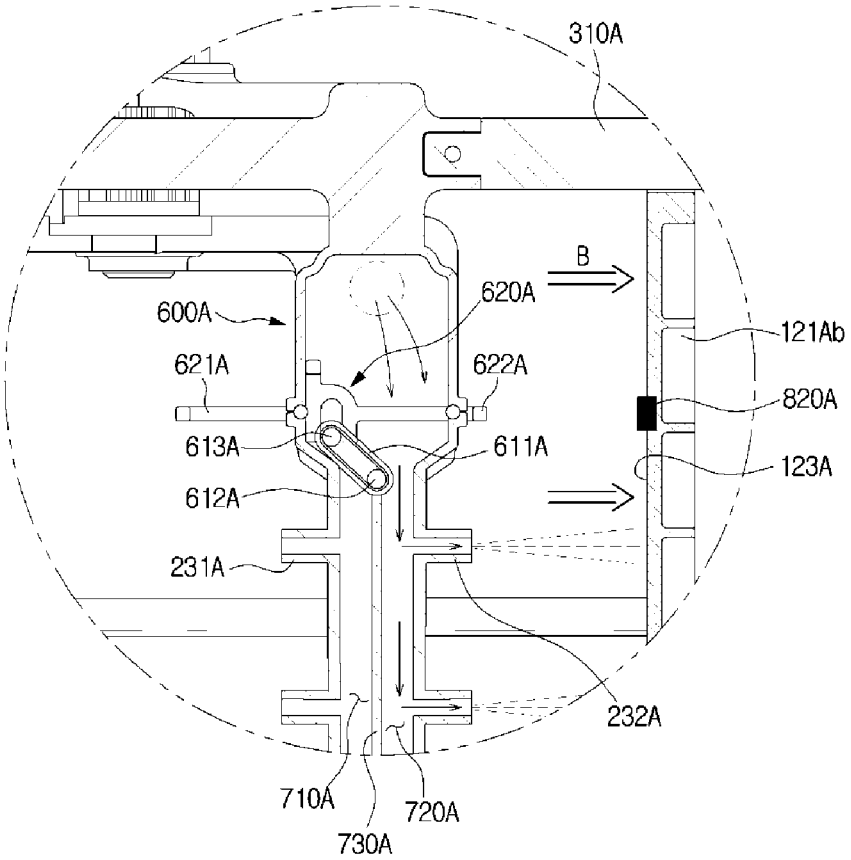
FIG. 10 is an enlarged view of portion A illustrated in FIG. 8, which illustrates the flow channel switching unit of the injection unit according to the first embodiment of the disclosure.

The first vane 121Aa and the second vane 121Ab, as illustrated in FIG. 9, are provided to be moved by the motor assembly 400A.

The second deflection unit 120A provided below the second dish basket 22A may receive power of the motor 401A due to the motor assembly 400A to move.

When the motor 401A installed on the rear wall 11Aa of the washing tub 11A rotates, the first gear portion 411A connected by the motor connection portion 412A may rotate and the first gear 411Aa may rotate due the rotation of the first gear portion 411A.

The second gear 131A engaged and connected with the first gear 411Aa may move along the rail 310A in the first direction A and the second direction B due to the rotation of the first gear 411Aa. The second gear 131A may be formed on a bottom of the rail 310A that connects the first vane 121Aa with the second vane 121Ab.

The first vane 121Aa and the second vane 121Ab may be movably connected to the rail 310A through a rail coupling portion 132A.

Due to the movement of the second gear 131A, the first vane 121Aa and the second vane 121Ab may reciprocate in the first direction A and the second direction B of the washing tub 11A.

The movement of the first vane 121Aa and the second vane 121Ab may be controlled through the sensing, by the sensor unit 800A, of the positions thereof.

A portion 8A of FIG. 8 within the broken line in FIGS. 10 to 13 illustrates a flow channel switching operation performed by the flow channel switching unit 600A according to the first embodiment of the and described as follows.

When the washing water is supplied through the second fixed nozzle 221A, the washing water may be supplied into the injection case 222A and the injection body 240A.

The washing water supplied into the injection body 240A may flow into the second injection flow channel 720A of the injection flow channel 700A in an open state due to the flow channel switching member 610A of the flow channel switching unit 600A and may be injected through the second nozzle 232A.

The washing water injected through the second nozzle 232A may deflect due to the second deflection surface 123A of the second vane 121Ab and may be injected toward the dishes in the second dish basket 22A.

The second vane 121Ab allows the washing water injected through the second nozzle 232A to deflect toward the dishes while moving along the rail 310A in the second direction B due to the motor assembly 400A.

Figure 11:
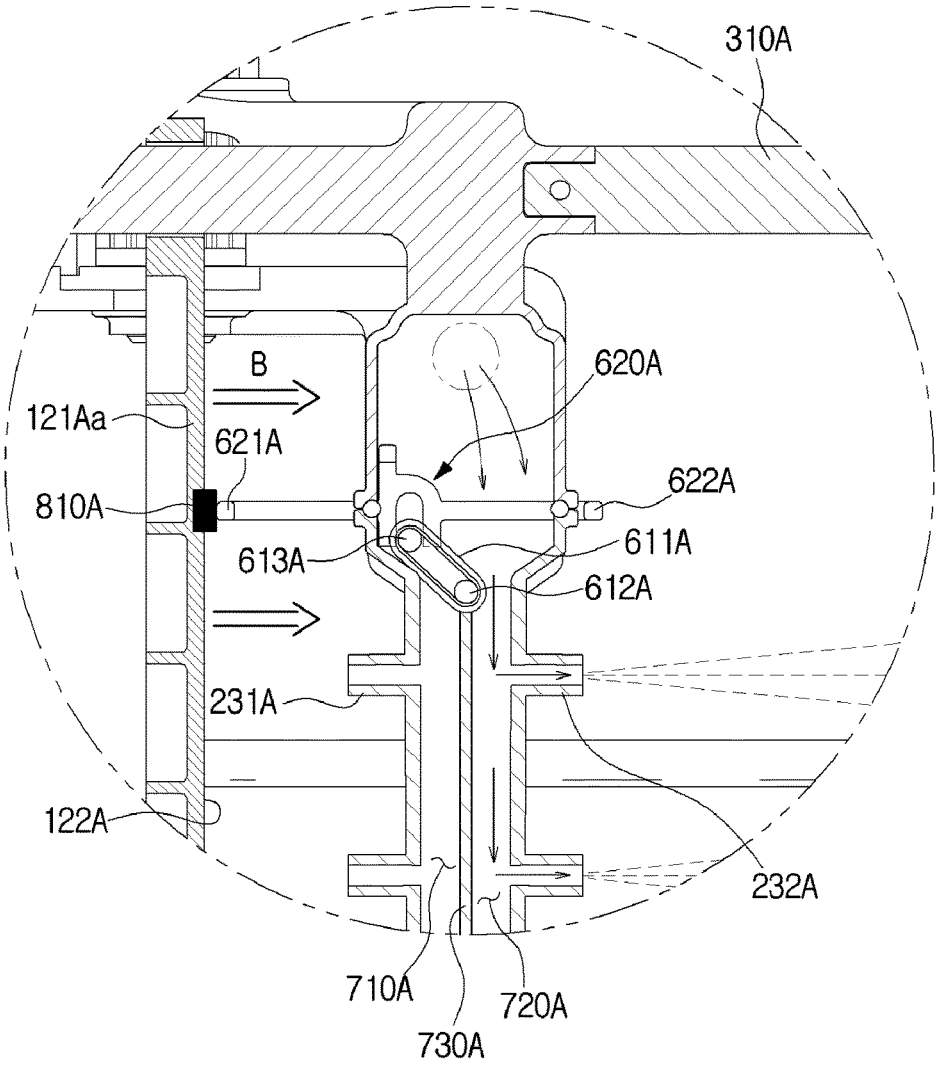
FIG. 11 is a view illustrating an operation of injecting washing water through a second injection flow channel, performed by the flow channel switching unit and a first vane according to the first embodiment of the disclosure.
Figure 12:
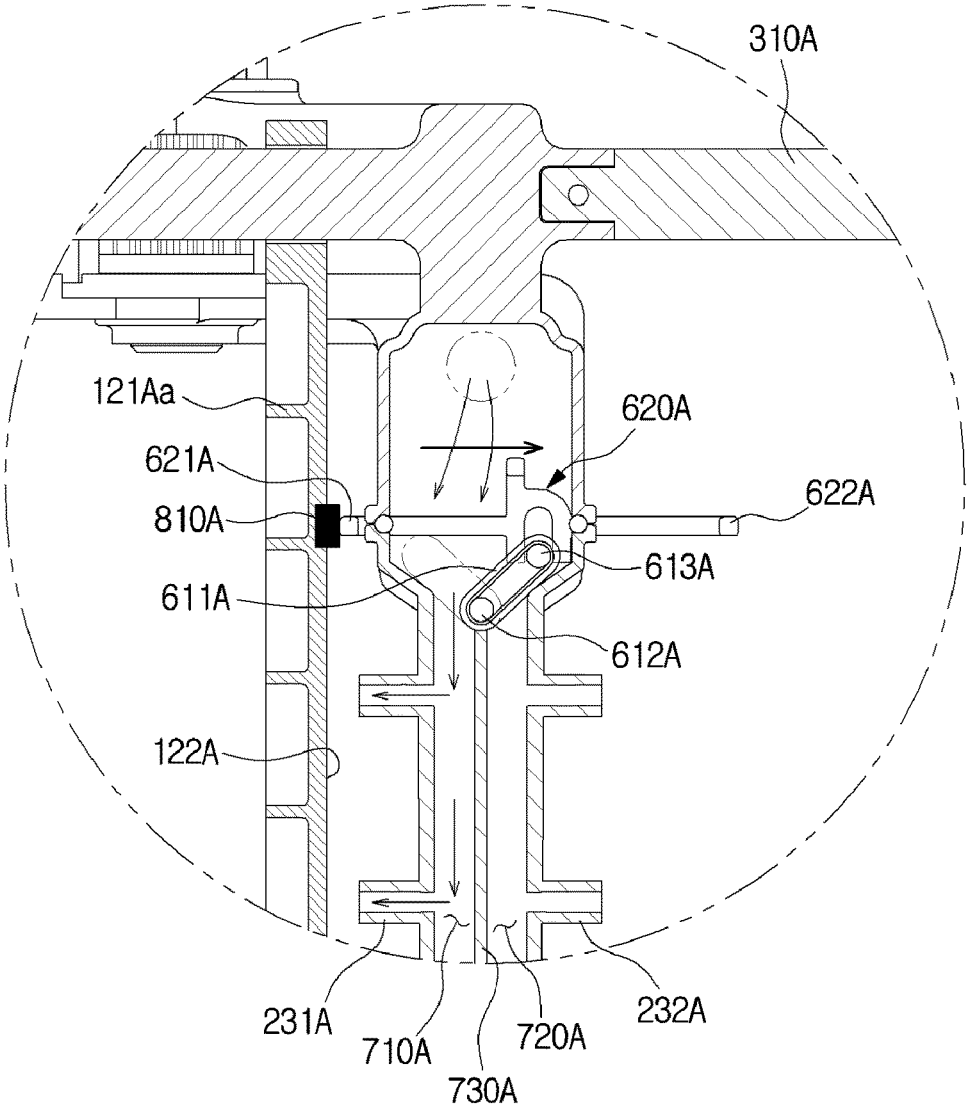
FIG. 12 is a view illustrating an operation of a flow channel switching holder of the flow channel switching unit according to the first embodiment of the disclosure.
Figure 13:
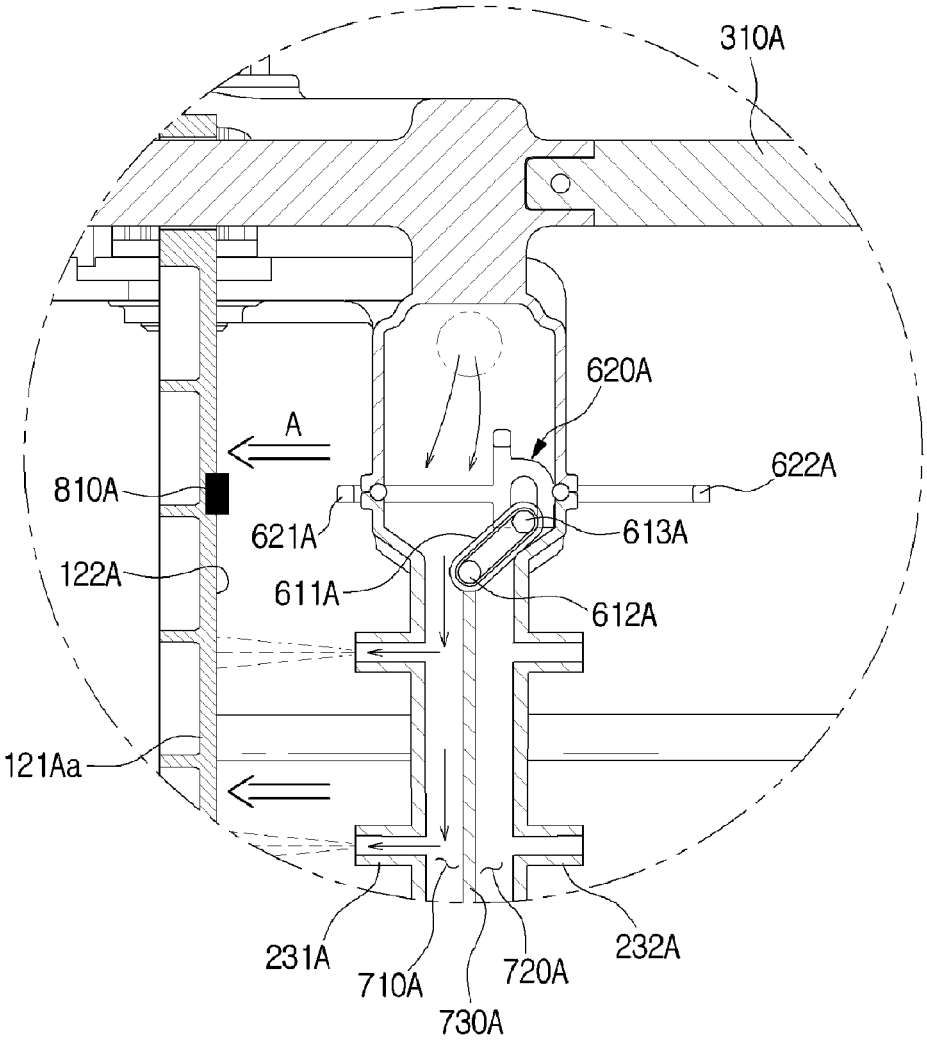
FIG. 13 is a view illustrating an operation of injecting washing water to a first injection flow channel, performed by the flow channel switching unit according to the first embodiment of the disclosure.

When the second vane 121Ab moves in the second direction B, the first vane 121Aa that interworks with the second vane 121Ab moves in the second direction B (see, for example, FIG. 11).

The first vane 121Aa pressurizes the pressurized portion 621A of the flow channel switching holder 620A while moving in the second direction B close to the first nozzle 231A.

The first pressurized portion 621A is pressurized and moves in the second direction B, and the flow channel switching movement shaft 613A of the flow channel switching holder 620A moves in the second direction B based on the flow channel switching rotation shaft 612A.

The flow channel switching member 610A may block the second injection flow channel 720A and may open the first injection flow channel 710A.

The washing water flows into the open first injection flow channel 710A and may be injected through the first nozzle 231A.

The washing water injected through the first nozzle 231A deflects due to the first deflection surface 122A of the first vane 121Aa and may be injected toward the dishes in the second dish basket 22A there above.

The first vane 121Aa allows the washing water injected through the first nozzle 231A to deflect toward the dishes while moving along the rail 310A in the first direction A due to the motor assembly 400A.

The positions of the first vane 121Aa and the second vane 121Ab may be sensed by the sensor unit 800A and the driving force of the motor 401A may be controlled, thereby controlling the movement of the first vane 121Aa and the second vane 121Ab.

The sensor unit 800A may include a first sensor portion 810A provided at the first vane 121Aa and a second sensor portion 820A provided at the second vane 121Ab.

The first sensor portion 810A may be provided to sense the position of the first vane 121Aa, and the second sensor portion 820A may be provided to sense the position of the second vane 121Ab.

Accordingly, a moving direction of the first vane 121Aa and the second vane 121Ab may be switched by the sensor unit 800A, which may be continuously performed through reciprocation between the first direction A and the second direction B.

According to an embodiment of the disclosure, as an example, the second deflection unit 120A including the first vane 121Aa and the second vane 121*ab* is installed at the second dish basket 22A, but is not limited thereto. For example, the first vane 121Aa and the second vane 121Ab of the second injection unit 220A may be applied to the first dish basket 21A located on a bottom of the dish washing machine 1A.

Figure 14:
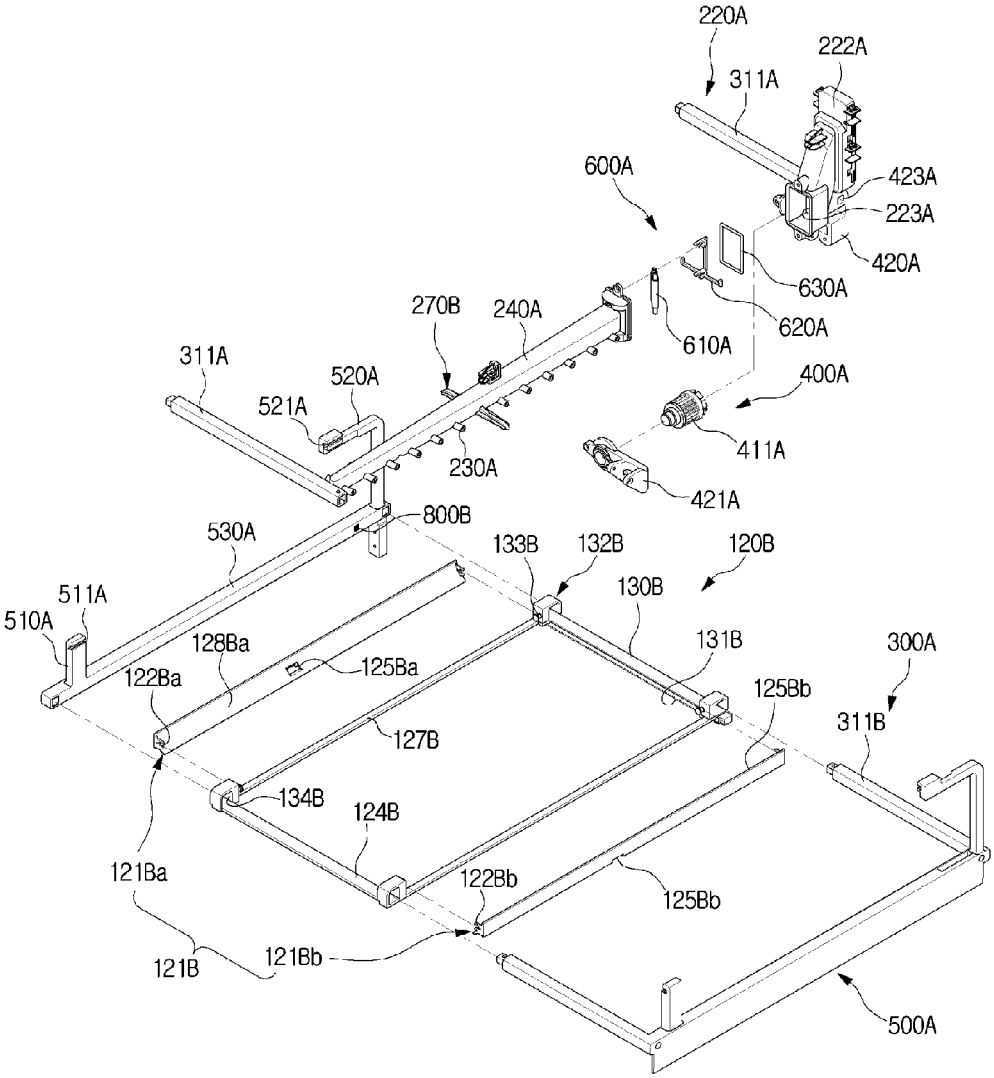
FIG. 14 is an exploded perspective view of a deflection unit according to a second embodiment of the disclosure.
Figure 15:
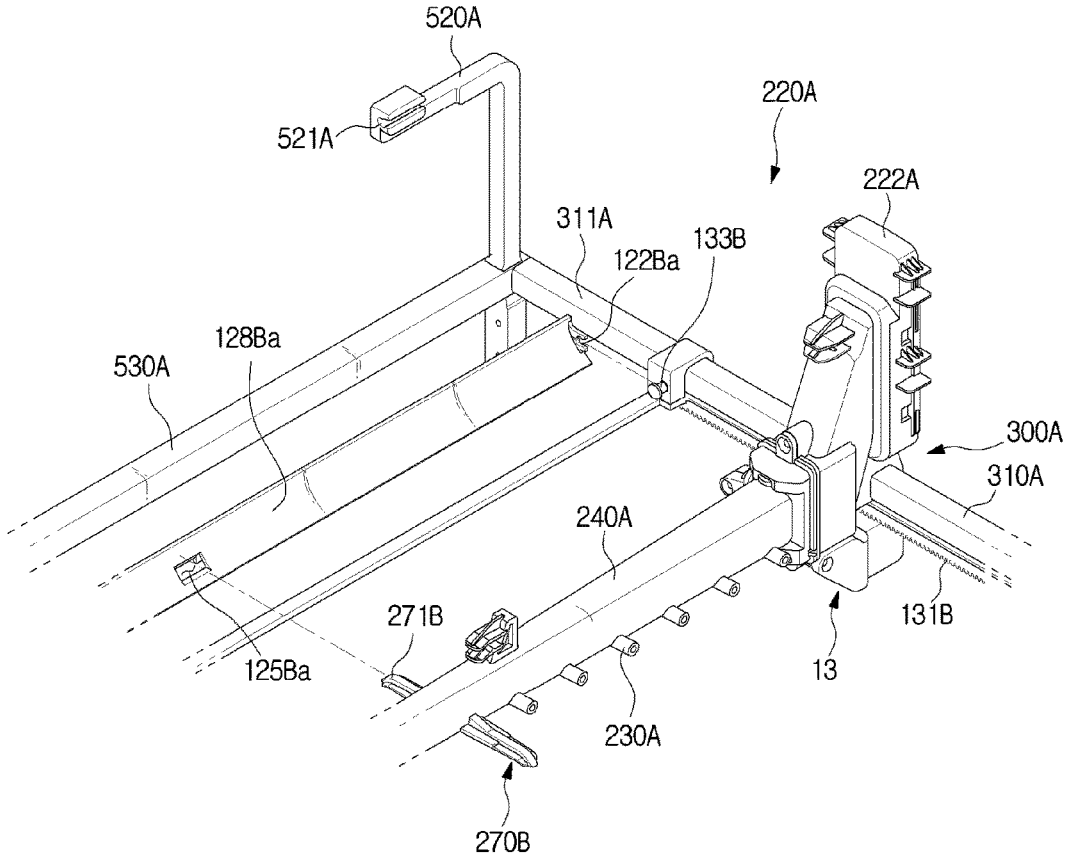
FIG. 15 is a perspective view of a rotating vane unit of the deflection unit according to the second embodiment of the disclosure.
Figure 16:
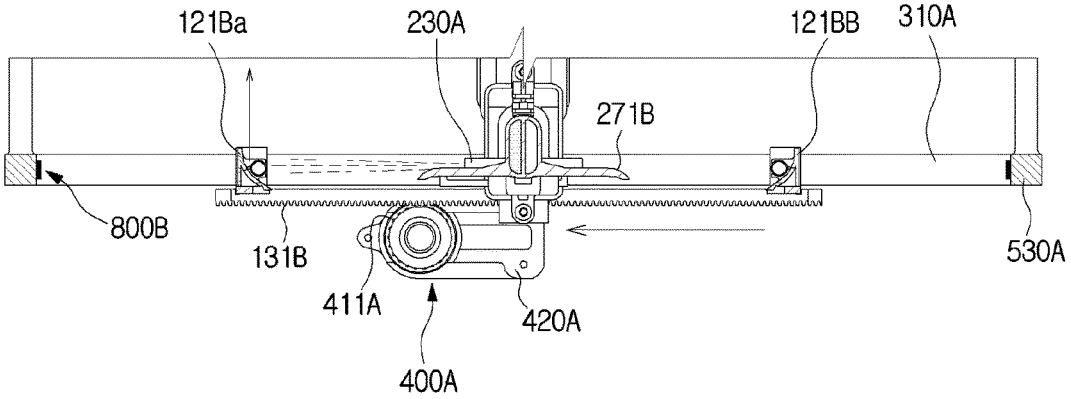
FIG. 16 is a view illustrating the movement of the rotating vane unit of the deflection unit according to the second embodiment of the disclosure.
Figure 17:
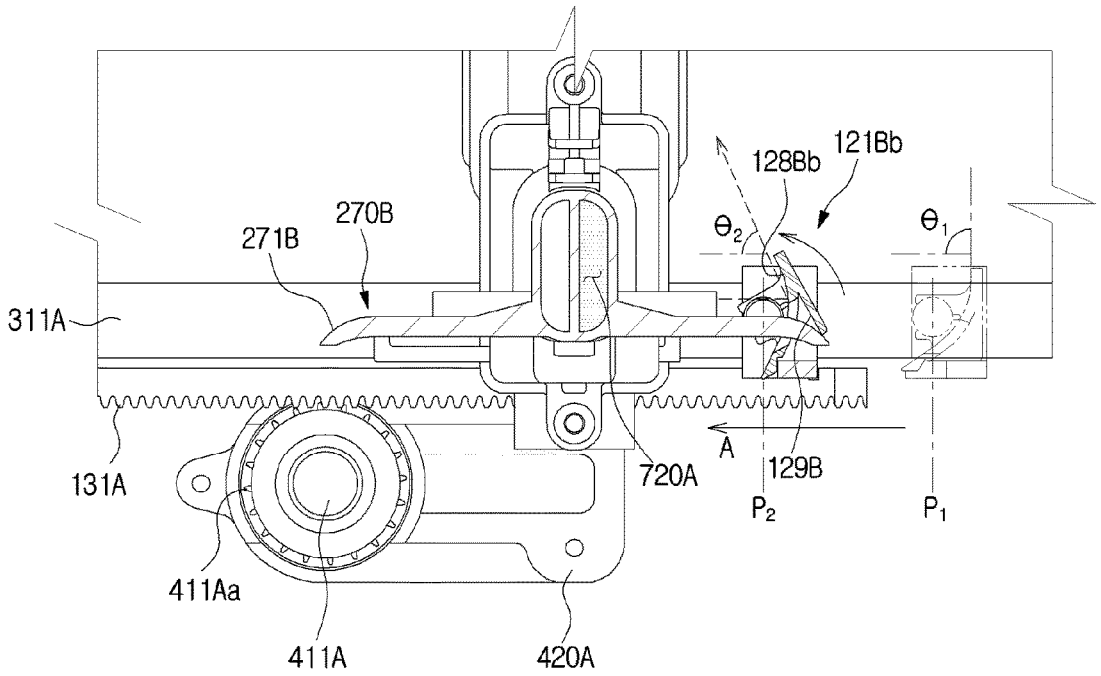
FIGS. 17 to 19 are views illustrating rotating operations of rotating vanes of the rotating vane unit according to the second embodiment of the disclosure.
Figure 18:
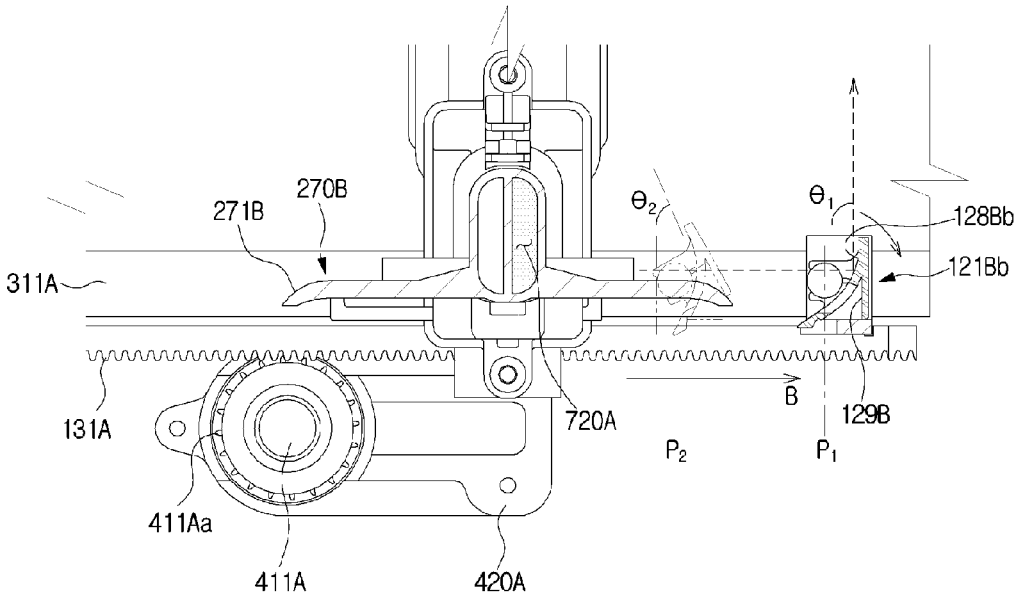
Figure 19:
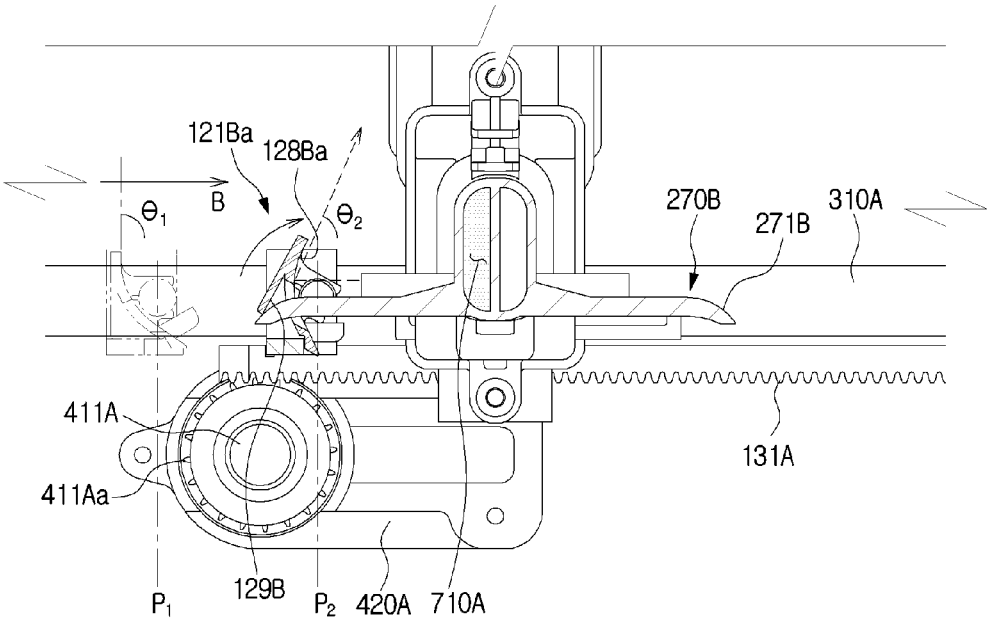

FIG. 14 is an exploded perspective view of a deflection unit 120B according to a second embodiment of the disclosure. FIG. 15 is a perspective view of a rotating vane unit 121B of the deflection unit 120B according to the second embodiment of the disclosure. FIG. 16 is a view illustrating the movement of the rotating vane unit 121B of the deflection unit 120B according to the second embodiment of the disclosure. FIGS. 17 to 19 are views illustrating rotating operations of rotating vanes 121Ba and 121Bb of the rotating vane unit 121B according to the second embodiment of the disclosure. Hereinafter, reference numerals not illustrated in the drawings can be found with reference to FIGS. 1 to 12. Also, descriptions that are the same as those with reference to FIGS. 1 to 12 may be omitted.

As illustrated in FIGS. 14 to 19, the second deflection unit 120B according to the second embodiment of the disclosure may be provided to be rotatable at a certain angle to switch a moving direction of the washing water.

The second injection unit 220A includes the injection case 222A and the injection body 240A connected to the injection case 222A and including the injection flow channel 700A therein and the injection nozzle 230A to inject the washing water provided on both sides thereof. The injection nozzle 230A may be formed in a plurality thereof on the left and right of the injection body 240A. The injection nozzle 230A may include the first nozzle 231A and the second nozzle 232A.

The injection flow channel 700A may be formed inside the injection body 240A. The second injection unit 220A may include the flow channel switching unit 600A to inject the washing water through at least one of the first nozzle 231A and the second nozzle 232A.

Since a detailed configuration of the flow channel switching unit 600A is similar to the first embodiment, a detailed description thereof will be omitted.

The second deflection unit 120B may be provided to be rotatable at a certain angle to switch the moving direction of the injected washing water.

The washing water injected toward the first direction A and the second direction B of the washing tub 11A through the second injection unit 220A may deflect toward the dishes on top through the second deflection unit 120B installed below the second dish basket 22A.

The second deflection unit 120B includes the rotating vane unit 121B provided to linearly reciprocate and to be rotatable in a direction in which the washing water is injected.

The rotating vane unit 121B may include a first rotating vane 121Ba disposed to allow the washing water injected through the first nozzle 231A of the injection nozzle 230A to deflect and a second rotating vane 121Bb disposed to allow the washing water injected through the second nozzle 232A to deflect.

The first rotating vane 121Ba and the second rotating vane 121Bb may be interconnected to interwork with each other. The first rotating vane 121Ba and the second rotating vane 121Bb may be connected by a vane connection portion 124B. The first rotating vane 121Ba and the second rotating vane 121Bb may be spaced at a certain interval due to the vane connection portion 124B. The vane connection portion 124B may be provided to connect front ends of the first rotating vane 121Aa and the second rotating vane 121Ab.

The first rotating vane 121Ba and the second rotating vane 121Bb may include a moving rail 130B connect rear ends thereof. The moving rail 130B may be provided to have a length corresponding to the vane connection portion 124B to connect the first rotating vane 121Ba and the second rotating vane 121Bb.

A second gear 131B corresponding to the first gear 411Aa of the motor assembly 400A may be formed on a bottom of the moving rail 130B.

Reinforcing ribs 127B may be provided between the vane connection portion 124B and the moving rail 130B. The reinforcing ribs 127B may be provided to connect the vane connection portion 124B with the moving rail 130B with a certain interval to reinforce the strength of the first rotating vane 121Ba and the second rotating vane 121Bb.

Vane holders 132B to movably connect the rotating vane unit 121B with the rail assembly 300A may be provided at corners of the vane connection portion 124B and the moving rail 130B.

The vane holders 132B may be at a connection portion between the vane connection portion 124B and the first rotating vane 121Ba, a connection portion between the vane connection portion 124B and the second rotating vane 121Bb, a connection portion between the moving rail 130B and the first rotating vane 121Ba, and a connection portion between the moving rail 130B and the second rotating vane 121Bb, respectively.

The vane holders 132B may include rail coupling holes to allow the rail 310A of the rail assembly 300A to penetrate and to move and rotating protrusions 133B to allow the first and second rotating vanes 121Ba and 121Bb to be rotatably installed.

The rail coupling holes 134B may be formed on the left and right of the vane holder 132B to allow the vane holder 132B to be movable along the rail 310A in the first direction A and the second direction B.

The rotating protrusions 133B may be disposed on inner surfaces of the vane holders 132B to rotatably connect the first rotating vane 121Ba with the second rotating vane 121Bb.

One end of each of the first rotating vane 121Ba and the second rotating vane 121Bb in a longitudinal direction may be adjacent to the front side of the washing tub 11A and the other ends thereof may be formed adjacently to the rear side of the washing tub 11A.

Rotating protrusion coupling grooves 122Ba and 122Bb coupled with the rotating protrusions 133B of the vane holders 132B may be formed on both ends of the first rotating vane 121Ba and the second rotating vane 121Bb.

Accordingly, the first rotating vane 121Ba and the second rotating vane 121Bb may be rotatable through coupling between the rotating protrusion coupling grooves 122Ba and 122Bb at both ends thereof and the rotating protrusions 133B of the vane holders 132B.

The first rotating vane 121Ba and the second rotating vane 121Bb may be disposed in parallel. The first rotating vane 121Ba and the second rotating vane 121Bb may be interconnected to interwork with each other.

The first rotating vane 121Ba and the second rotating vane 121Bb may include rotating deflection surfaces 128B to allow the washing water injected from the second injection unit 220A to deflect.

The first rotating vane 121Ba and the second rotating vane 121Bb may include rotating deflection surfaces 128B to allow the washing water injected through the first nozzle 231A and the second nozzle 232A to deflect, respectively. The first rotating vane 121Ba may include a first rotating deflection surface 128Ba, and the second rotating vane 121Bb may include a second rotating deflection surface 128Bb.

The first rotating vane 121Ba may be installed to be able to linearly reciprocate along the first direction A of the washing tub 11A and the second direction B opposite to the first direction A. The second rotating vane 121Bb may be provided to interwork according to the first rotating vane 121Ba.

The first rotating vane 121Ba and the second rotating vane 121Bb reciprocate along the rail 310A of the rail assembly 300A in the first direction A and the second direction B.

The first rotating vane 121Ba and the second rotating vane 121Bb rotate near the injection nozzles 230A in the center of the washing tub 11A. The first rotating vane 121Ba and the second rotating vane 121Bb may rotate to allow the washing water injected from the center to deflect to be injected toward the center portion of the washing tub 11A.

According to an embodiment of the disclosure, as an example, rotation positions of the first rotating vane 121Ba and the second rotating vane 121Bb are in the center of the rail assembly 300A, but it is not limited thereto. However, for convenience of description, it may be assumed that a rotating vane rotates in the center.

The first rotating vane 121Ba and the second rotating vane 121Bb each may include a rotation guide hole 125B for guiding rotation in the center thereof. The first rotating vane 121Ba may include a first rotation guide hole 125Ba, and the second rotating vane 121Bb may include a second rotation guide hole 125Bb.

Rotation guides 270B may be formed on both sides of the injection body 240A. The rotation guides 270B protrude from left and right sides of the injection body 240A, respectively. The rotation guide 270B may be formed to be longer than the first nozzle 231A and the second nozzle 232A of the injection body 240A.

The rotation guide 270B may include a rotation guide surface 271B whose top surface of an outer cross section is formed with a downward curvature.

Accordingly, the rotation guides 270B may be inserted into the first rotation guide hole 125Ba of the first rotating vane 121Ba and the second rotation guide hole 125Bb of the second rotating vane 121Bb and pressurize the first rotating vane 121Ba and the second rotating vane 121Bb in an opposite direction of the movement thereof, thereby rotating the first rotating vane 121Ba and the second rotating vane 121Bb.

However, as illustrated in FIG. 16, the first rotating vane 121Ba and the second rotating vane 121Bb may reciprocate along the rail 310A due to the motor assembly 400A.

Since the detailed description of the flow channel switching unit 400A is similar to the first embodiment, it will be omitted.

The driving force of the motor 401A may be transferred to the first gear 411Aa of the first gear portion 411A and the rotation of the first gear 411Aa moves the second gear 131B engaged with the first gear 411Aa.

The second gear 131B may move along the rail 310A in the first direction A and the second direction B due to the rotation of the first gear 411Aa. The first rotating vane 121Ba and the second rotating vane 121Bb connected to the moving rail 130B formed with the second gear 131B also move in the first direction A and the second direction B.

The movement of the first rotating vane 121Ba and the second rotating vane 121Bb may be sensed and controlled by a sensor unit 800B. The sensor unit 800B may be installed inside the holder frame 530A to sense moving positions of the first rotating vane 121Ba and the second rotating vane 121Bb.

FIGS. 17 to 19 illustrate a rotating operation of the rotating vane unit 121B according to the second embodiment of the disclosure.

When the first gear 411Aa rotates due to the rotation of the motor 401A, the second gear moves in the first direction A while being engaged with the first gear 411Aa. The washing water may be supplied to the second injection flow channel 720A inside the injection body 240A and may be injected through the second nozzle 232A.

The second rotating vane 121Bb moves from a first position P1 at a first angle θ1. The first position P1 is a position in which the second rotating vane 121Bb moves without rotation. The first angle θ1 is an angle at which the second rotating vane 121Bb does not rotate. The first angle θ1 at which the second rotating vane 121Bb does not rotate may include an angle approximately perpendicular to the washing water to allow the washing water injected from the second nozzle 232A to deflect upward.

When the second rotating vane 121Bb moves, e.g., further moves toward the second nozzle 232A and moves to a second position P2, the rotation guide 270B may be inserted into the rotation guide hole 125B of the second rotating vane 121Bb. The rotation guide surface 271B of the rotation guide 270B is in contact with a rotation contact surface 129B formed on a bottom end of a rear side of the second rotating vane 121Bb and rotates the second rotating vane 121Bb.

The second rotating vane 121Bb rotates on the rotation protrusion 133B and forms a second angle θ2. The second angle θ2 may be formed to allow the washing water injected from the second nozzle 232A to deflect toward the center of the washing tub 11.

When the second rotating vane 121Bb moves in the second direction B of the washing tub 11A and moves from the second position P2 to the first position P1, the second rotating vane 121Bb rotates from the second angle θ2 at which the washing water deflects toward the center of the washing tub 11A to have the first angle θ1 at which the washing water deflects toward the top of the washing tub 11A.

As illustrated in FIG. 19, an operation of the first rotating vane 121Ba is similar to the movement and rotation operations of the second rotating vane 121Bb. A detailed description thereof will be omitted.

The washing water may be supplied to the first injection flow channel 710A inside the injection body 240A and may be injected through the first nozzle 231A.

Figure 20:
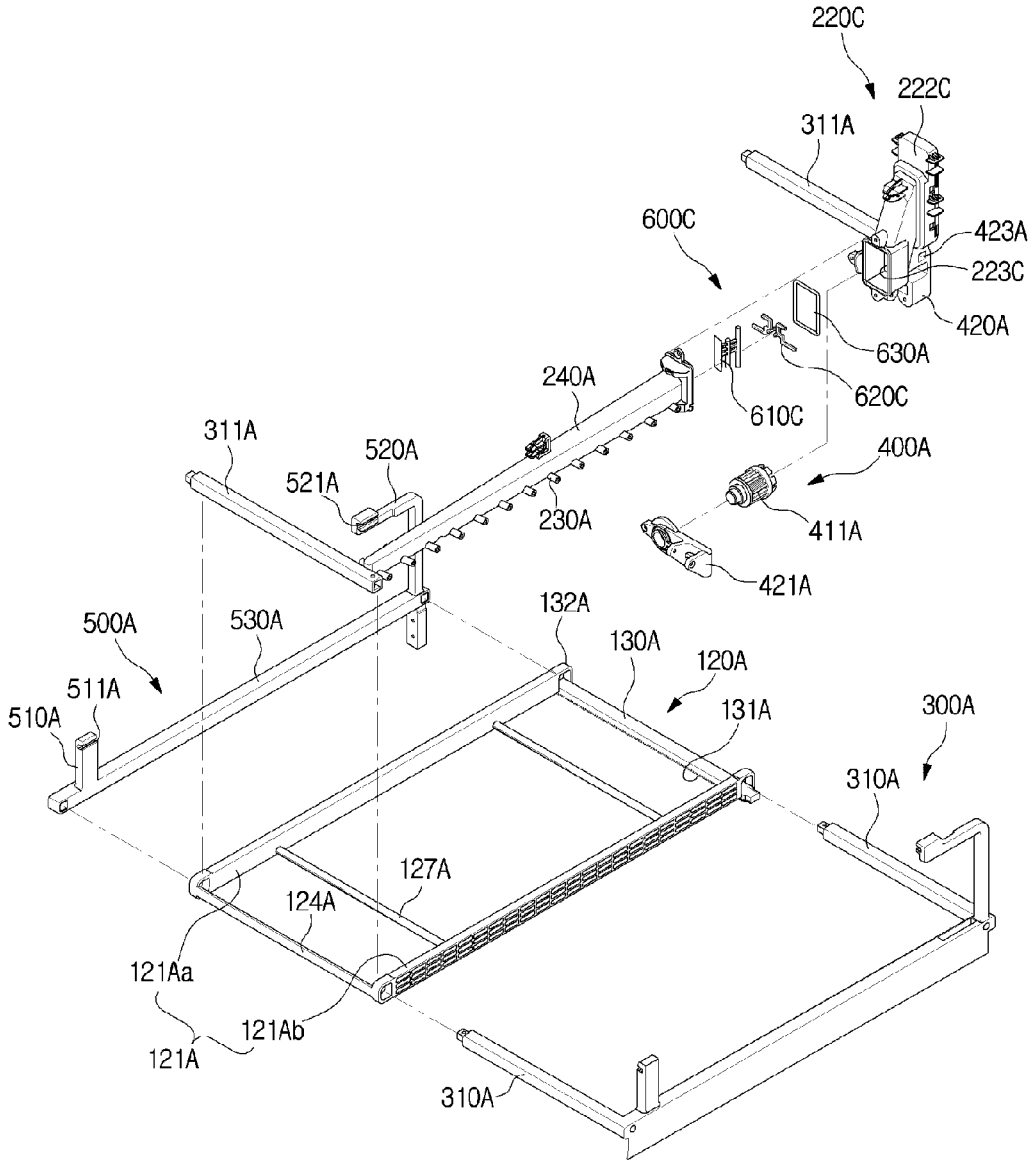
FIG. 20 is an exploded perspective view of an injection unit including a flow channel switching unit installed therein according to a third embodiment of the disclosure.
Figure 21:
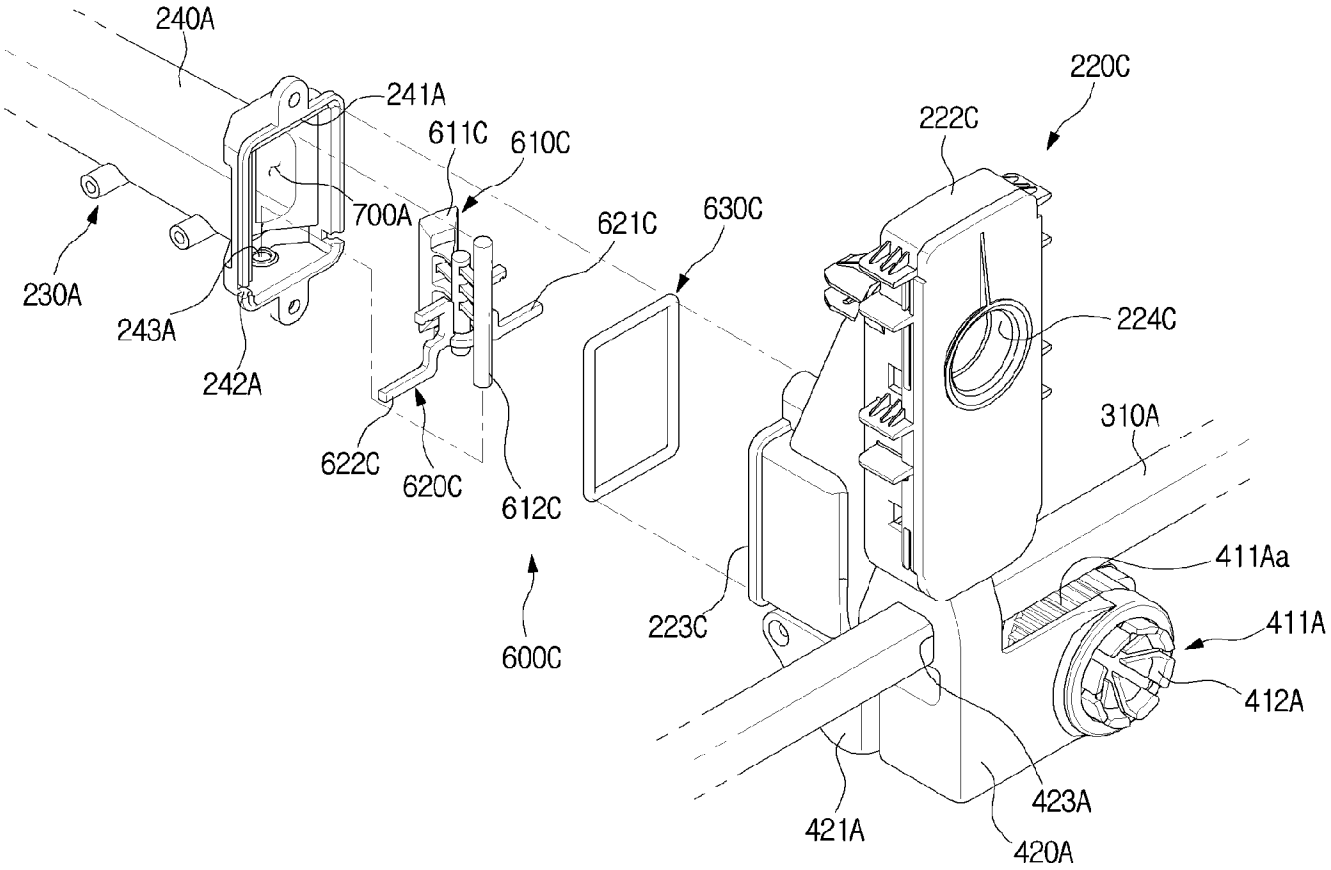
FIG. 21 is an exploded perspective view of the flow channel switching unit according to the third embodiment of the disclosure.
Figure 22:
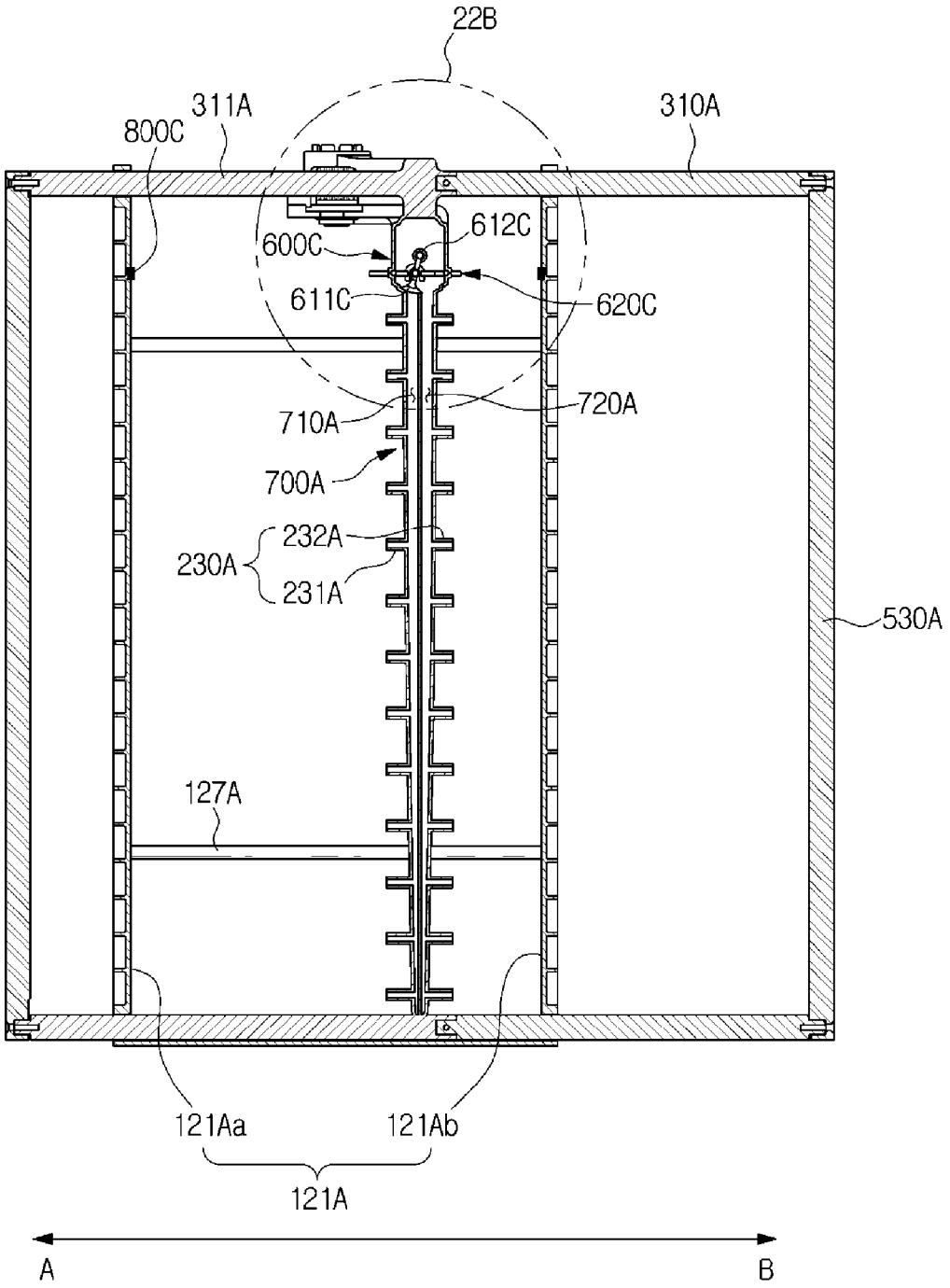
FIG. 22 is a view illustrating the injection unit and the flow channel switching unit according to the third embodiment of the disclosure.
Figure 23:
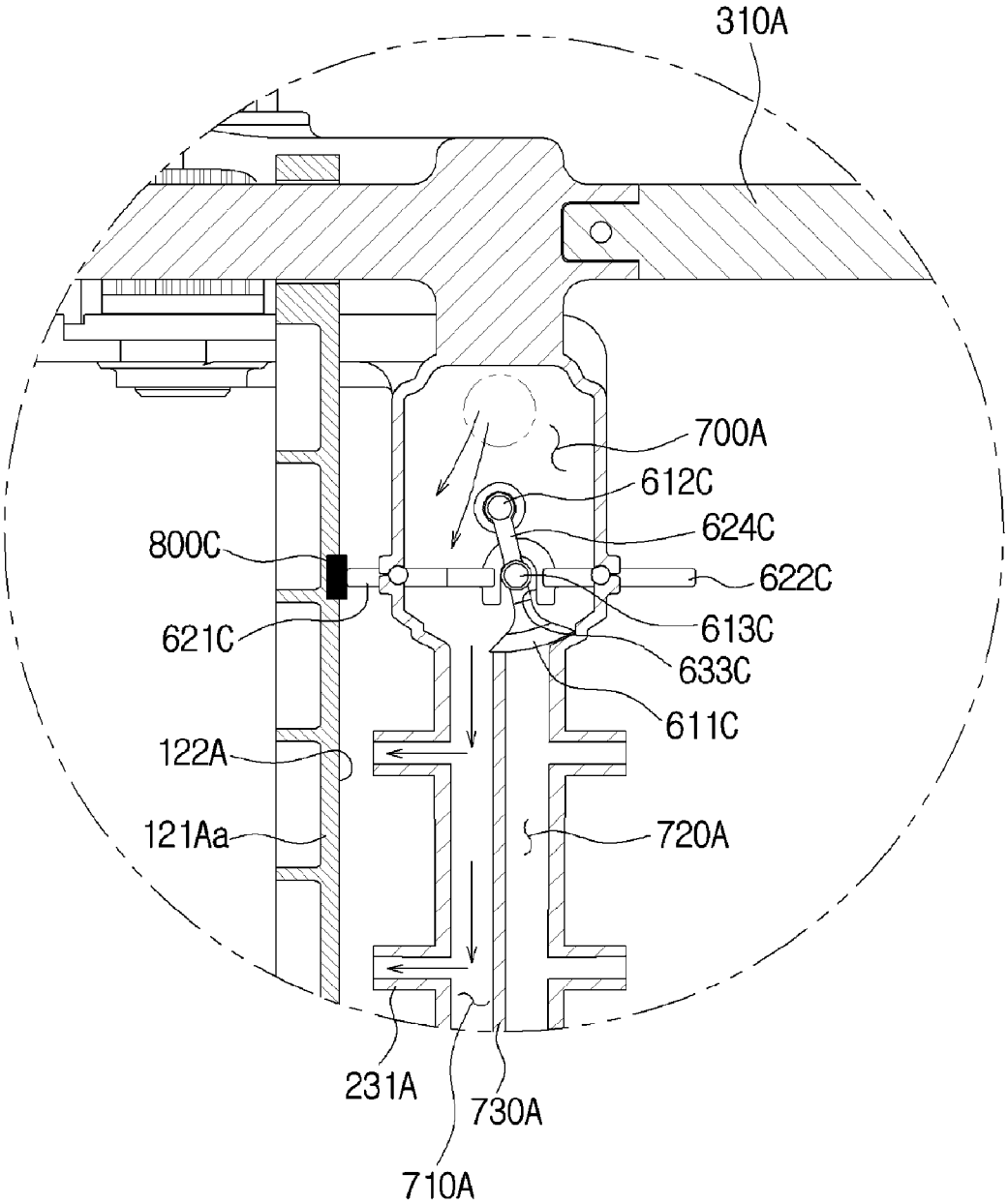
FIGS. 23 and 24 are views illustrating an operation of the flow channel switching unit according to the third embodiment of the disclosure.
Figure 24:
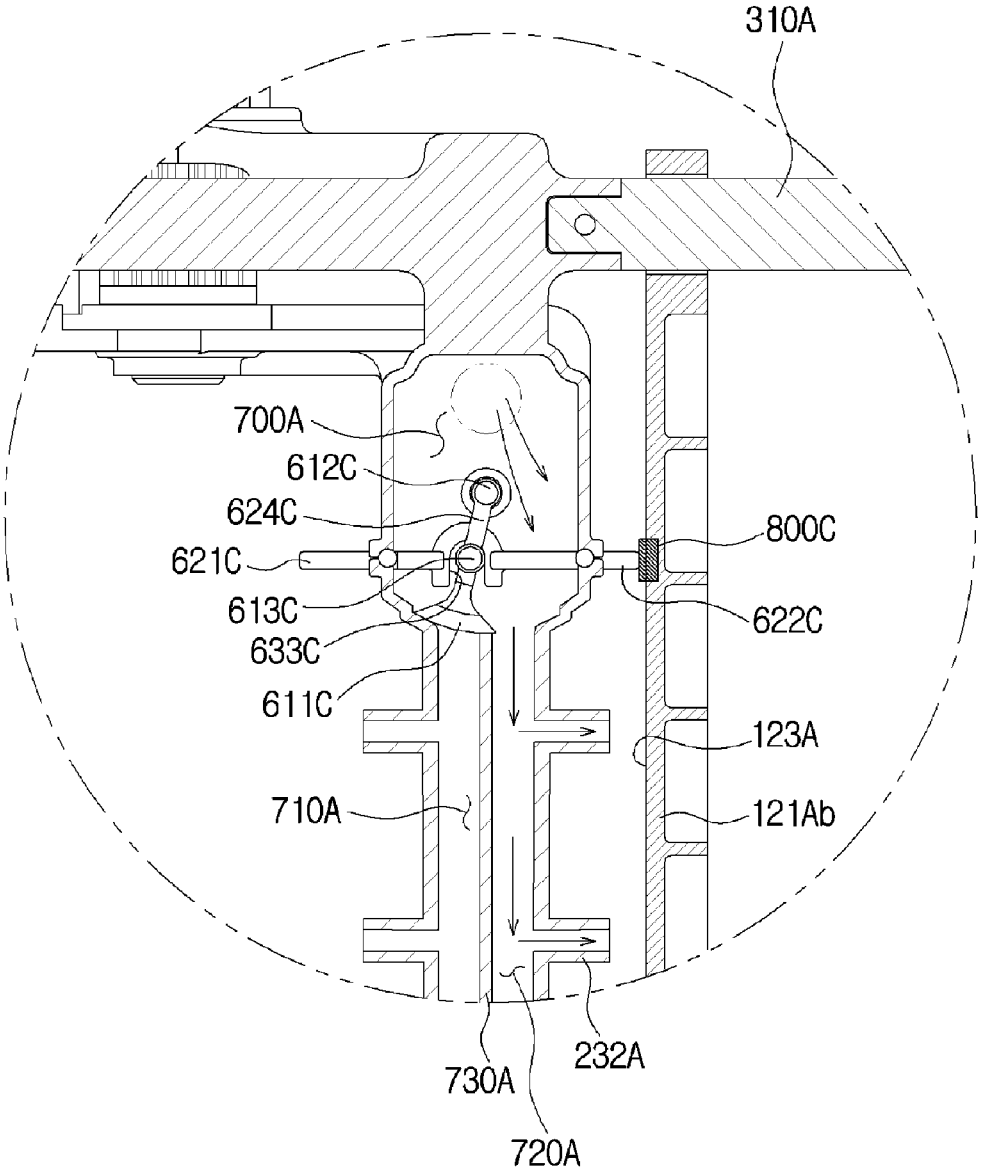

FIG. 20 is an exploded perspective view of an injection unit including a flow channel switching unit 600C installed therein according to a third embodiment of the disclosure. FIG. 21 is an exploded perspective view of the flow channel switching unit 600C according to the third embodiment of the disclosure. FIG. 22 is a view illustrating the injection unit and the flow channel switching unit 600C according to the third embodiment of the disclosure. A portion 22B of FIG. 22 within the broken line is illustrated in FIGS. 23 and 24 illustrating an exemplary operation of the flow channel switching unit 600C according to the third embodiment of the disclosure. Hereinafter, reference numerals not illustrated in the drawings can be found with reference to FIGS. 1 to 19. Also, descriptions that are the same as those with reference to FIGS. 1 to 19 may be omitted.

As illustrated in FIGS. 20 to 22, the flow channel switching unit 600C according to the third embodiment of the disclosure may be disposed between the injection case connection portion 241A of the injection body 240A and the injection body connection portion 223A of the injection case 222A.

The flow channel switching unit 600C may include a flow channel switching member 610C, a flow channel switching holder 620C, and a sealing member 630C.

The flow channel switching member 610C may be rotatably installed to open and close the injection flow channel 700A. The flow channel switching member 610C may include a flow channel switching panel 611C having a fan shape.

The outside of the flow channel switching panel 611C may be formed of a sealing material, for example, including rubber to fully seal the injection flow channel 700A.

The flow channel switching panel 611C may be provided in front of member 610C, and a flow channel switching rotation shaft 612C to rotate the flow channel switching panel 611C may be provided in the rear thereof.

The flow channel switching rotation shaft 612C may be rotatably supported by the rotation shaft fixing groove 243A of the injection body 240A. The rotation shaft fixing groove 243A may be formed on an end of the partition 730A for dividing the injection flow channel 700A into the first injection flow channel 710A and the second injection flow channel 720A.

The holder installation portion 242A to allow a flow channel switching holder 620C to be installed therein may be formed in the injection case connection portion 241A of the injection body 240A. The holder installation portion 242A may be split and formed on each of the left and right of the injection body 240A.

A sealing member 630A to seal, for example for fully sealing the injection flow channel 700A may be provided between the injection body 240A and the injection case 222A, the.

A flow channel switching movement shaft 613C may be formed in the center of the flow channel switching holder 620C. The flow channel switching holder 620C may include a first pressurized portion 621C formed to protrude toward the first direction A based on a movement slit 623C in the center and a second pressurized portion 622C formed to protrude toward the second direction B.

The flow channel switching movement shaft 613C may slidably move in the first direction A or the second direction B due to the first pressurized portion 621C and the second pressurized portion 622C. Due to the movement of the flow channel switching movement shaft 613C, the flow channel switching member 610C may be rotated about the flow channel switching rotation shaft 612C.

For example, when the first pressurized portion 621C of the flow channel switching holder 620C is pressurized in the second direction B, the flow channel switching panel 611C of the flow channel switching member 610C moves to close the second injection flow channel 720A while the flow channel switching movement shaft 613C rotates about the flow channel switching rotation shaft 612C in the second direction B. When the second pressurized portion 622C is pressurized in the first direction A, the flow channel switching panel 611C of the flow channel switching member 610C moves to close the first injection flow channel 710A while the flow channel switching movement shaft 613C rotates about the flow channel switching rotation shaft 612C in the first direction A.

FIGS. 23 and 24 illustrate a flow channel switching operation performed by the flow channel switching unit 600C according to the third embodiment as follows.

When the washing water is supplied through the second fixed nozzle 221A, the washing water may be supplied into the injection case 222A and the injection body 240A.

The washing water supplied into the injection body 240A flows into the first injection flow channel 710A of the injection flow channel 700A in an open state due to the flow channel switching member 610C of the flow channel switching unit 600C and may be injected through the first nozzle 231A.

The washing water injected through the first nozzle 231A deflects due to the first deflection surface 122A of the first vane 121Aa and may be injected toward the dishes in the second dish basket 22A thereabove.

The first vane 121Aa deflects the washing water injected through the second nozzle 232A toward the dishes while moving along the rail 310A in the second direction B due to the motor assembly 400A.

When the first vane 121Aa moves close to the first nozzle 231A, the sensor unit 800C may be in contact with the first pressurized portion 621C of the flow channel switching holder 620C. The sensor unit 800C switches a moving direction of the first vane 121Aa by controlling the motor assembly 400A.

When the moving direction of the first vane 121Aa is switched and the first vane 121Aa moves in the first direction A, the second vane 121Ab may also move in the first direction A.

The first pressurized portion 621A may be pressurized and move in the first direction A, and the flow channel switching movement shaft 613C of the flow channel switching holder 620C may move in the first direction A based on the flow channel switching rotation shaft 612C.

The flow channel switching member 610C may block the second injection flow channel 720A and may open the first injection flow channel 710A.

The washing water flows into the open first injection flow channel 710A and may be injected through the first nozzle 231A.

The washing water injected through the first nozzle 231A deflects due to the first deflection surface 122A of the first vane 121Aa and may be injected toward the dishes in the second dish basket 22A thereabove.

The first vane 121Aa deflects the washing water injected through the first nozzle 231A toward the dishes while moving along the rail 310A in the first direction A due to the motor assembly 400A.

The positions of the first vane 121Aa and the second vane 121Ab may be sensed by a sensor unit 800C and the driving force of the motor 401A is controlled, thereby controlling the movement of the first vane 121Aa and the second vane 121Ab.

Accordingly, moving directions of the first vane 121Aa and the second vane 121Ab are switched by the sensor unit 800C, and the process may be continuously performed through reciprocation between the first direction A and the second direction B.

Figure 25:
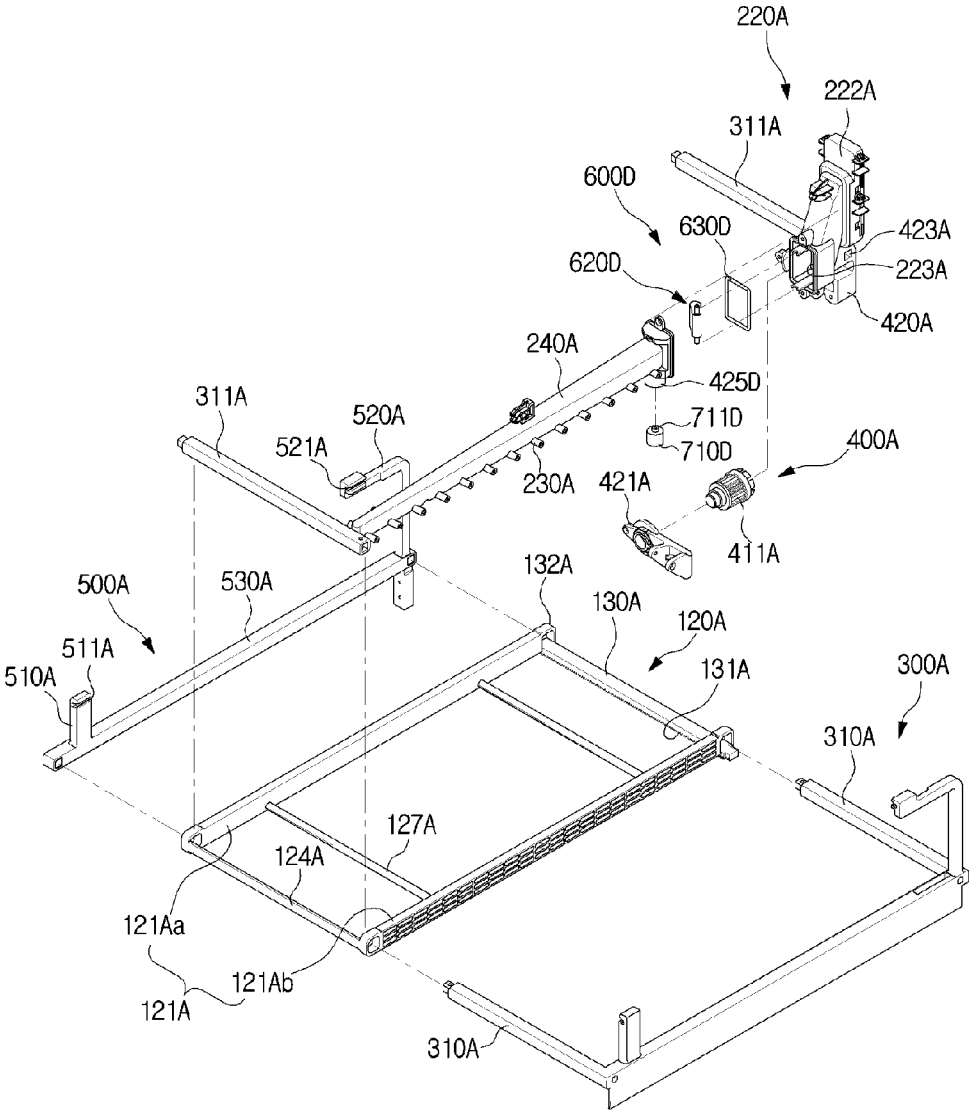
FIG. 25 is a view illustrating an injection unit and a flow channel switching unit according to a fourth embodiment of the disclosure.
Figure 26:
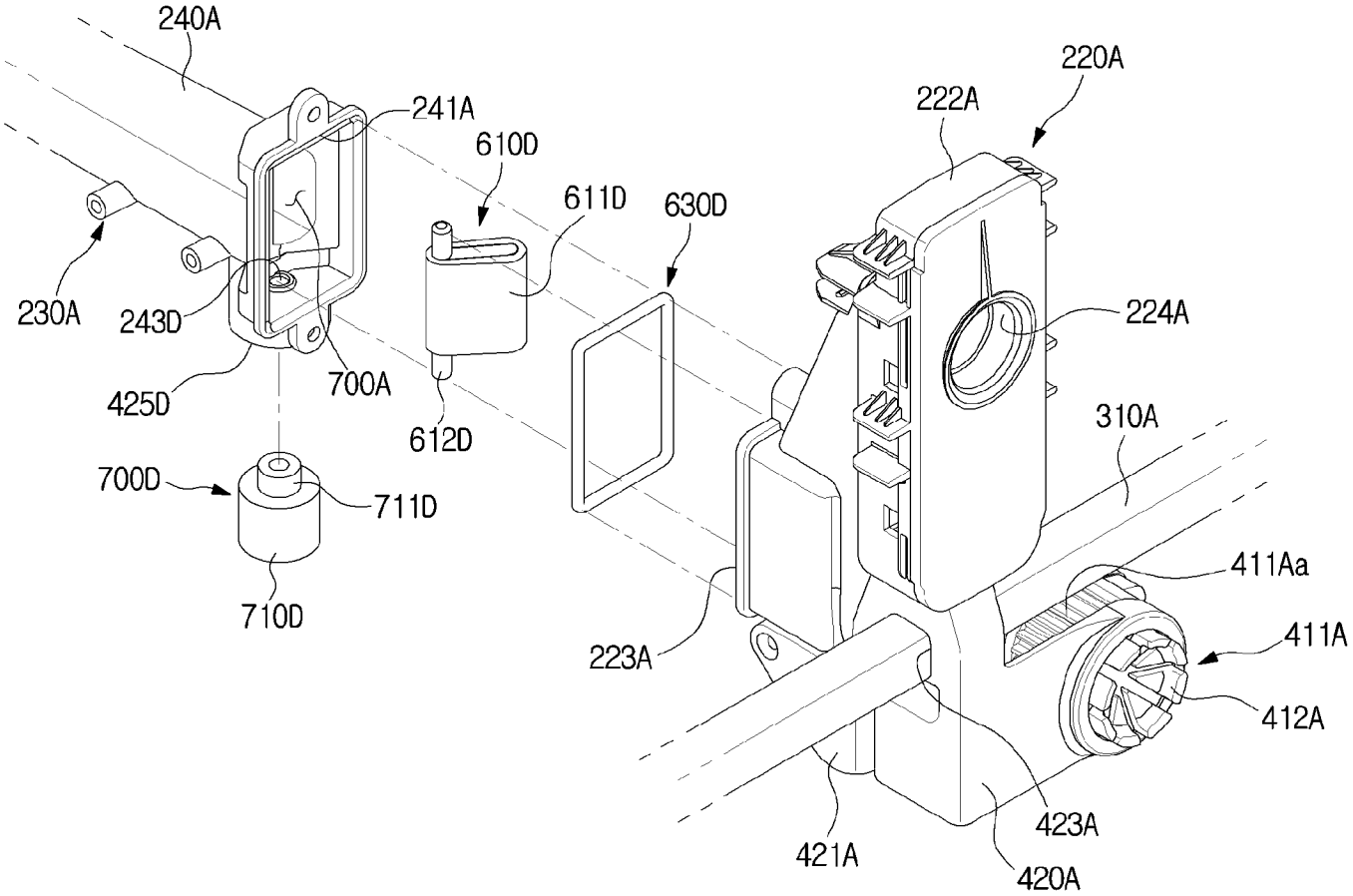
FIG. 26 is an exploded perspective view of the flow channel switching unit according to the fourth embodiment of the disclosure.
Figure 27:
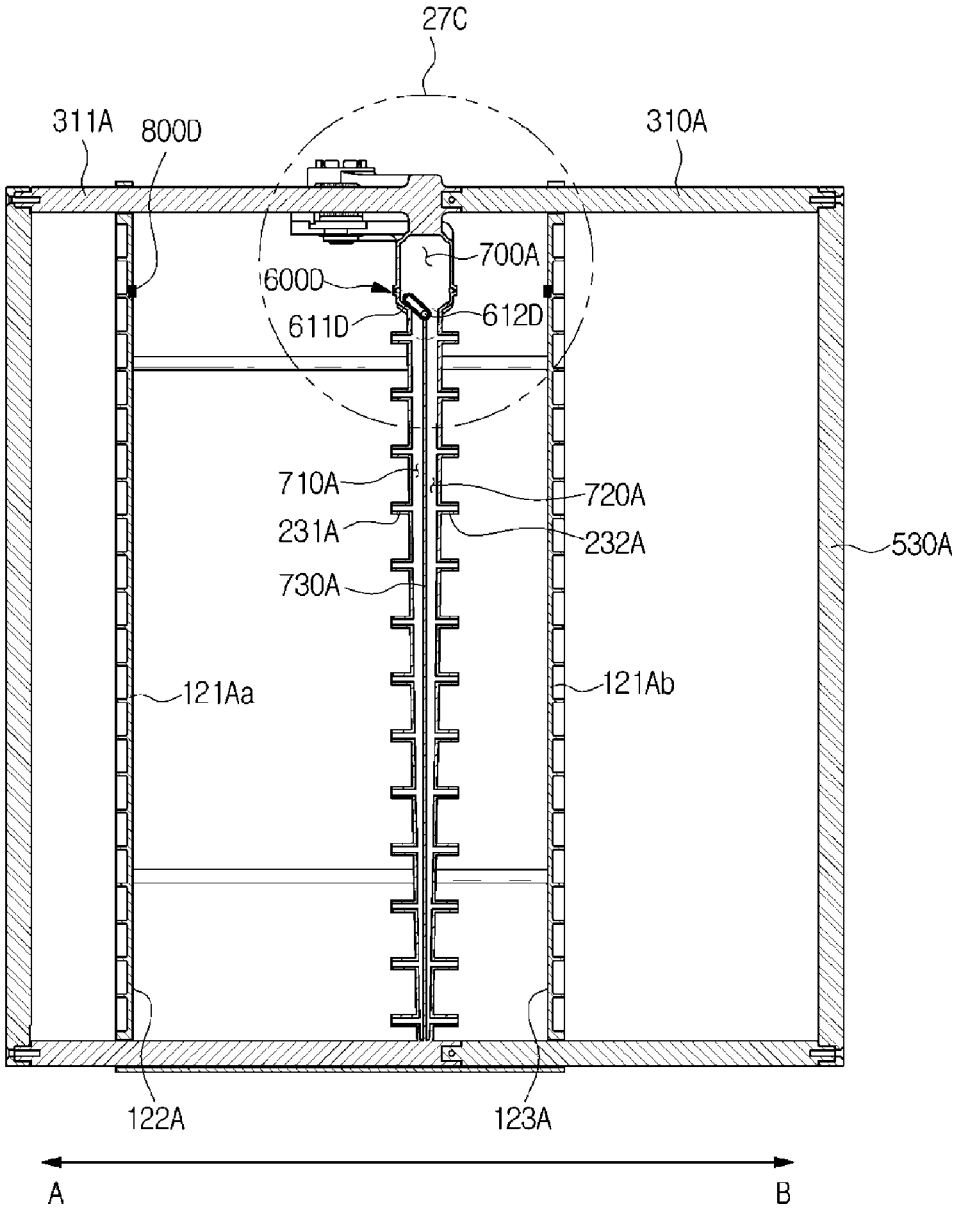
FIGS. 27 to 29 are views illustrating an operation of the flow channel switching unit according to the fourth embodiment of the disclosure.
Figure 28:
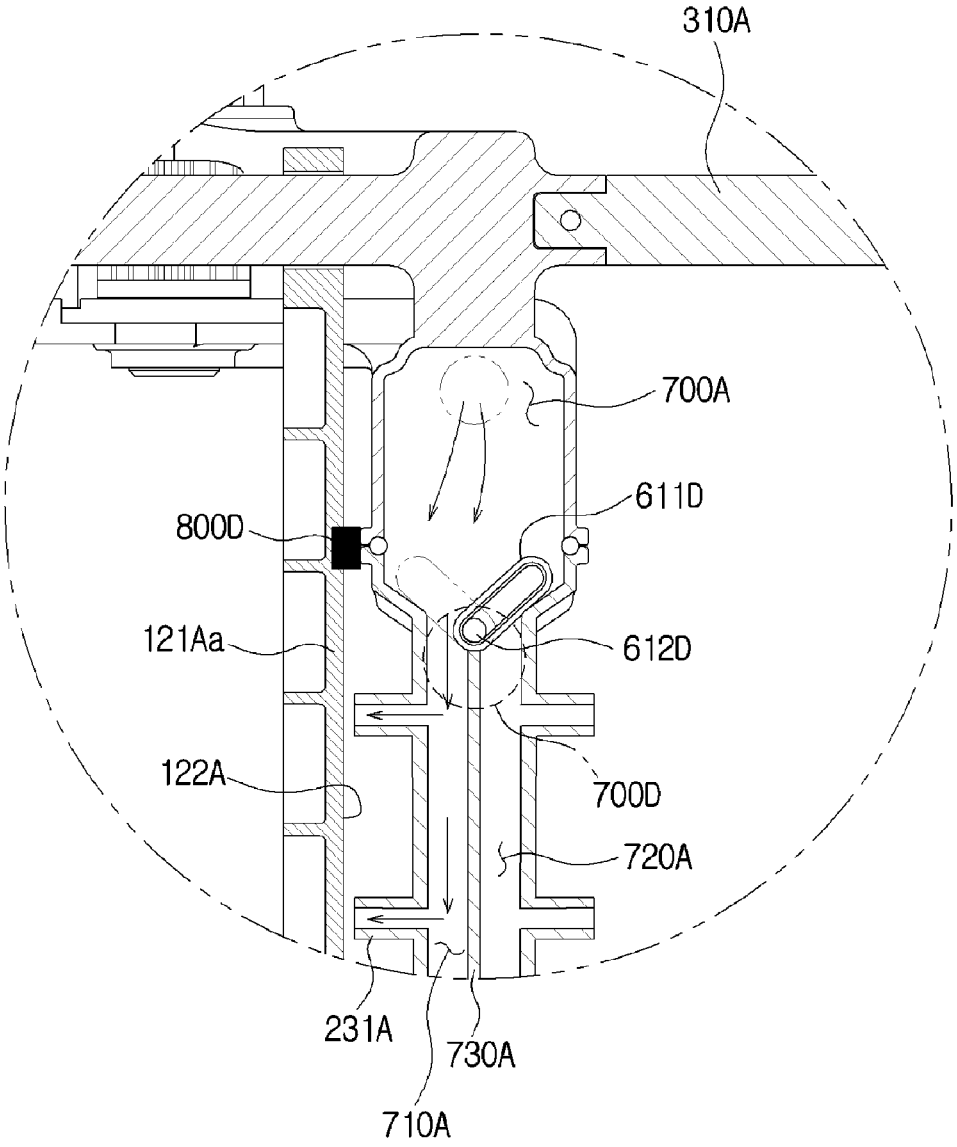
Figure 29:
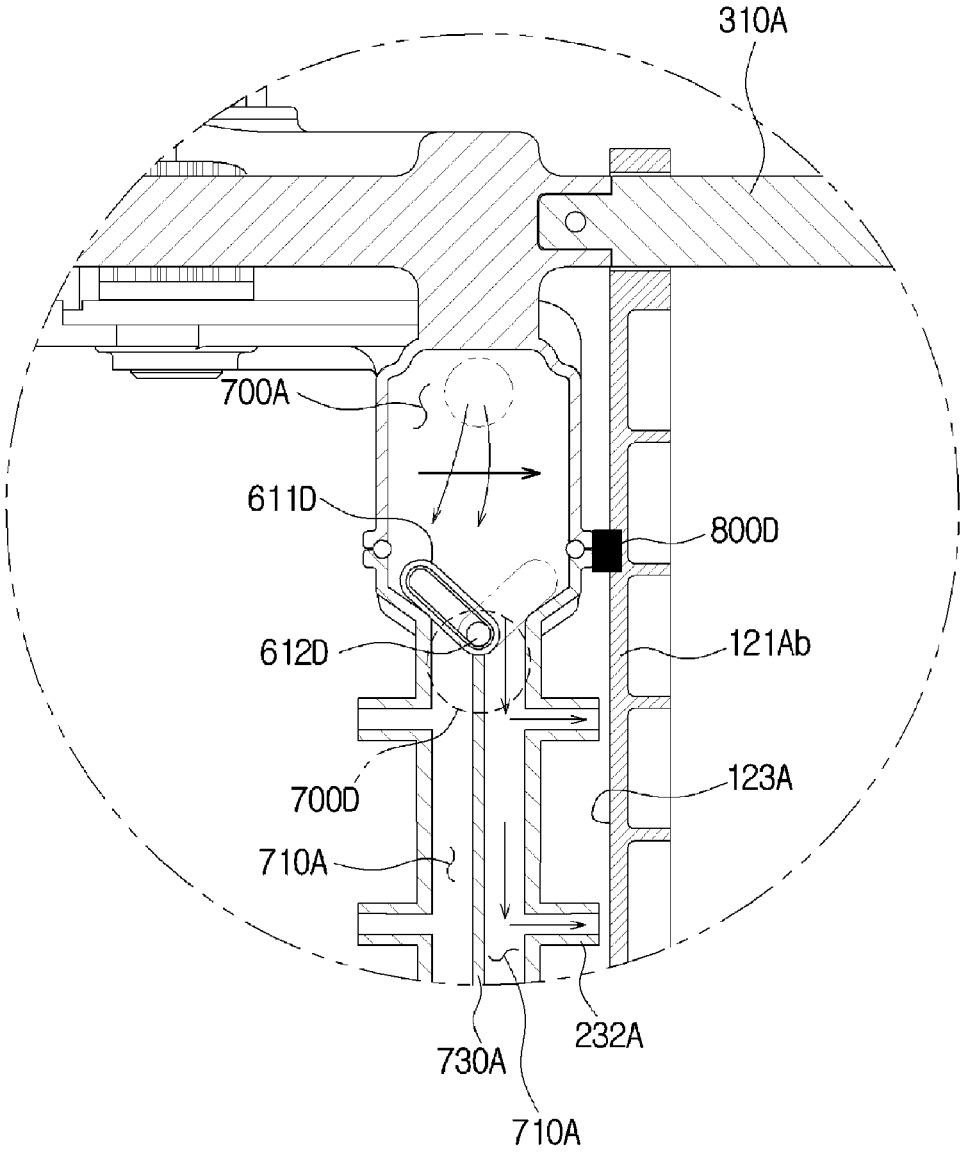

FIG. 25 is a view illustrating the injection unit 220A and a flow channel switching unit 600D according to the fourth embodiment of the disclosure. FIG. 26 is an exploded perspective view of the flow channel switching unit 600D according to the fourth embodiment of the disclosure. FIGS. 27 to 29 are views illustrating an operation of the flow channel switching unit 600D according to the fourth embodiment of the disclosure. A portion 27C of FIG. 27 within the broken line is illustrated in FIGS. 28 and 29. Hereinafter, reference numerals not illustrated in the drawings can be found with reference to FIGS. 1 to 24. Also, descriptions that are the same as those with reference to FIGS. 1 to 24 may be omitted.

As illustrated in FIGS. 25 to 29, the flow channel switching unit 600D according to the fourth embodiment of the disclosure may include a flow channel switching motor 700D.

The flow channel switching unit 600D may be disposed between the injection case connection portion 241A of the injection body 240A and the injection body connection portion 223A of the injection case 222A.

The flow channel switching unit 600D may include a flow channel switching member 610D, a sealing member 630D, and the flow channel switching motor 700D provided to drive the flow channel switching member 610D.

The flow channel switching member 610D may be rotatably installed to open and close the injection flow channel 700A. The flow channel switching member 610D may include a flow channel switching panel 611D having a panel shape.

The outside of the flow channel switching panel 611D may be formed of a sealing material, for example, including rubber to fully seal the injection flow channel 700A.

A flow channel switching rotation shaft 612D serving as a center of rotation of the flow channel switching panel 611D may be provided at one end of the flow channel switching panel 611D.

The flow channel switching rotation shaft 612D may be rotatably supported by a rotation shaft fixing groove 243D of the injection body 240A. The rotation shaft fixing groove 243D may be formed on the end of the partition 730A for dividing the injection flow channel 700A into the first injection flow channel 710A and the second injection flow channel 720A.

The sealing member 630D of the flow channel switching unit 600D may be provided between the injection body 240A and the injection case 222A, thereby fully sealing the injection flow 700A.

The flow channel switching panel 611D may be provided to be rotatable on the flow channel switching rotation shaft 612D. The flow channel switching motor 700D provided to rotate the flow channel switching panel 611D may be installed at a flow channel switching motor installation portion 425D of the gear bracket cover 421A.

The flow channel switching motor 700D installed in the flow channel switching motor installation portion 425D is provided to enable a motor shaft 711D to be rotatably installed in the rotation shaft fixing hole 243D of the injection body 240A.

The motor shaft 711D of the flow channel switching motor 700D may be connected to the flow channel switching shaft 612D of the flow channel switching panel 611D and may transfer the torque of the flow channel switching motor 700D to the flow channel switching panel 611D.

FIGS. 27 to 29 illustrate a flow channel switching operation performed by the flow channel switching unit 600D according to the fourth embodiment of the disclosure as follows.

When the washing water is supplied through the second fixed nozzle 221A, the washing water may be supplied into the injection case 222A and the injection body 240A.

The washing water supplied into the injection body 240A flows into the first injection flow channel 710A of the injection flow channel 700A in an open state due to the flow channel switching member 610D of the flow channel switching unit 600D and is injected through the first nozzle 231A.

The flow channel switching panel 611D may block the second injection flow channel 720A The washing water injected through the first nozzle 231A deflects due to the first deflection surface 122A of the first vane 121Aa and may be injected toward the dishes in the second dish basket 22A thereabove.

The first vane 121Aa deflects the washing water injected through the second nozzle 232A toward the dishes while moving along the rail 310A in the second direction B due to the motor assembly 400A.

The first vane 121Aa may move close to the first nozzle 231A and in contact with a sensor unit 800D.

The sensor unit 800D may switch moving directions of the first vane 121Aa and the second vane 121Ab by controlling the motor assembly 400A.

The sensor unit 800D rotates the flow channel switching panel 611D by driving the flow channel switching motor 700D of the flow channel switching unit 600D.

Due to the rotation of the flow channel switching panel 611D, the second injection flow channel 720A may open and the first injection flow channel 710A may close.

The washing water flows into the open second injection flow channel 720A and may be injected through the second nozzle 232A.

The washing water injected through the second nozzle 232A deflects due to the second deflection surface 123A of the second vane 121Ab and may be injected toward the dishes in the second dish basket 22A.

Accordingly, the sensor unit 800D may control the moving directions of the first vane 121Aa and the second vane 121Ab and the direction switching of the injection flow channel 700A. In the first vane 121Aa and the second vane 121Ab, the process may be continuously performed through reciprocating in the first direction A and the second direction B.

Figure 30:
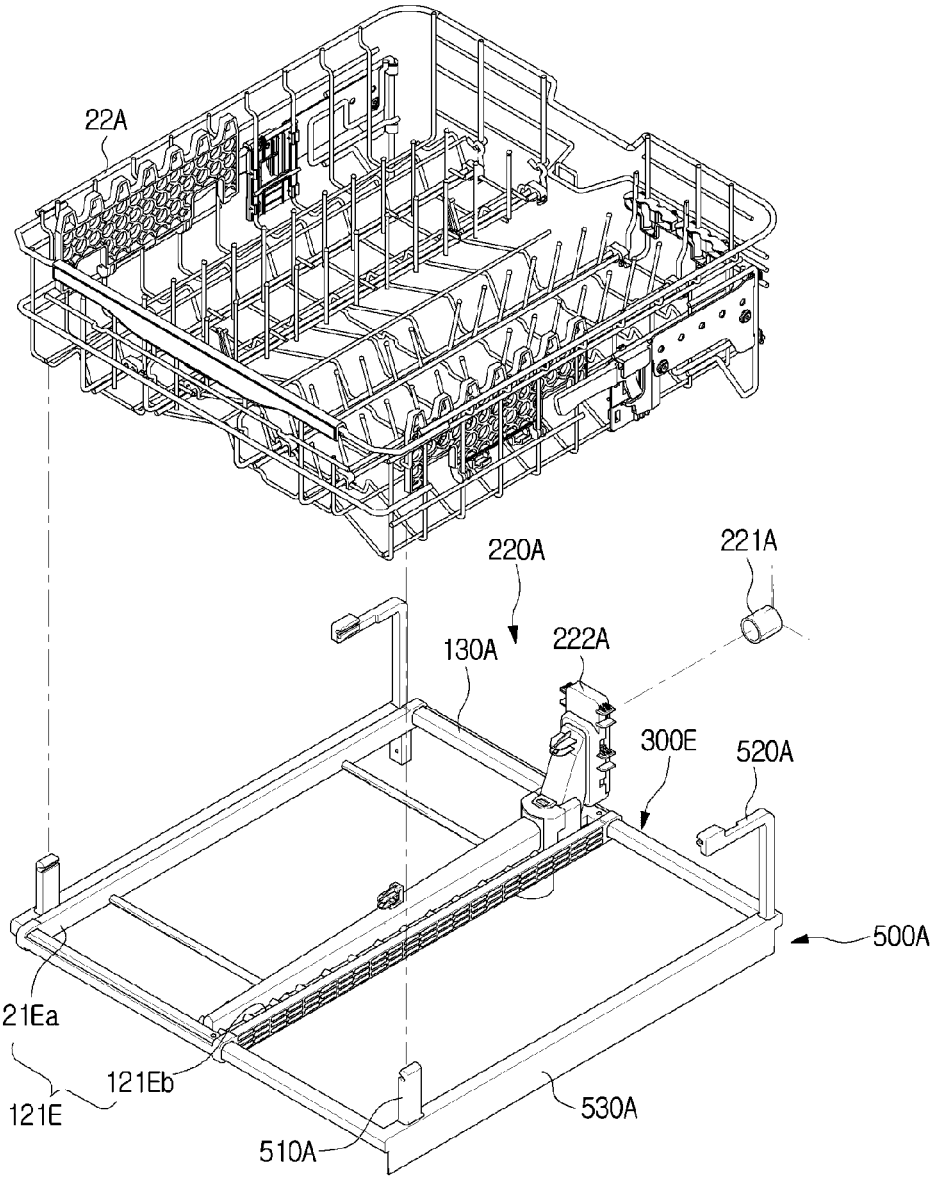
FIG. 30 is a view illustrating an injection unit and a deflection unit according to a fifth embodiment of the disclosure.
Figure 31:
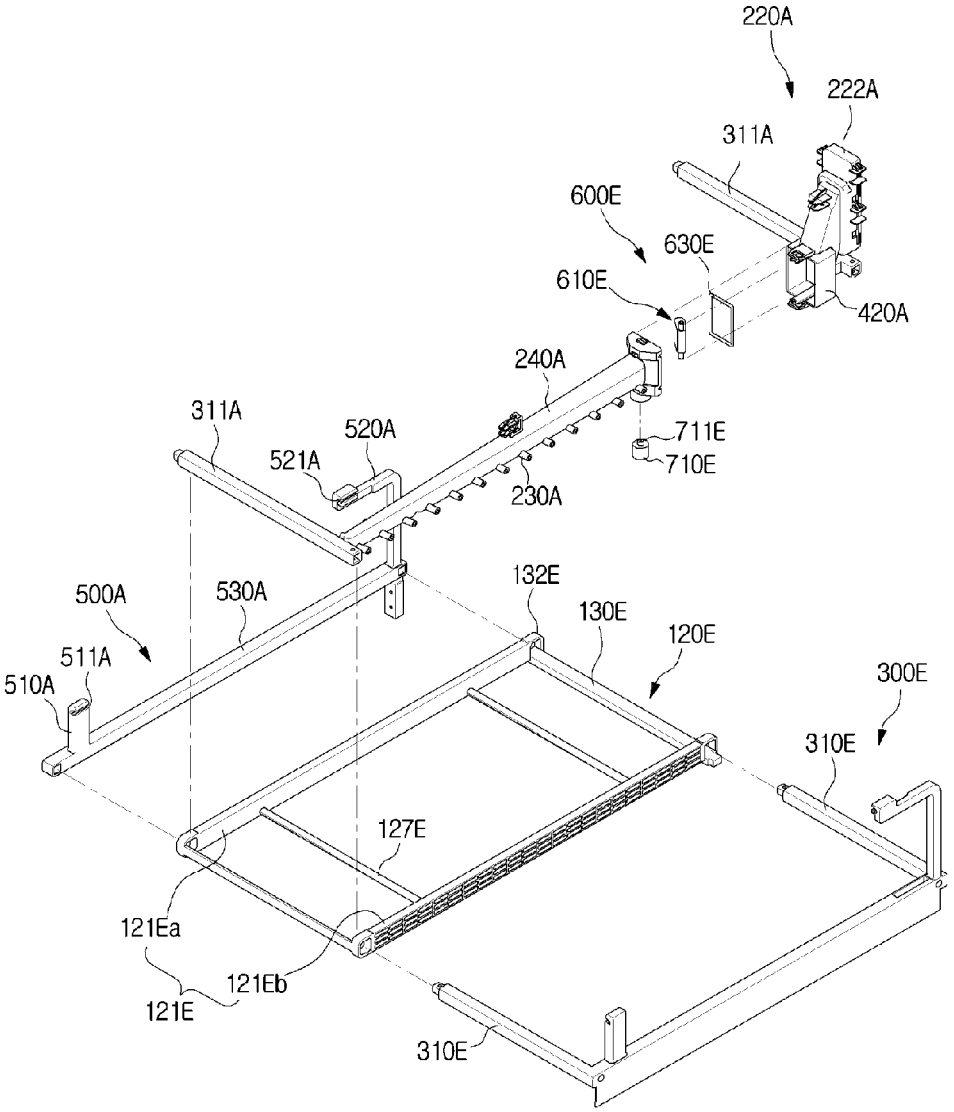
FIG. 31 is a view illustrating the injection unit and a flow channel switching unit according to the fifth embodiment of the disclosure.
Figure 32:
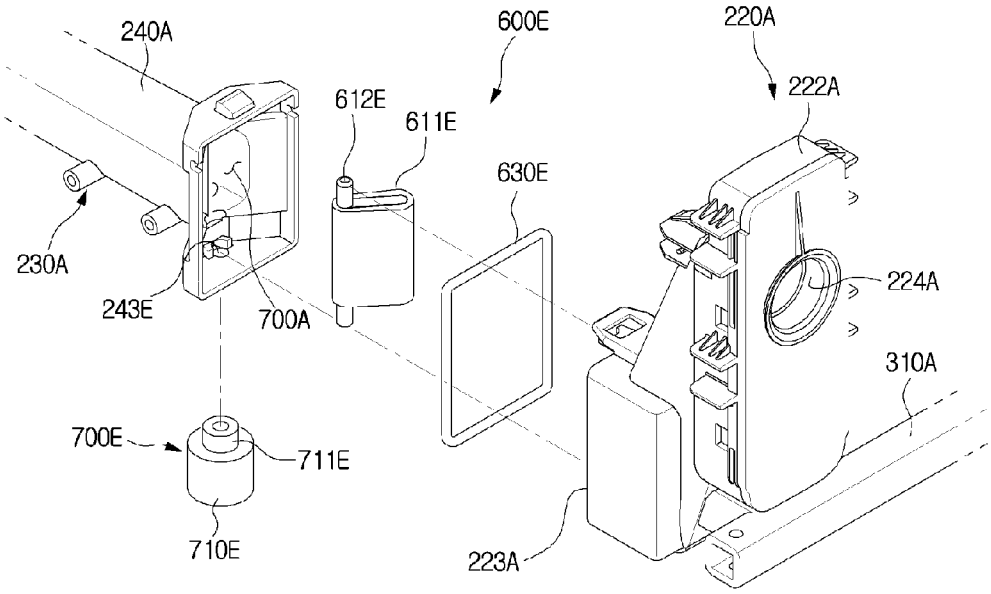
FIG. 32 is an exploded perspective view of the flow channel switching unit according to the fifth embodiment of the disclosure.
Figure 33:
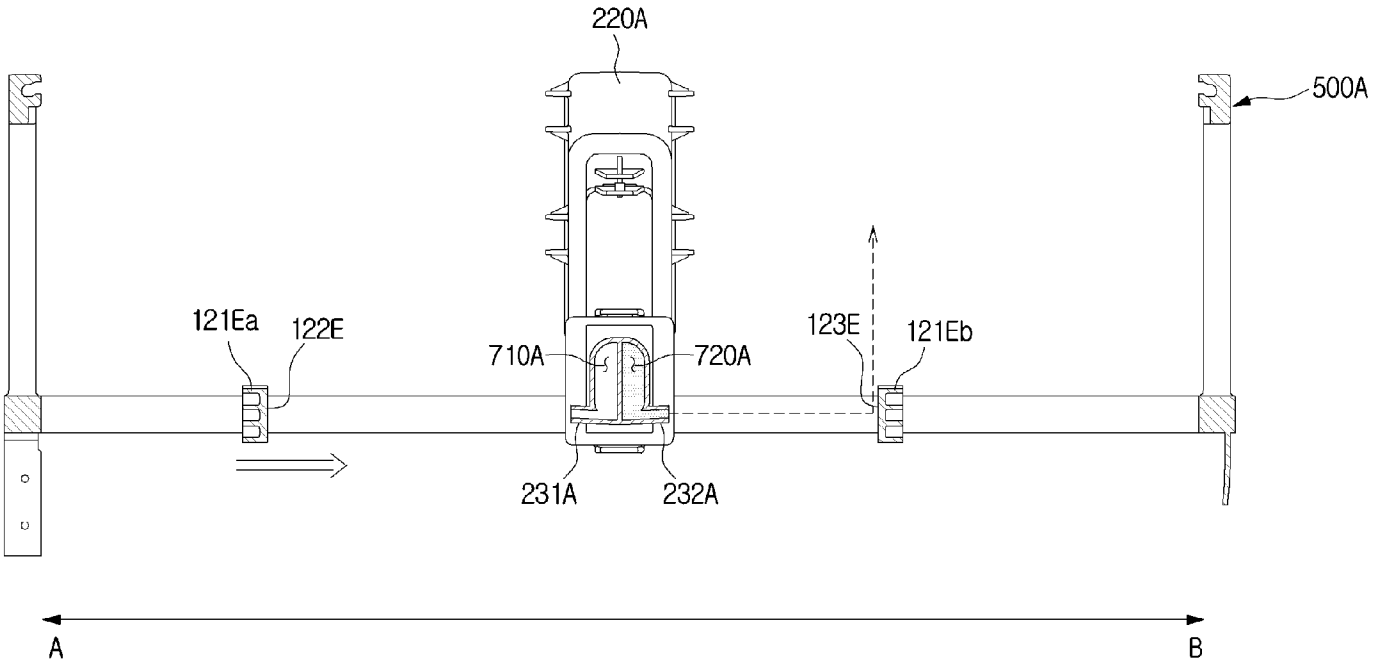
FIG. 33 is a schematic diagram illustrating the movement of a vane unit according to an injection flow channel according to the fifth embodiment of the disclosure.
Figure 34:
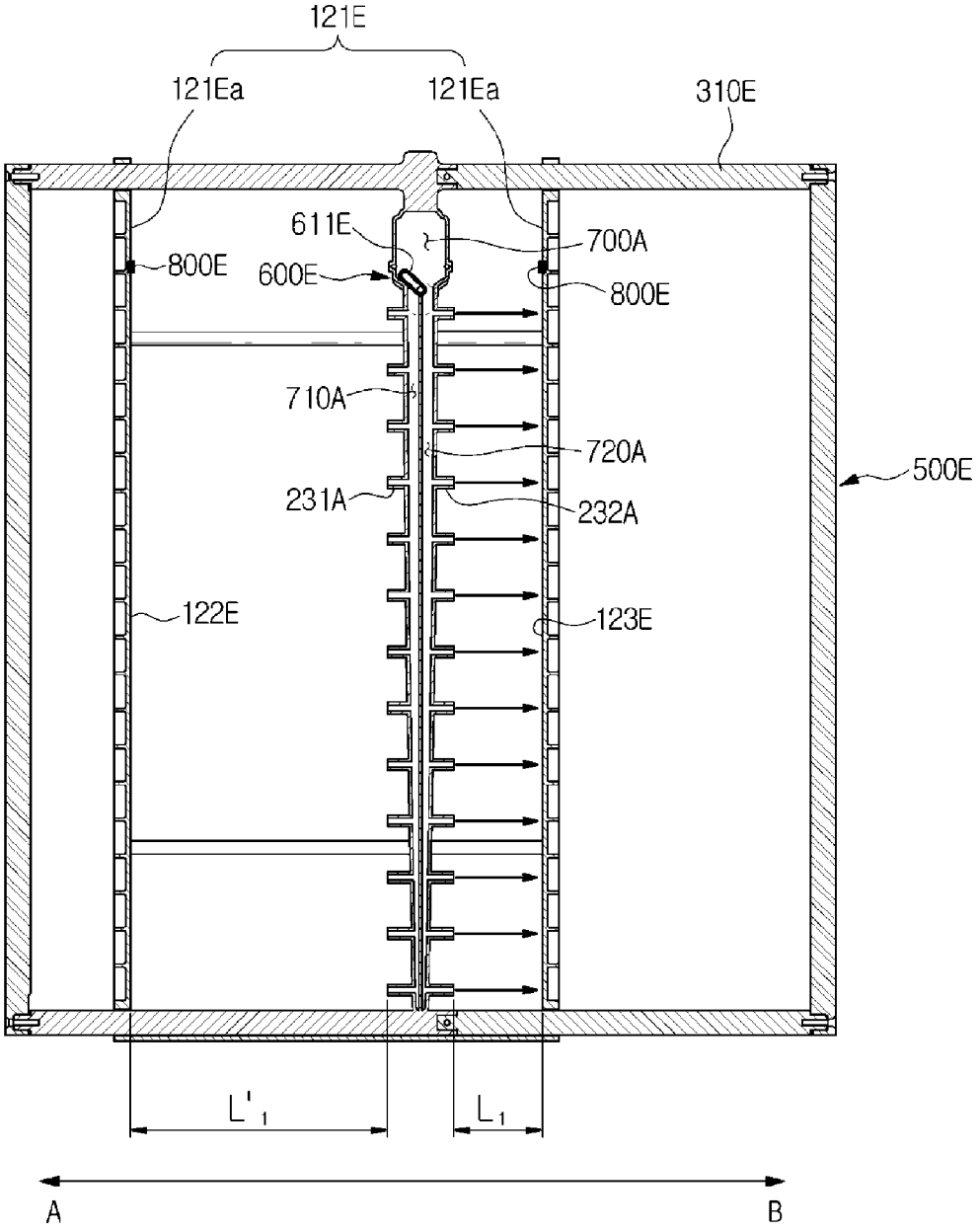
FIGS. 34 to 37 are views illustrating the movement of the vane unit caused by injection of washing water performed by the flow channel switching unit according to the fifth embodiment of the disclosure.
Figure 35:
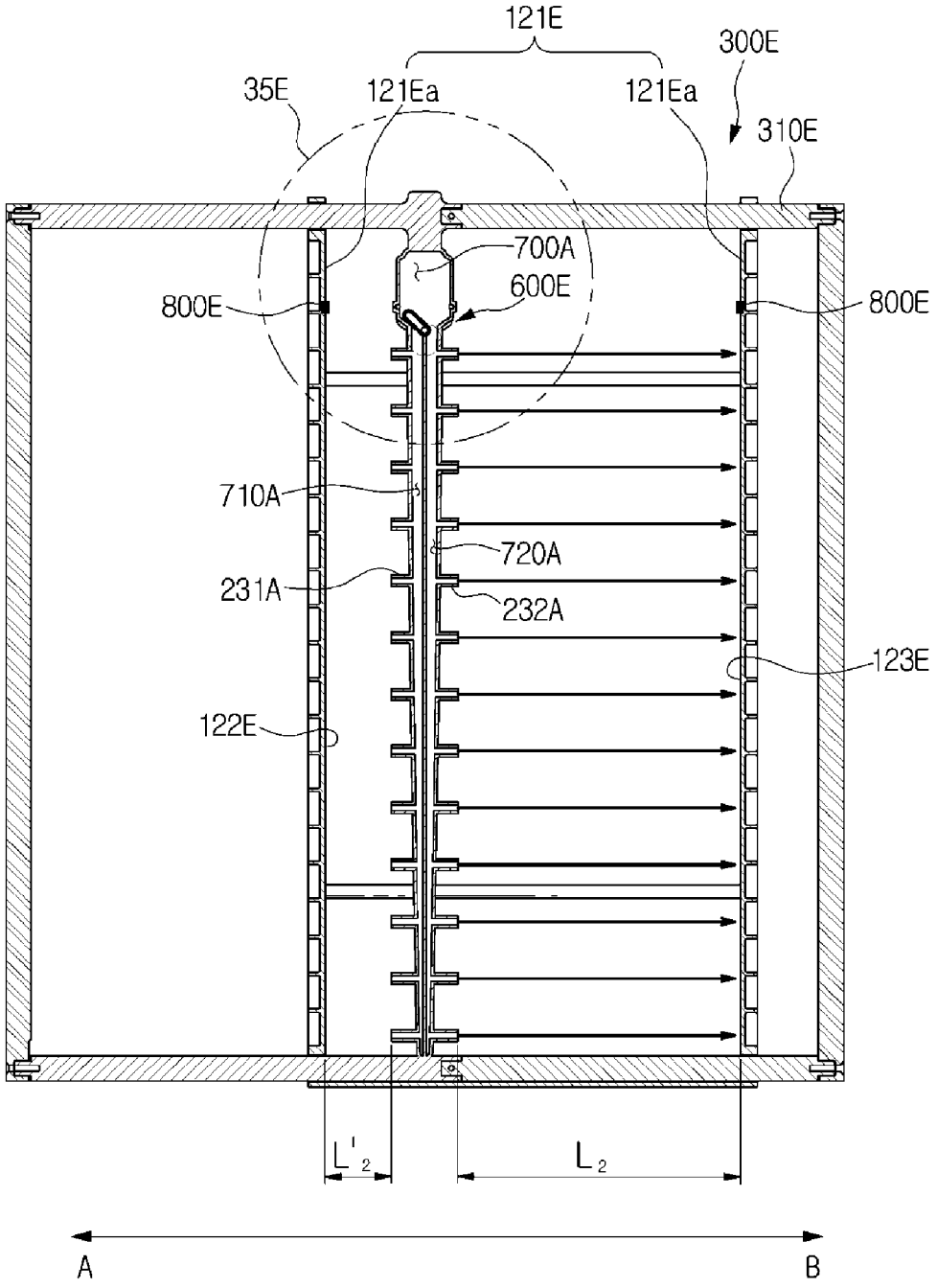
Figure 36:
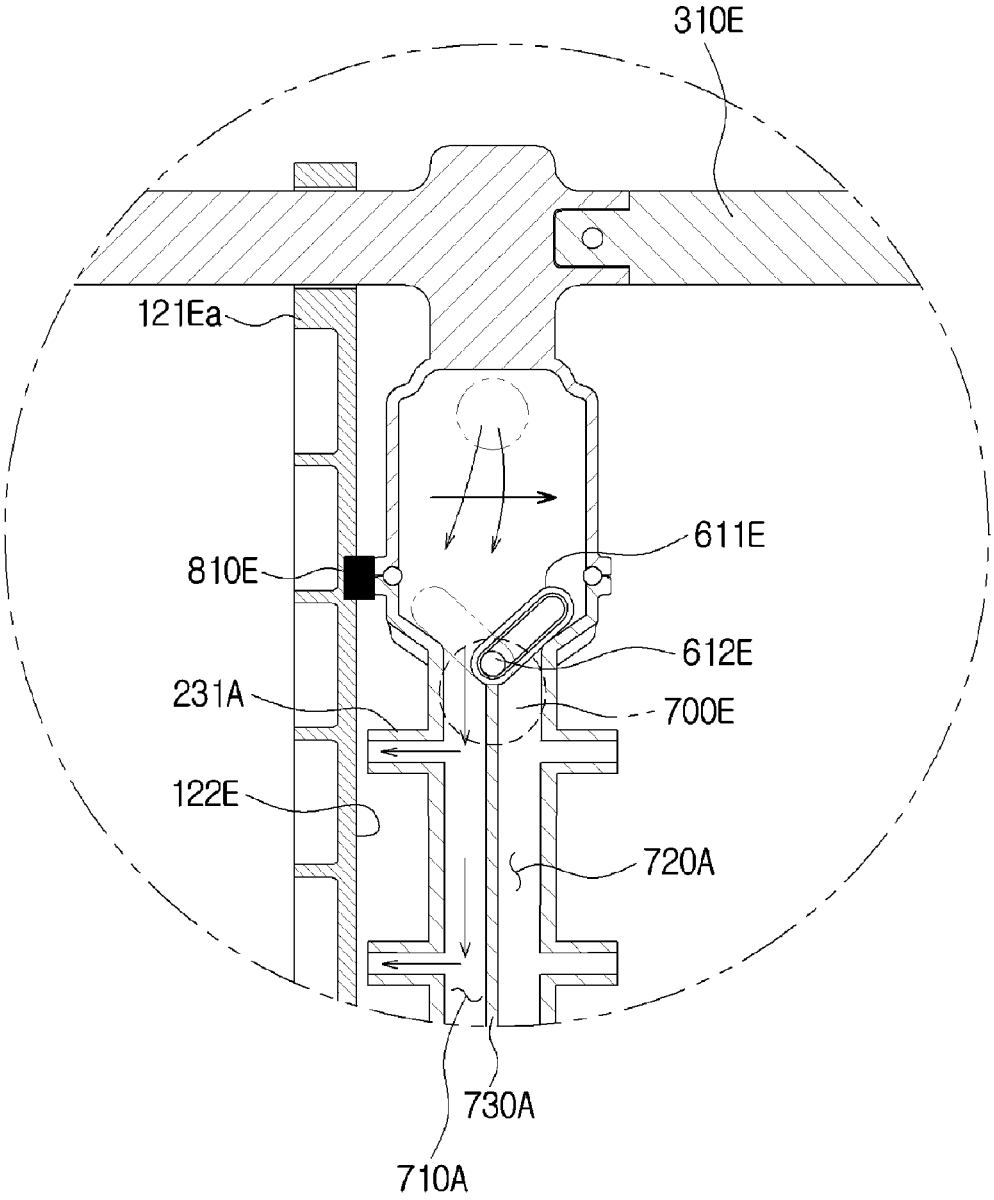
Figure 37:
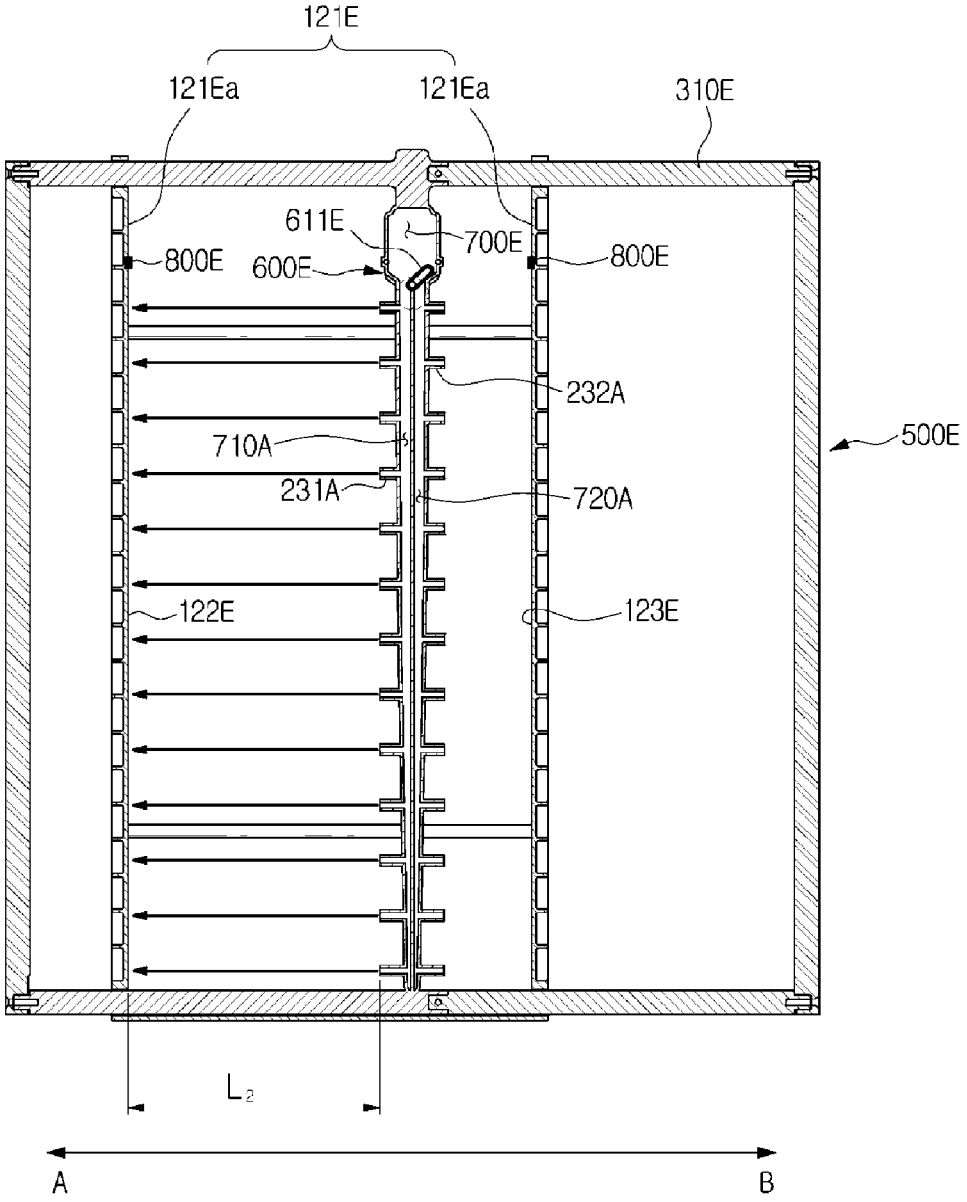

FIG. 30 is a view illustrating the injection unit 220A and a deflection unit 120E according to a fifth embodiment of the disclosure. FIG. 31 is a view illustrating the injection unit 220A and a flow channel switching unit 600E according to the fifth embodiment of the disclosure. FIG. 32 is an exploded perspective view of the flow channel switching unit 600E according to the fifth embodiment of the disclosure. FIG. 33 is a schematic diagram illustrating the movement of a vane unit 121E according to the injection flow channel 700A according to the fifth embodiment of the disclosure. FIGS. 34 to 37 are views illustrating the movement of the vane unit 121E caused by injection of the washing water performed by the flow channel switching unit 600E according to the fifth embodiment of the disclosure. FIG. 36 illustrates portion 35E within the broken line of FIG. 35. Hereinafter, reference numerals not illustrated in the drawings can be found with reference to FIGS. 1 to 29. Also, descriptions that are the same as those with reference to FIGS. 1 to 29 may be omitted.

As illustrated in FIGS. 30 to 37, the deflection unit 120E according to the fifth embodiment of the disclosure may be provided to be moved by an injection force of the washing water injected by the injection unit 200A.

The deflection unit 120E may deflect the washing water injected through the second injection unit 220A in the first direction A and the second direction B of the washing tub 11A toward the dishes thereabove.

The deflection unit 120E includes the vane unit 121E to reciprocate in a direction in which the washing water is injected. The vane unit 121E may include a first vane 121Ea to deflect the washing water injected through the first nozzle 231A of the injection nozzle 230A and a second vane 121Eb to deflect the washing water injected through the second nozzle 232A.

The first vane 121Ea and the second vane 121Eb may be interconnected to interwork with each other. The first vane 121Ea and the second vane 121Eb may include deflection surfaces 122E and 123E to deflect the washing water injected through the first nozzle 231A and the second nozzle 232A, respectively. The first vane 121Ea may include a first deflection surface 122E, and the second vane 121Ab may include a second deflection surface 123E.

The second deflection unit 120A may include a rail assembly 300E for guiding the movement of the first vane 121Ea and the second vane 121Eb. The rail assembly 300E may be coupled with the bottom of the injection case 222A of the second injection unit 220A.

The rail assembly 300E may include a rail 310E and the holder unit 500A provided such that the rail 310E is installed. The rail 310E may include an extension rail 311E connected to the holder unit 500A and provided to extend a length thereof.

The rail 310E extends in the first direction A and the second direction B of the washing tub 11A. The rail 310E movably connects the first vane 121Ea with the second vane 121Eb of the second deflection unit 120A.

The first vane 121Ea and the second vane 121Eb movably coupled with the rail assembly 300E may be moved by the water pressure of the washing water injected through one of the first injection flow channel 710A and the second injection flow channel 720A switched by the flow channel switching unit 600E.

The flow channel switching unit 600E may include a flow channel switching member 610E, a sealing member 630E, and a flow channel switching motor 700E provided to drive the flow channel switching member 610E.

The flow channel switching member 610E may be rotatably installed to open and close the injection flow channel 700A. The flow channel switching member 610E may include a flow channel switching panel 611E having a panel shape.

A flow channel switching rotation shaft 612E serving as a center of rotation of the flow channel switching panel 611E may be provided at one end of the flow channel switching panel 611E. The flow channel switching rotation shaft 612E may be rotatably supported by a rotation shaft fixing groove 243E of the injection body 240A. The rotation shaft fixing groove 243E may be formed on the end of the partition 730A for dividing the injection flow channel 700A into the first injection flow channel 710A and the second injection flow channel 720A.

The sealing member 630E of the flow channel switching unit 600E may be provided between the injection body 240A and the injection case 222A, thereby fully sealing the injection flow 700A.

The flow channel switching panel 611E may be provided to be rotatable on the flow channel switching rotation shaft 612E. The motor shaft 711E of the flow channel switching motor 700E may be connected to the flow channel switching shaft 612E of the flow channel switching panel 611E and may transfer the torque of the flow channel switching motor 700E to the flow channel switching panel 611E.

As illustrated in FIGS. 33 to 37, a flow channel switching operation performed by the flow channel switching unit 600E according to the fifth embodiment of the disclosure is as follows.

When the washing water is supplied through the second fixed nozzle 221A, the washing water is supplied into the injection case 222A and the injection body 240A. The washing water supplied into the injection body 240A flows into the second injection flow channel 720A of the injection flow channel 700A in an open state due to the flow channel switching unit 600E and is injected through the second nozzle 232A.

The flow channel switching panel 611E may block the first injection flow channel 710A.

The washing water injected through the second nozzle 232A deflects due to the second deflection surface 123E of the second vane 121Eb to be injected toward the dishes thereabove.

The second vane 121Ea moves along the rail 310E in the second direction B due to the water pressure of the washing water injected through the second nozzle 232A. The second vane 121Eb becomes farther from the second nozzle 232A from a distance $L_1$ to a distance $L_2$. The first vane 121Ea becomes closer to the first nozzle 231A from a distance $L'_1$ to a distance $L'_2$ (see, for example, FIGS. 34 and 35).

When the first vane 121Ea becomes closer to the first nozzle 231A and is in contact with the sensor unit 800E, the sensor unit 800E may rotate the flow channel switching panel 611E by driving the flow channel switching motor 700E of the flow channel switching unit 600E.

Due to the rotation of the flow channel switching panel 611E, the second injection flow channel 720A may be closed and the first injection flow channel 710A may be opened.

The washing water flows into the open first injection flow channel 710A and may be injected through the first nozzle 231A. The washing water injected through the first nozzle 231A pressurizes the first deflection surface 122E of the first vane 121Ea, and the first vane 121Ea moves in the first direction A due to the water pressure of the washing water.

Figure 38:
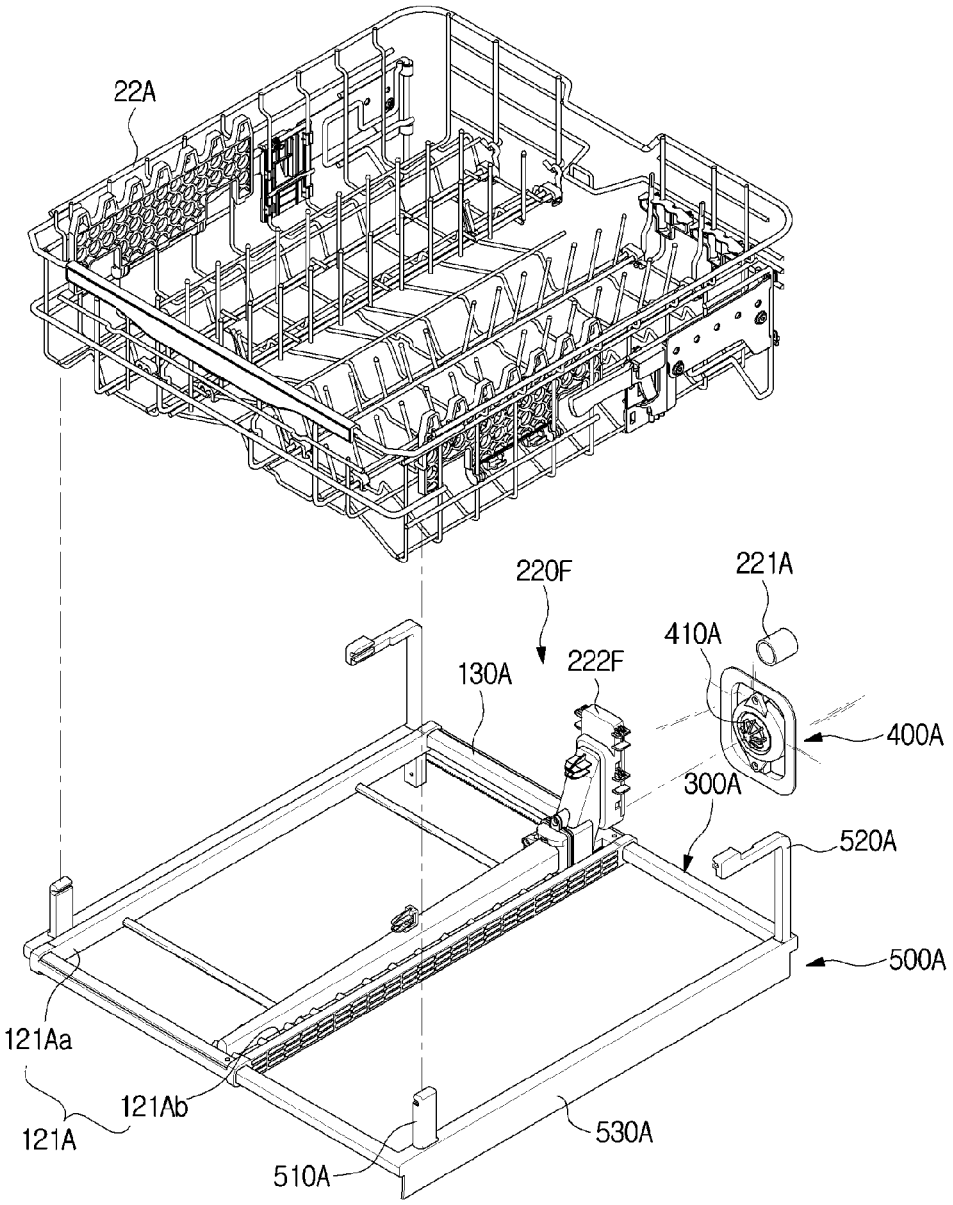
FIG. 38 is a view illustrating an injection unit and a deflection unit according to a sixth embodiment of the disclosure.
Figure 39:
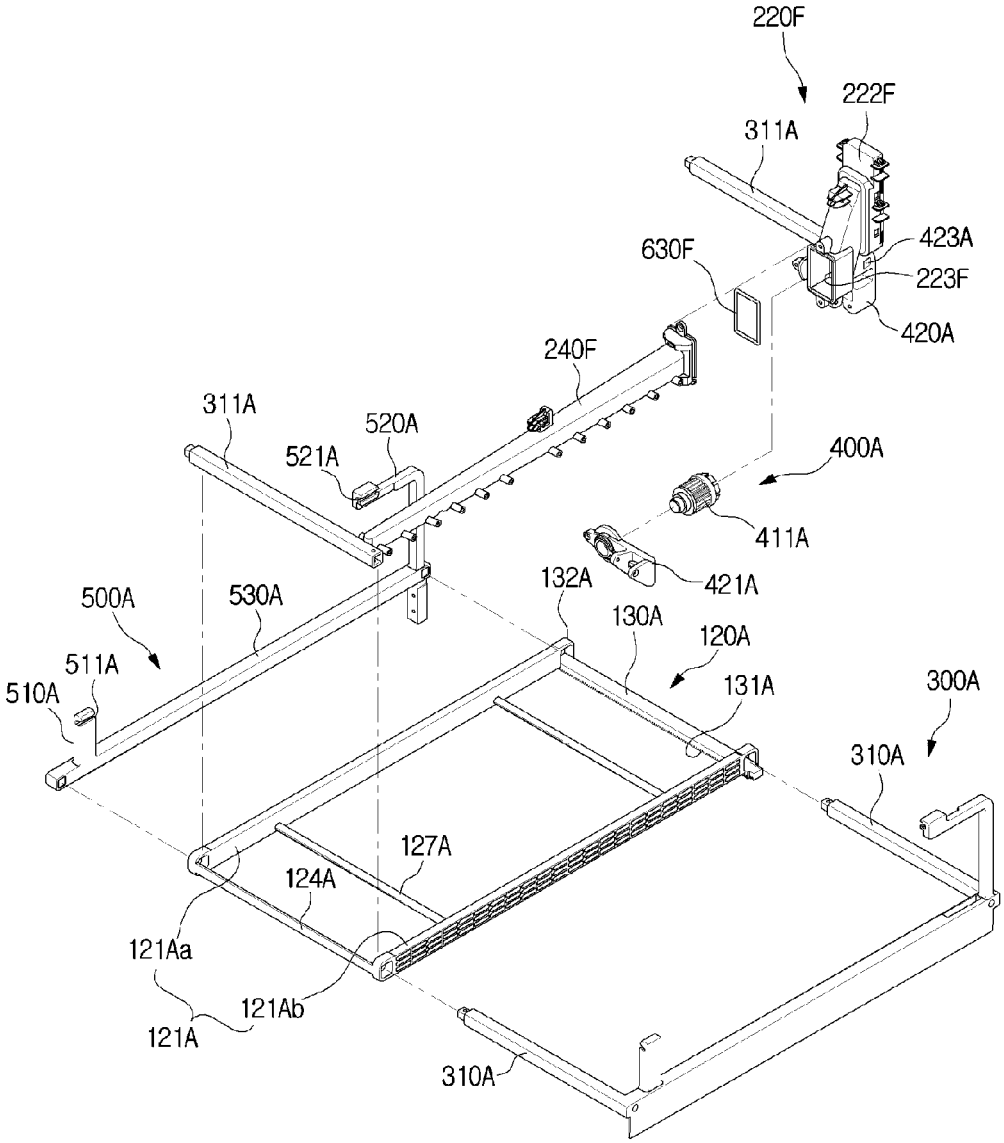
FIG. 39 is an exploded perspective view illustrating the injection unit and the deflection unit according to the sixth embodiment of the disclosure.
Figure 40:
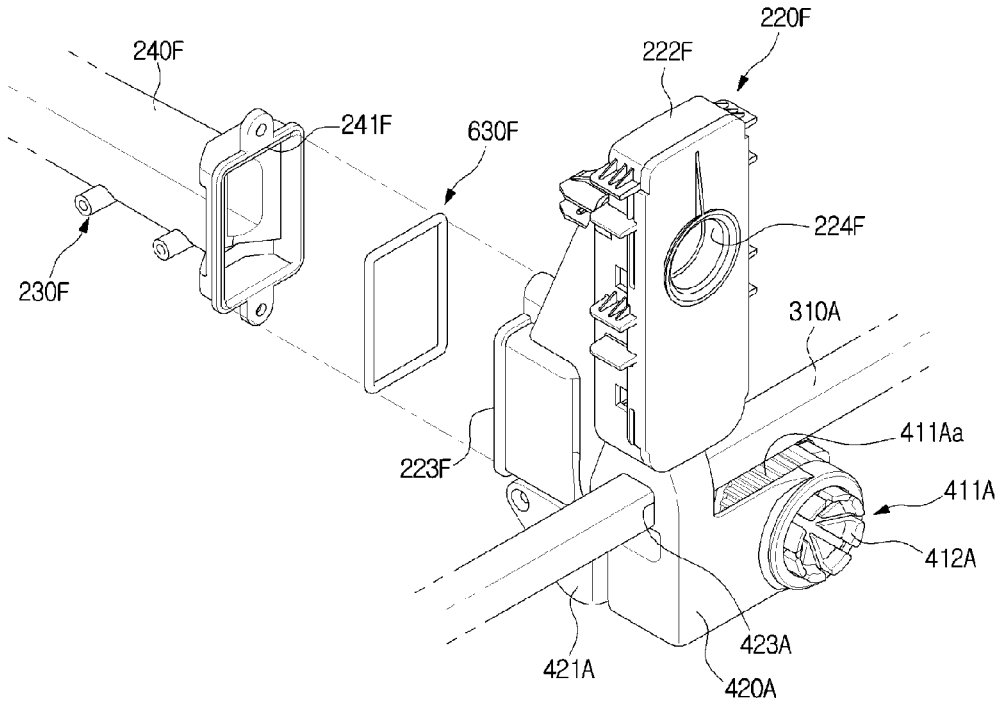
FIG. 40 is a schematic diagram of a connection portion of an injection body and an injection case according to the sixth embodiment of the disclosure.
Figure 41:
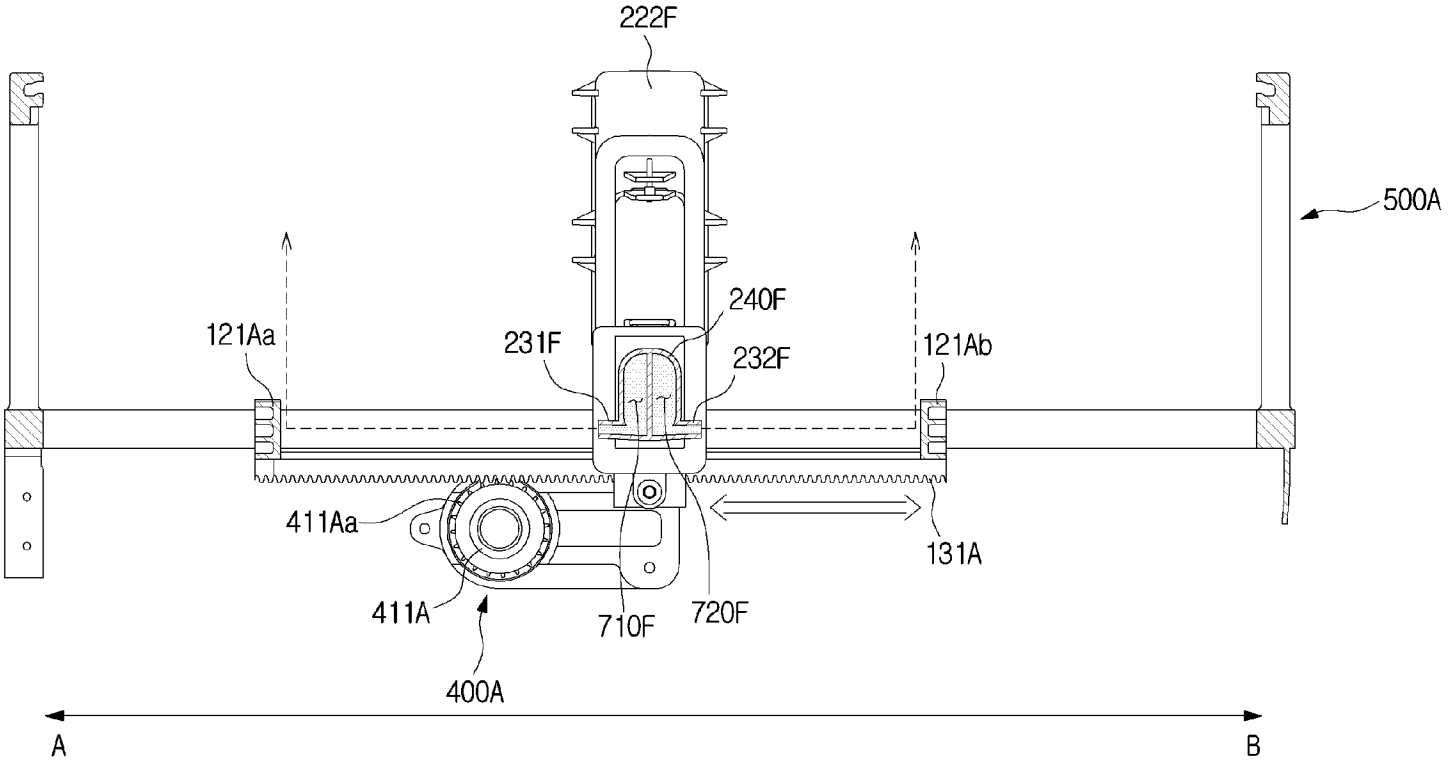
FIG. 41 is a schematic diagram of a vane unit moved by a motor assembly according to the sixth embodiment of the disclosure.
Figure 42:
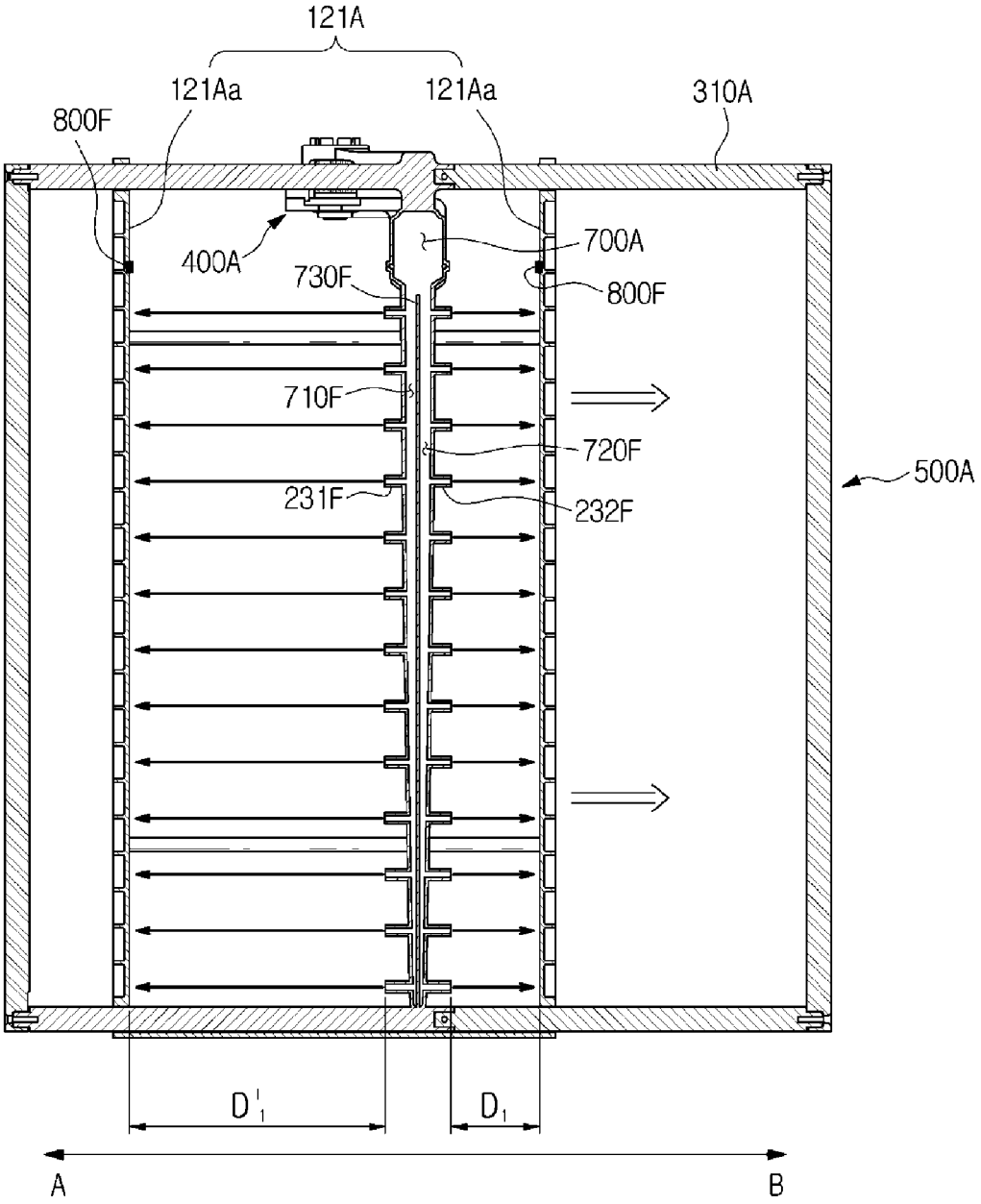
FIGS. 42 to 45 are views illustrating the deflection of washing water according to the movement of the vane unit according to the sixth embodiment of the disclosure.
Figure 43:
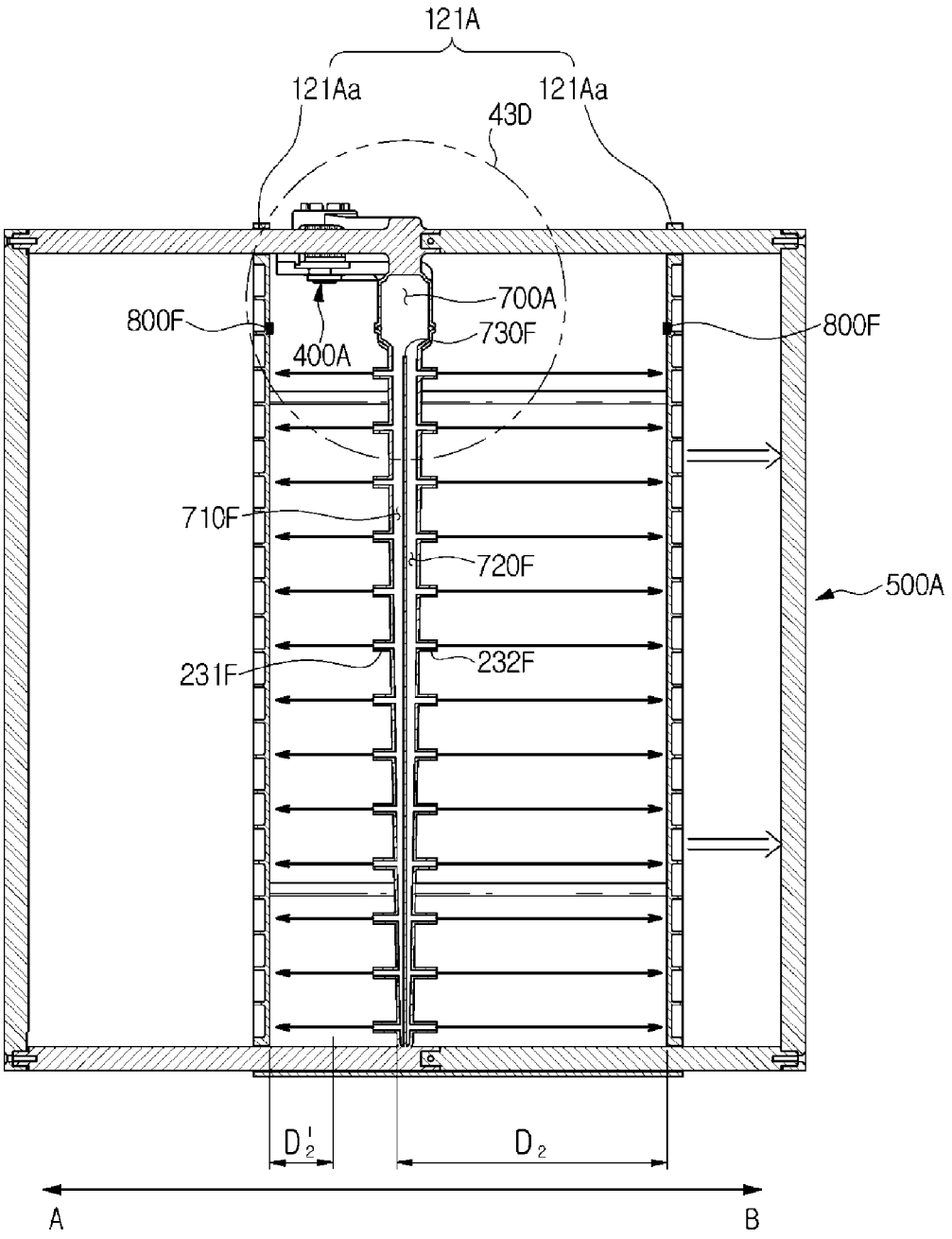
Figure 44:
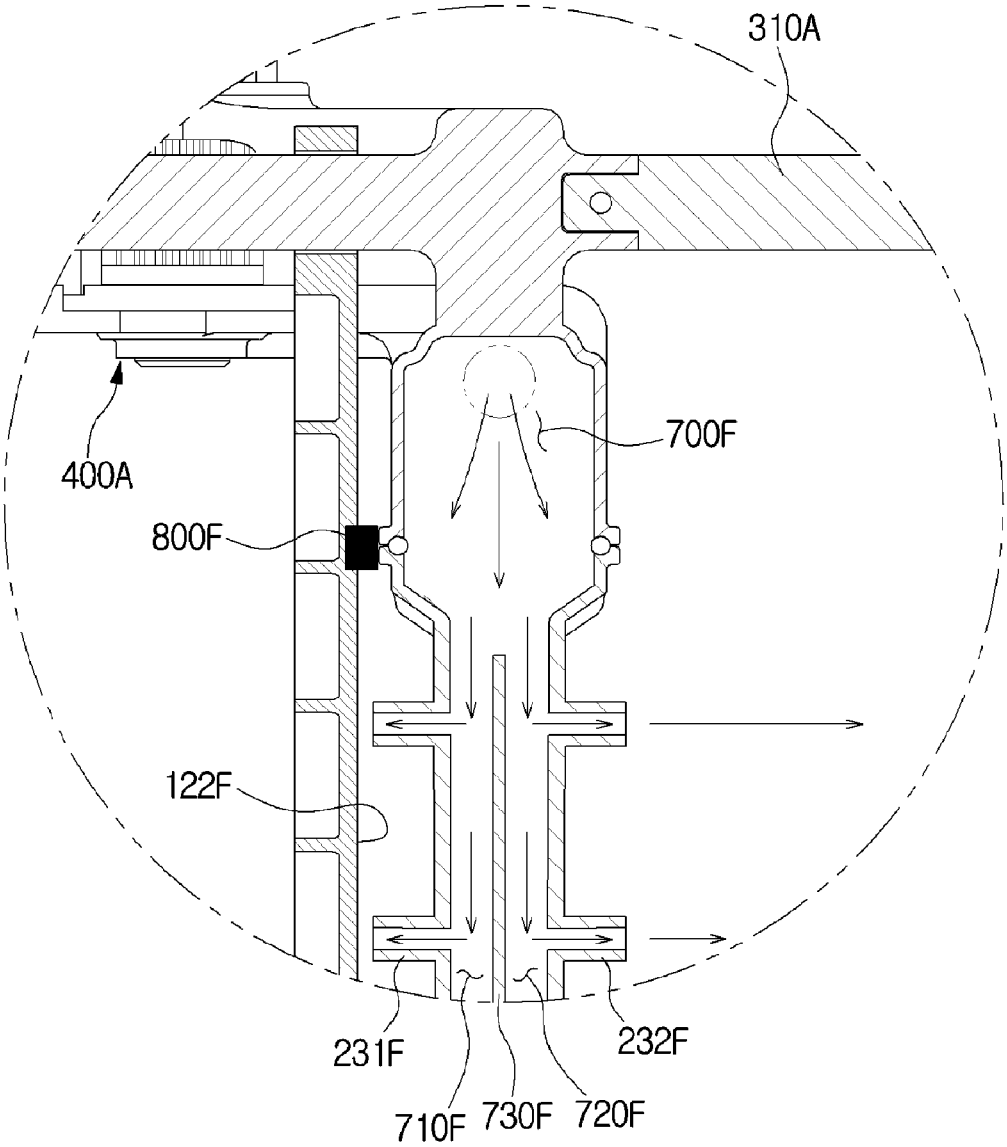
Figure 45:
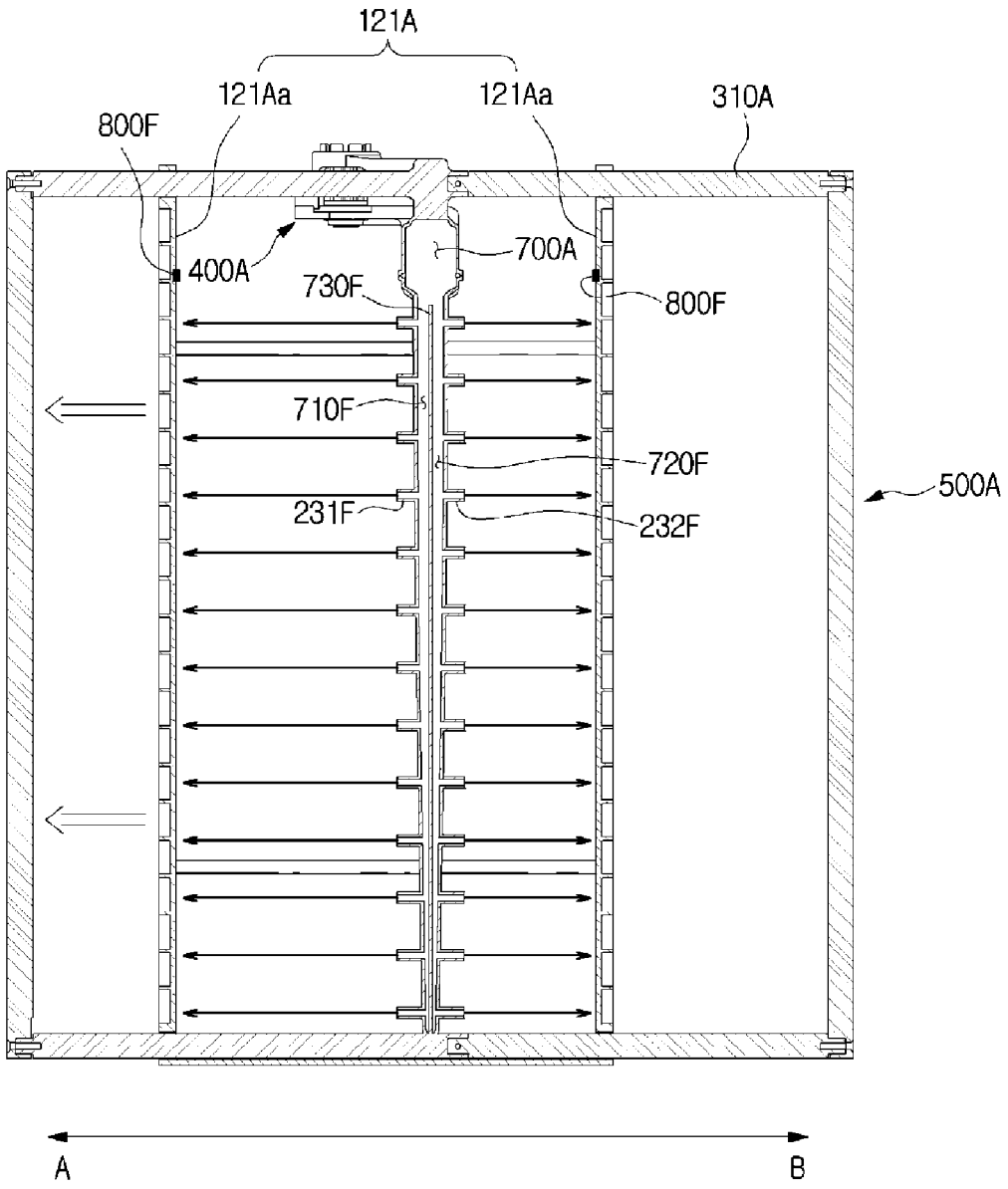

FIG. 38 is a view illustrating an injection unit 220F and the deflection unit 120A according to a sixth embodiment of the disclosure. FIG. 39 is an exploded perspective view illustrating the injection unit 220F and the deflection unit 120A according to the sixth embodiment of the disclosure. FIG. 40 is a schematic diagram of a connection portion of an injection body 240F and an injection case 222F according to the sixth embodiment of the disclosure. FIG. 41 is a schematic diagram of the vane unit 121A moved by the motor assembly 401 according to the sixth embodiment of the disclosure. FIGS. 42 to 45 are views illustrating the deflection of the washing water according to the movement of the vane unit 121A according to the sixth embodiment of the disclosure. FIG. 44 illustrates portion 43E within the broken line of FIG. 43. Hereinafter, reference numerals not illustrated in the drawings can be found with reference to FIGS. 1 to 37. Also, descriptions that are the same as those with reference to FIGS. 1 to 37 may be omitted.

As illustrated in FIGS. 38 to 45, the deflection unit 120A according to the sixth embodiment includes the vane unit 121A provided to be capable of being moved by the motor assembly 400A.

The washing water injected through the injection unit 220F may be controlled by the vane unit 121A that is moved left and right by the motor assembly 400A.

The injection unit 220F may include the injection case 222F, the injection body 240F, and injection nozzles 230F formed on the left and right of the injection body 240F.

A fixed nozzle connection portion 224F to connect the second fixed nozzle 221A may be formed in a rear side of the injection case 222F. The injection case 222F may include an injection body connection portion 223F having an open front on a bottom of the injection case 222 to connect with the injection body 240F.

The injection nozzles 230F each may include a first nozzle 231F protruding from the left of the injection body 240F and a second nozzle 232F protruding from the right of the injection body 240F. A direction from the left of the injection body 240F, that is, the center of the washing tub 11A toward the left wall 11Ad is designated as a first direction A and a direction from the right of the injection body 240F, that is, the center of the washing tub 11A toward the right wall 11Ae is designated as a second direction B.

An injection flow channel 700F through which the washing water is supplied may be formed inside the injection body 240F formed with the injection nozzles 230F.

The injection flow channel 700F includes a first injection flow channel 710F and a second injection flow channel 720F. The first injection flow channel 710F and the second injection flow channel 720F may be divided by a partition 730F.

The first injection flow channel 710F may inject the washing water through a first nozzle 231F, and the second injection flow channel 720F may inject the washing water through a second nozzle 232F.

A sealing member 630F for sealing may be provided between the injection body 240F and the injection case 222F.

The washing water flowing into the injection case 222F through the fixed nozzle 221A may be supplied to the first injection flow channel 710F and the second injection flow channel 720F through the injection body 240F connected to the injection case 222F and may be injected through the first nozzle 231F and the second nozzle 232F at the same time.

The washing water injected through the first nozzle 231F and the second nozzle 232F may be injected at all times.

The vane unit 121A of the second deflection unit 120A may be moved by the rail assembly 300A and the motor assembly 400A in the first direction A and the second direction B of the washing tub 11A.

Accordingly, the first vane 121Aa and the second vane 121Ab that reciprocate left and right along the rail 310A of the rail assembly 300A may inject the washing water injected from the first nozzle 231F and the second nozzle 232F toward the dishes thereabove at the same time.

As illustrated in FIGS. 41 to 45, the washing water supplied into the injection body 240F through the injection case 222F may flow into the first injection flow channel 710F and the second injection flow channel 720F.

The washing water of the first injection flow channel 710F may be injected in the first direction A through the first nozzle 231F. The washing water of the second injection flow channel 720F may be injected in the second direction B through the second nozzle 232F. The washing water may be injected through the first nozzle 231F and the second nozzle 232F at the same time.

A movement of the vane unit 121A may be controlled by the motor assembly 400A.

The motor assembly 400A may move the first vane 121Aa and the second vane 121Ab in the second direction B.

When the first vane 121Aa and the second vane 121Ab are moved in the second direction B, the first vane 121Aa becomes closer to the first nozzle 231F from $D'_1$ to $D'_2$ and the second vane 121Ab becomes farther from the second nozzle 232F from $D_1$ to $D_2$.

The movement of the first vane 121Aa and the second vane 121Ab deflect the washing water injected from the first nozzle 231F and the second nozzle 232F to be supplied toward the dishes thereabove.

Moving directions of the first vane 121Aa and the second vane 121Ab may be switched by a sensor unit 800F.

The movement of the first vane 121Aa and the second vane 121Ab may be sensed by the sensor unit 800F to be driven by the motor assembly 400A.

When first vane 121Aa and the second vane 121Ab move in the first direction A, the first nozzle 231F and the second nozzle 232F may inject, e.g., always inject the washing water.

Figure 46:
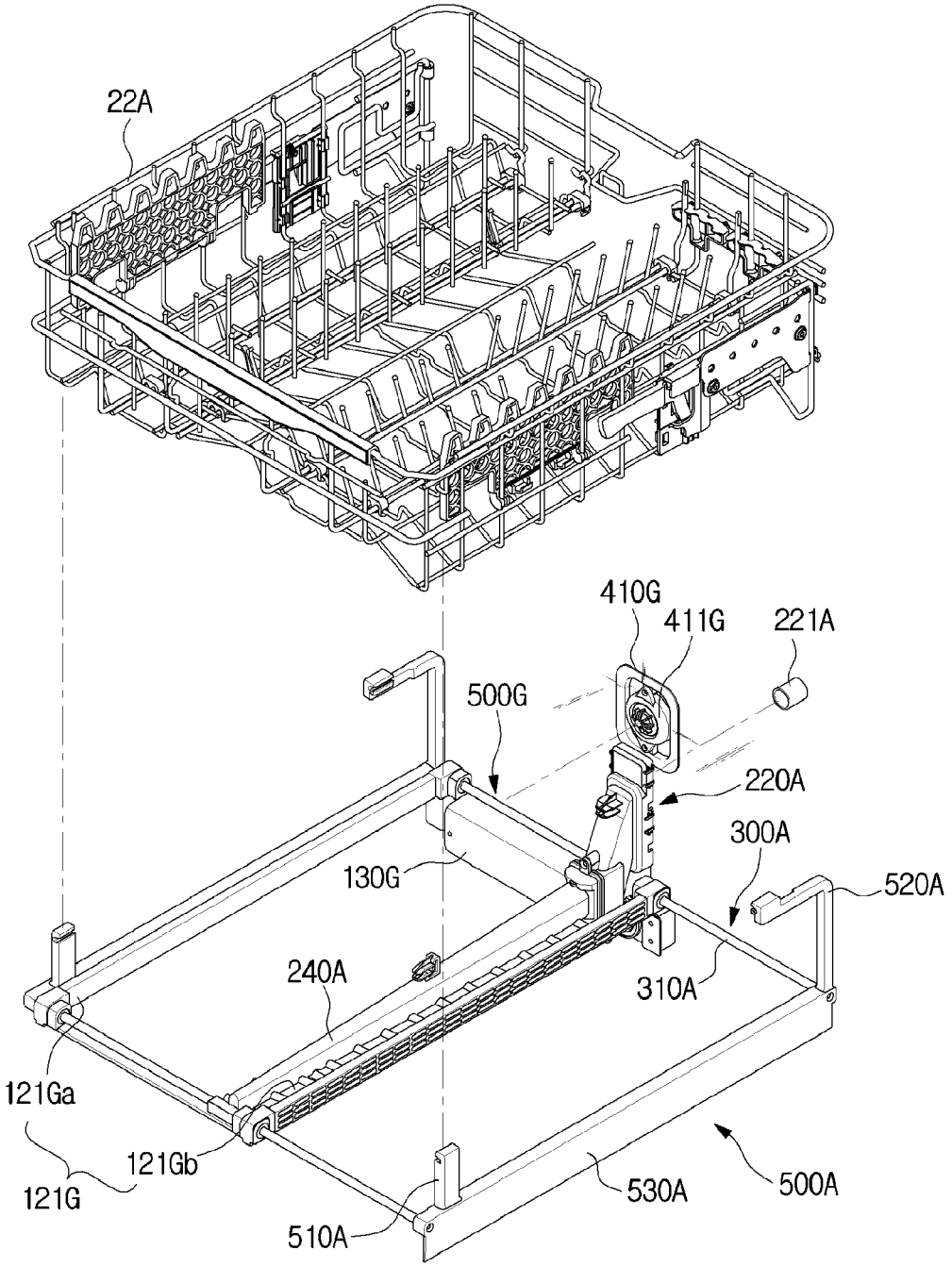
FIG. 46 is a view illustrating an injection unit and a deflection unit according to a seventh embodiment of the disclosure.
Figure 47:
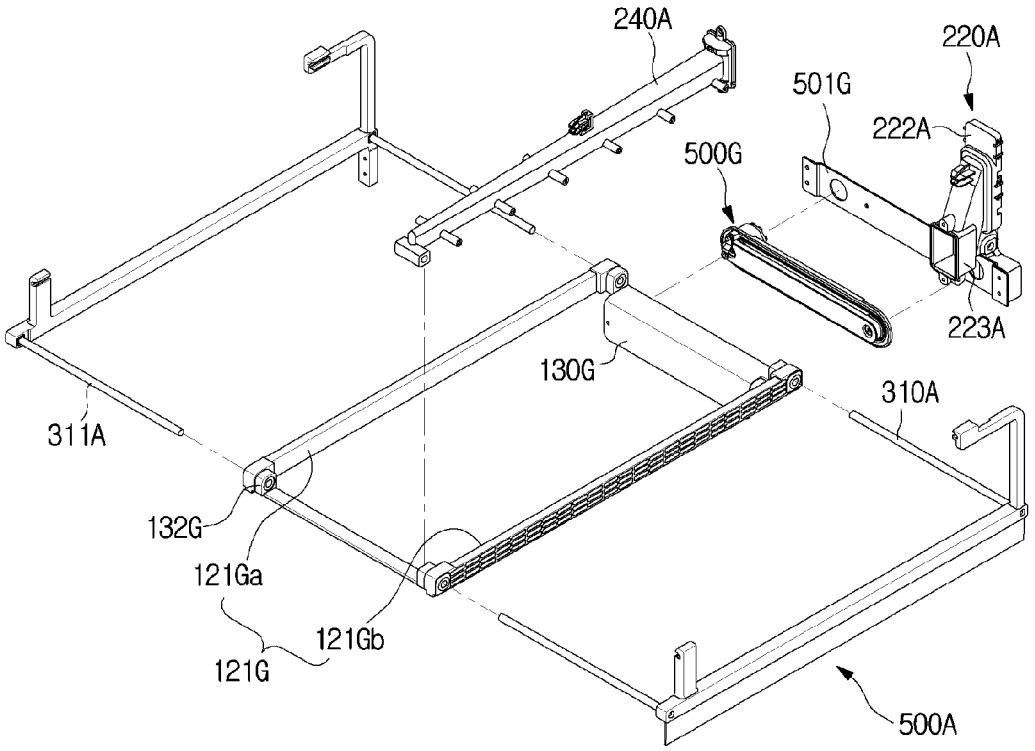
FIG. 47 is an exploded perspective view of a motor assembly for driving the deflection unit according to the seventh embodiment of the disclosure.
Figure 48:
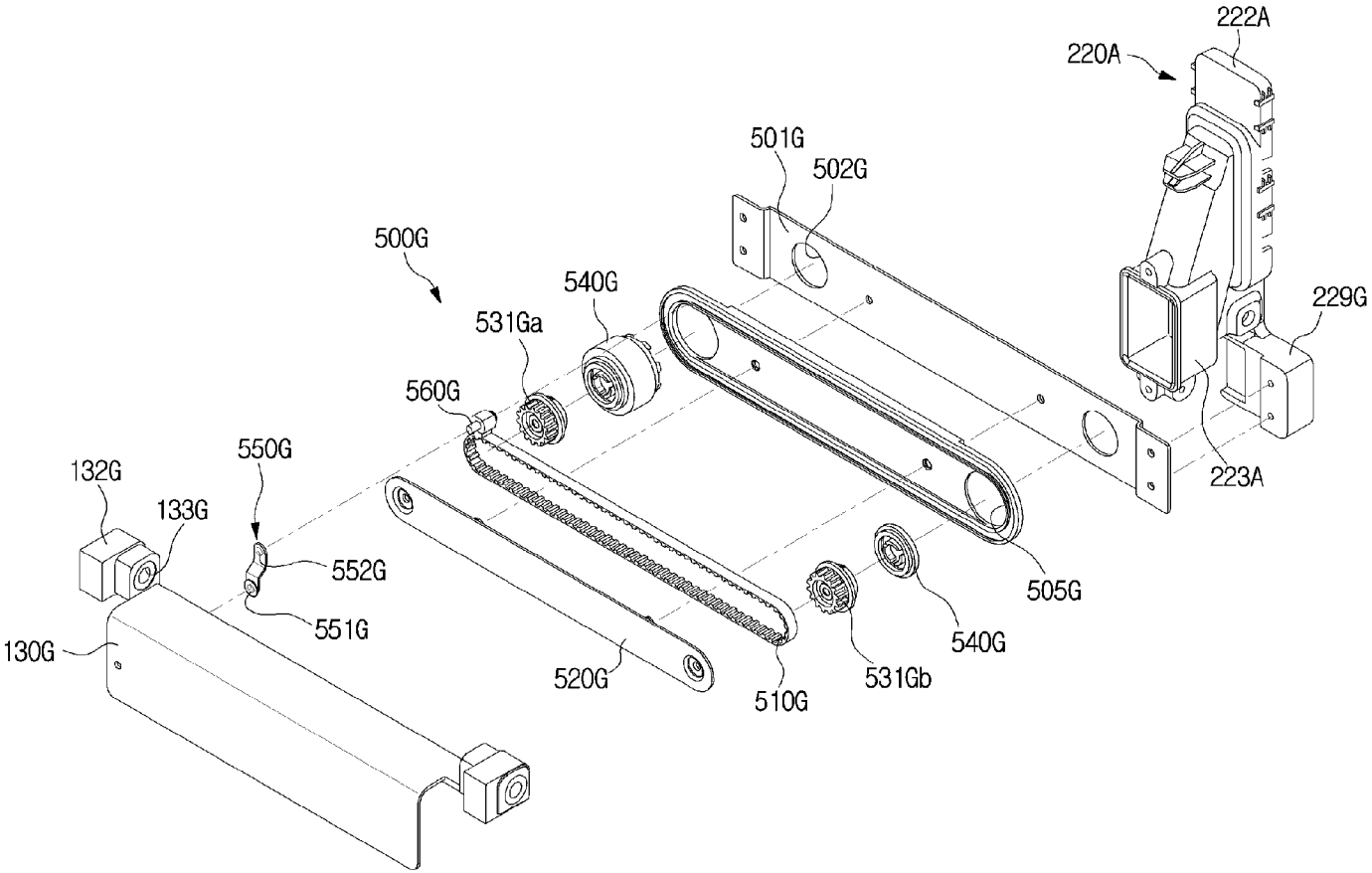
FIGS. 48 and 49 are exploded perspective views of the motor assembly according to the seventh embodiment of the disclosure.
Figure 49:
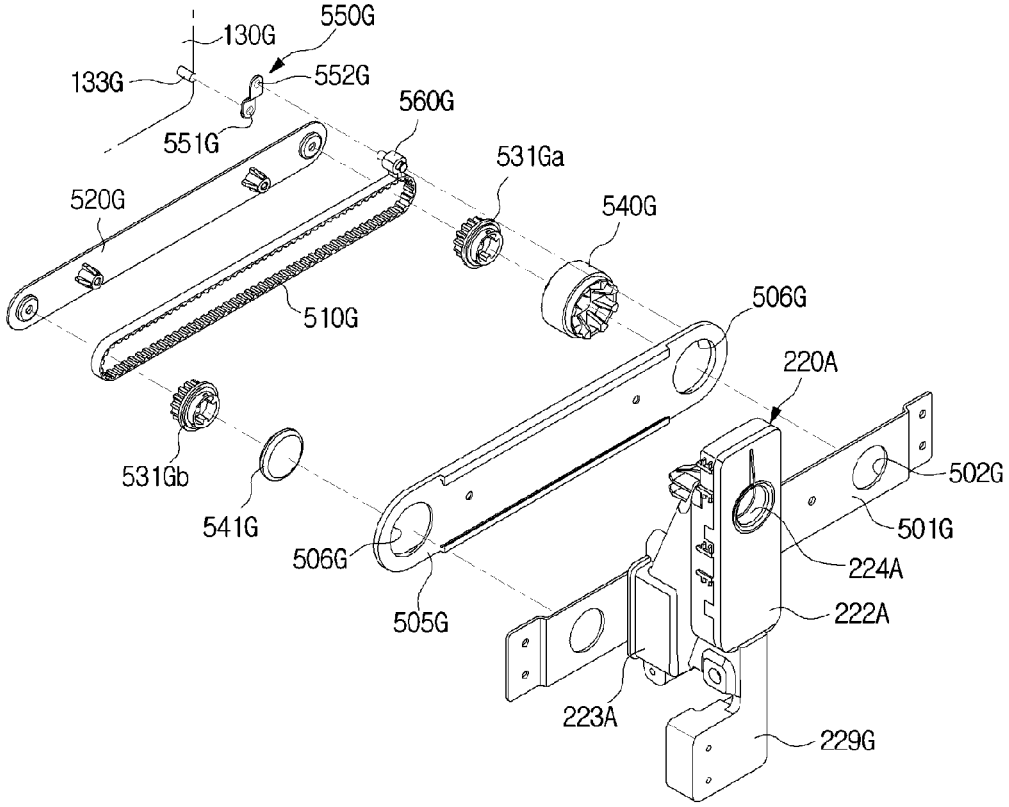
Figure 50:
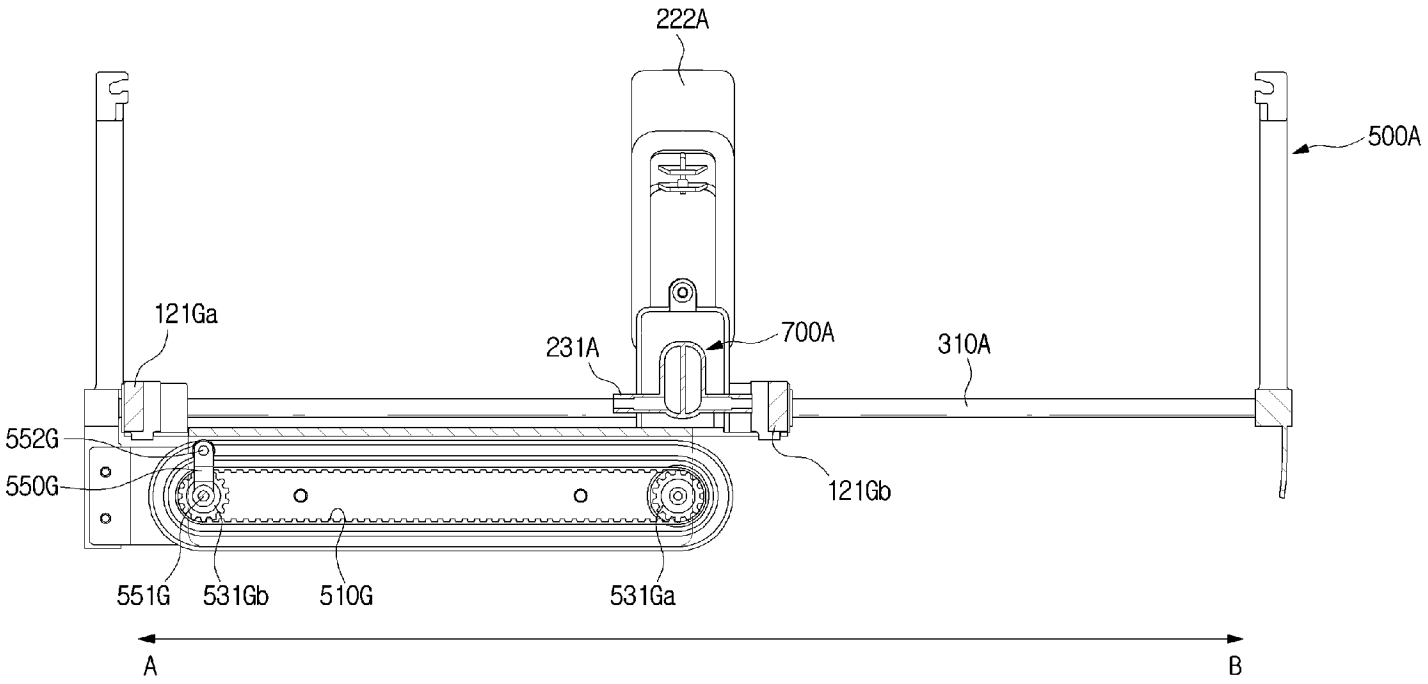
FIGS. 50 and 51 are view illustrating the movement of the deflection unit according to the driving of the motor assembly according to the seventh embodiment of the disclosure.
Figure 51:
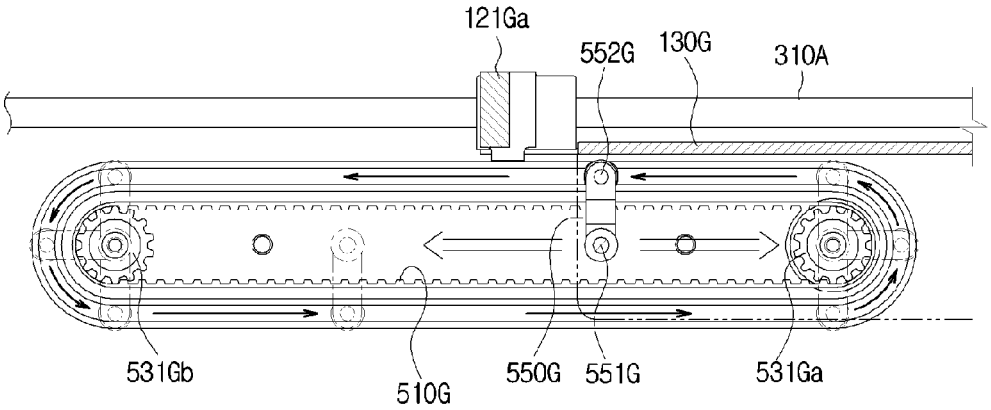

FIG. 46 is a view illustrating an injection unit and a deflection unit 120G according to a seventh embodiment of the disclosure. FIG. 47 is an exploded perspective view of a motor assembly 400G for driving the deflection unit 120G according to the seventh embodiment of the disclosure. FIGS. 48 and 49 are exploded perspective views of the motor assembly 400G according to the seventh embodiment of the disclosure. FIGS. 50 and 51 are view illustrating the movement of the deflection unit 120G according to the driving of the motor assembly 400G according to the seventh embodiment of the disclosure. Hereinafter, reference numerals not illustrated in the drawings can be found with reference to FIGS. 1 to 46. Also, description s that are the same as those with reference to FIGS. 1 to 46 may be omitted.

As illustrated in FIGS. 46 and 51, the motor assembly 400G provided to drive the deflection unit 120G according to the seventh embodiment of the disclosure may include a motor 411G of a motor installation portion 410G installed on the rear wall 11Aa of the washing tub 11A and a belt assembly 500G provided to transfer the power of the motor 401G.

The second injection unit 220A may include the second fixed nozzle 221A provided on the rear wall 11Aa of the washing tub 11A and the injection case 222A installed in the rear of the second dish basket 22A to be connected to the second fixed nozzle 221A. The second fixed nozzle 221A is provided to be fixed to the rear wall 11Aa of the washing tub 11A to inject the washing water to the washing tub 11A. The fixed nozzle connection portion 224A to connect the second fixed nozzle 221A may be formed in a rear side of the injection case 222A.

The injection case 222A may include the injection body 240A to extend forward and the injection nozzles 230A on the left and right of the injection body 240A.

The injection body connection portion 223A having an open front to be connected with the injection body 240A may be provided below the injection case 222A, the.

The second deflection unit 120G includes a vane unit 121G provided to reciprocate in a direction in which the washing water is injected. The vane unit 121G may include a first vane 121Ga disposed to deflect the washing water injected through the first nozzle 231A of the injection nozzle 230A and a second vane 121Gb disposed to deflect the washing water injected through the second nozzle 232A.

The first vane 121Ga and the second vane 121Gb may be interconnected to interwork with each other. The first vane 121Ga and the second vane 121Gb may be spaced from each other at a certain interval due to a vane connection portion 124G. The vane connection portion 124G may connect ends of the first vane 121Ga and the second vane 121Gb.

The second deflection unit 120G may include the motor assembly 400G provided to move the vane unit 121G.

The motor assembly 400G may be disposed below the injection case 222A.

The motor assembly 400G may include the motor 401G fixed to the rear wall 11Aa of the washing tub 11A and generating a driving force and the belt assembly 500G to be connected to the motor 401G and to transfer the driving force to the vane unit 121G.

The belt assembly 500G may include a first pulley 531Ga and a second pulley 531Gb that are connected to the motor 401G and rotate, a belt 510G that is connected to the first pulley 531Ga and the second pulley 531Gb and rotates, and a connection link 550G connecting the belt 510G with the vane unit 121G.

The belt assembly 500G may be installed on a belt frame 501G installed on the rear wall 11Aa of the washing tub 11A. One side of the belt frame 501G may be fixed to the rear wall 11Aa of the washing tub 11A and the other side thereof may be fixed to a belt frame bracket 229G provided below the injection case 222A.

The belt frame 501G may include a motor installation opening 502G corresponding to the motor 401G installed in the motor installation portion 410G on the rear wall 11Aa of the washing tub 11A.

A belt installation portion 505G including a belt rail 507G to movably install a belt 510G may be provided in front of the belt frame 501G. Pulley installation openings 506G may be formed to install the first pulley 531Ga and the second pulley 531Gb for supporting the rotation of the belt 510G at both ends of the belt installation portion 505G.

The first pulley 531Ga may be connected to the motor 401G through a motor connection member 540G and may receive the driving force of the motor 401G. The first pulley 531Ga may be connected to the belt 510G and rotates the belt 510G. One end of the belt 510G may be rotatably supported by the second pulley 531Gb. The second pulley 531Gb may be installed in the pulley installation opening 506G of the belt installation portion 505G using a second pulley bracket 541G.

A belt cover 520G for protecting the belt 510G may be installed In front of the belt installation portion 505G, a.

A moving rail 130G to receive the power from the motor assembly 400G and to move the first vane 121Ga and the second vane 121Gb may be installed at rear stages of the first vane 121Ga and the second vane 121Gb of the vane unit 121G.

The moving rail 130G may connect a rail coupling portion 132G in the rear of the first vane 121Ga and a rail coupling portion 132G in the rear of the second vane 121Gb. The moving rail 130G may have a shape bent toward a front lower side to protect the rail assembly 300G.

A belt coupling portion 133G to connect with the belt 510G of the belt assembly 500G may be formed on the moving rail 130G. The belt coupling portion 133G may be formed on a certain position on a rear side of the moving rail 130G to protrude backward. The belt coupling portion 133G may be rotatably connected to the belt 510G using the connection link 550G.

The connection link 550G includes a first connection portion 551G formed on one end and a second connection portion 552G formed on the other end.

The first connection portion 551G may be coupled with the belt coupling portion 133G of the moving rail 130G, and the second connection portion 552G may be coupled with a connection link fixing member 560G fixed to the belt 510G.

The first connection portion 551G and the second connection portion 552G of the connection link 550G may be rotatably coupled with the belt coupling portion 133G of the moving rail 130G and the connection link fixing member 560G of the belt 510G.

Accordingly, when the motor 401G of the motor assembly 400G rotates, the first pulley 531Ga connected to the motor 401G rotates and the belt 510G rotates due to the rotation of the first pulley 531Ga.

The moving rail 130G of the vane unit 121G may be movable by the connection link 550G connected to the belt 510G.

Figure 52:
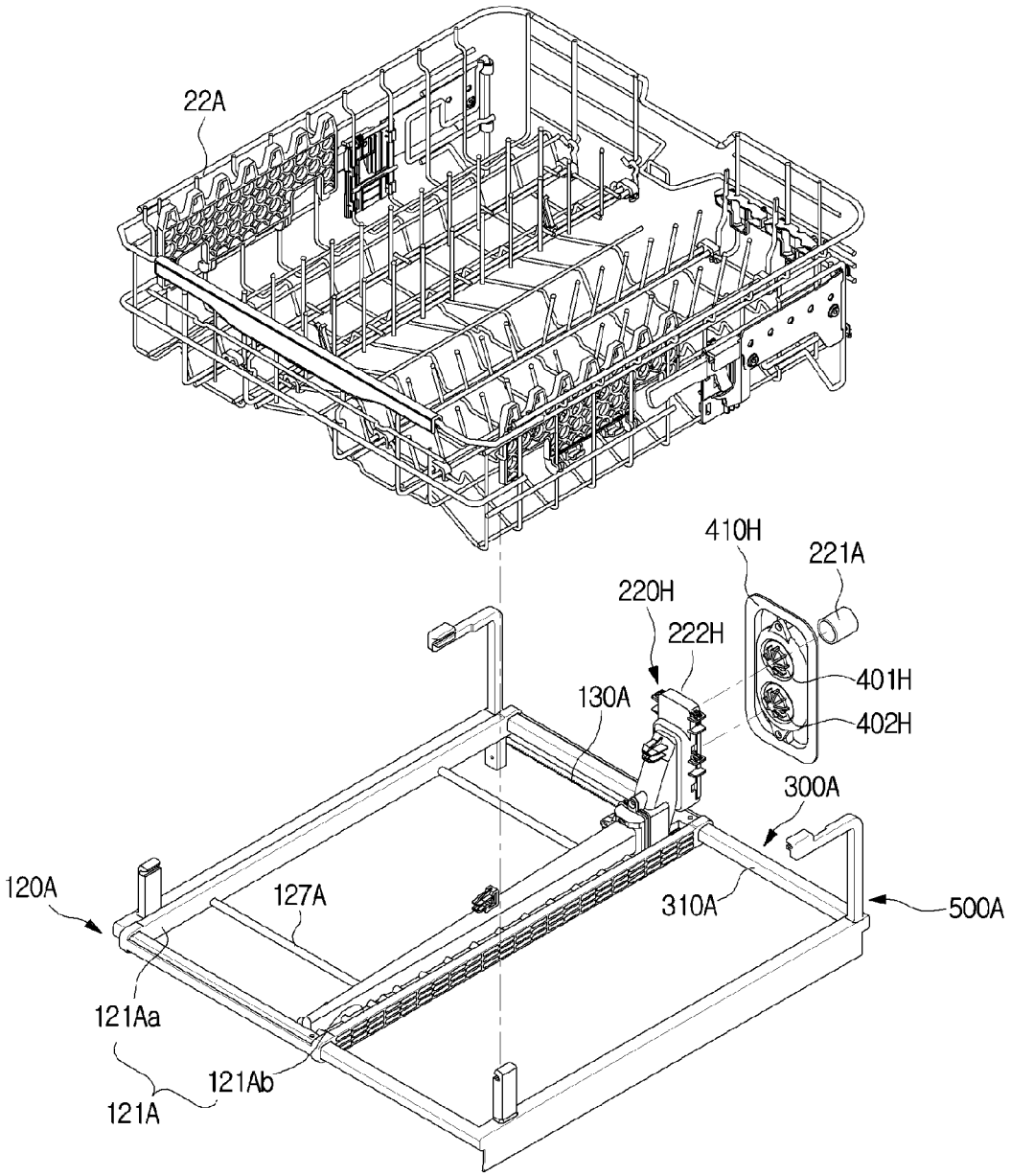
FIG. 52 is a view illustrating an injection unit and a deflection unit installed in a dish basket installable at different heights according to an eighth embodiment of the disclosure.
Figure 53:
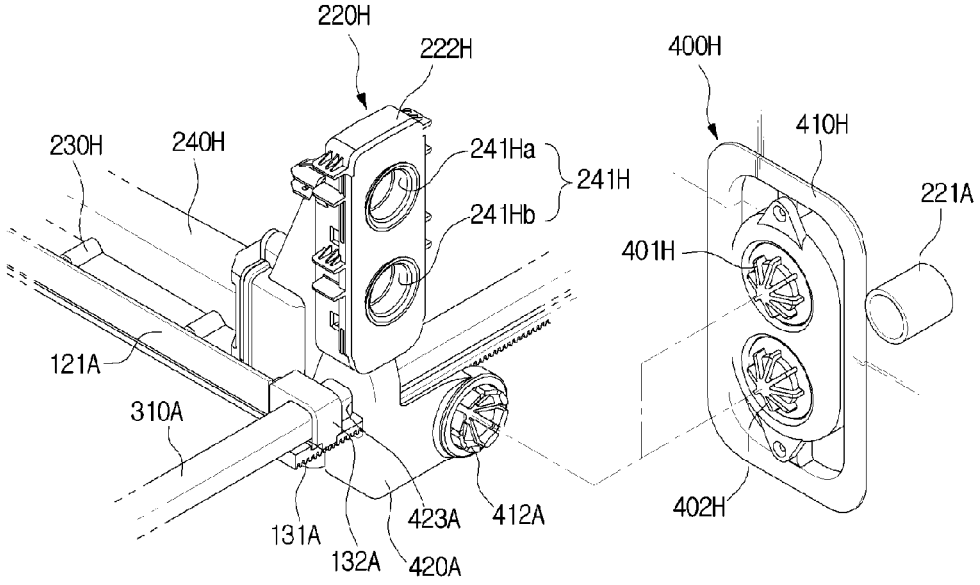
FIG. 53 is a view illustrating a connection between a motor assembly of the deflection unit and a driving unit of a washing tub according to the eighth embodiment of the disclosure.
Figure 54:
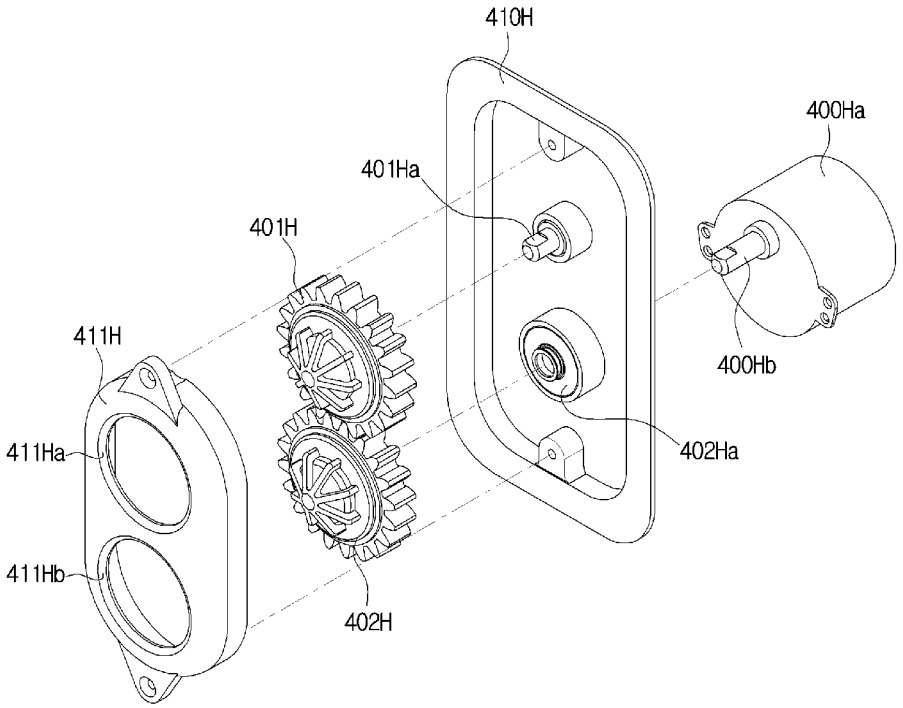
FIG. 54 is an exploded perspective view of the driving unit according to the eighth embodiment of the disclosure.
Figure 55:
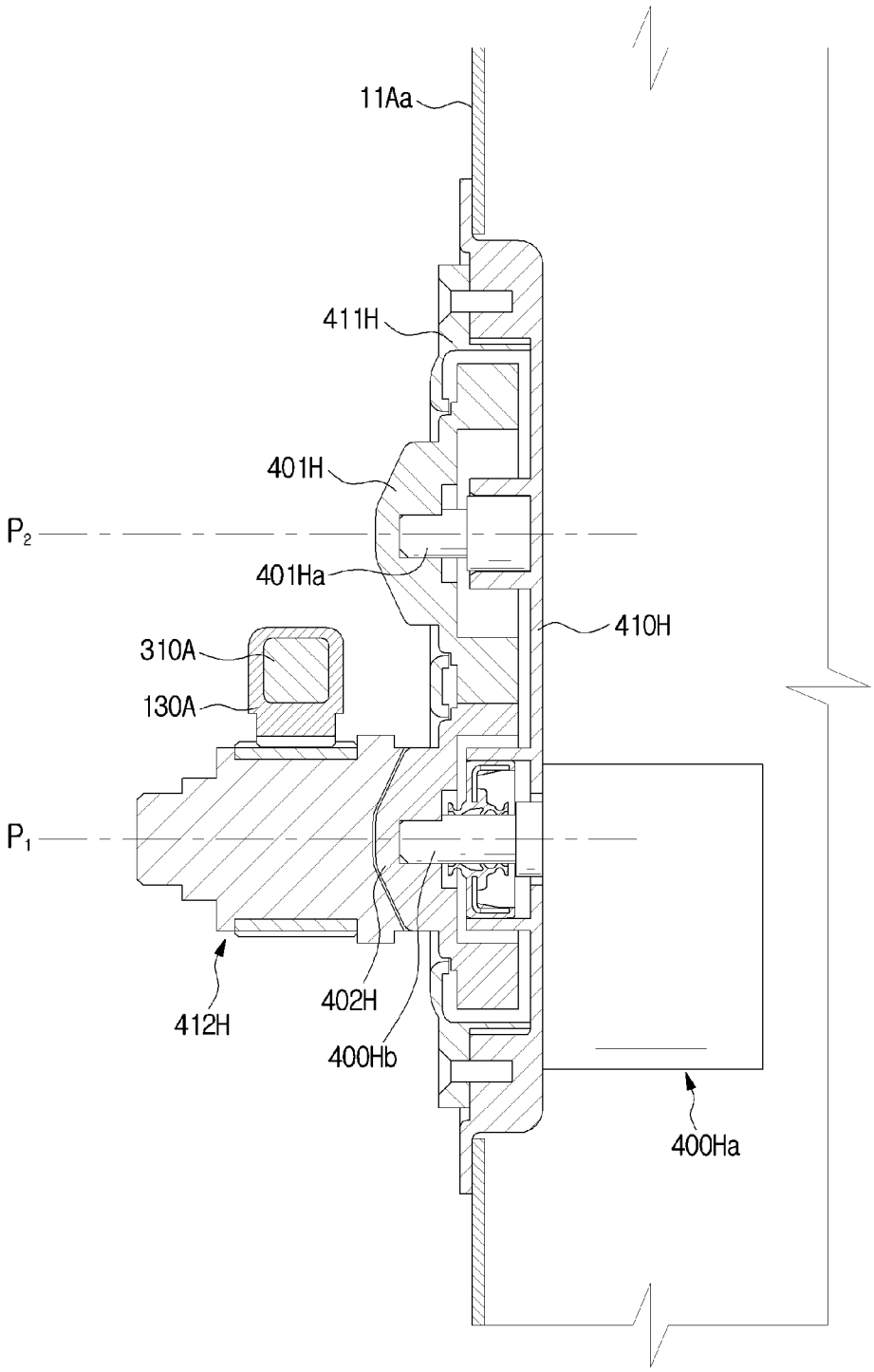
FIG. 55 is a cross-sectional view of the driving unit according to the eighth embodiment of the disclosure.
Figure 56:
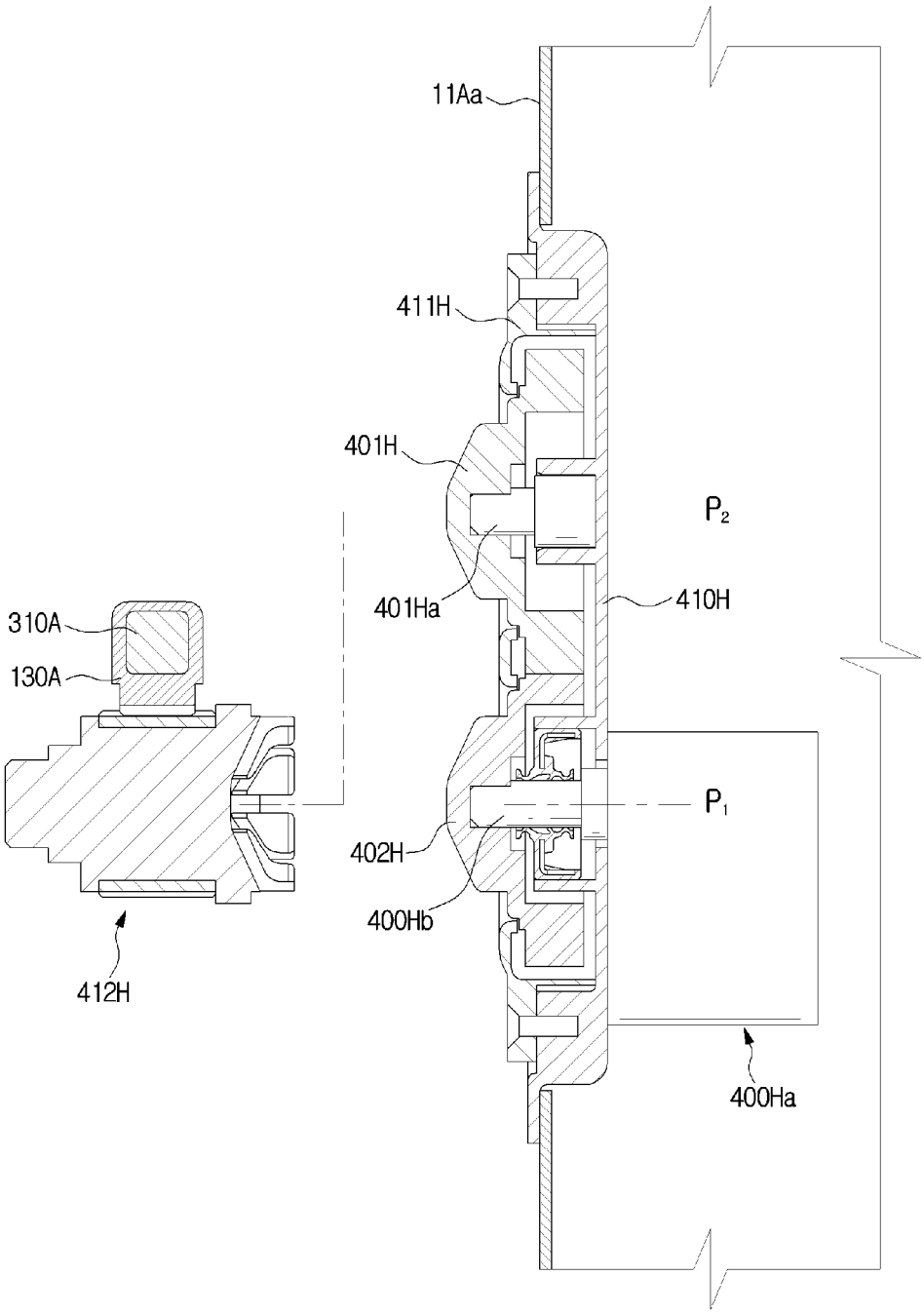
FIGS. 56 and 57 are views illustrating an operation of the driving unit according to the eighth embodiment of the disclosure.
Figure 57:
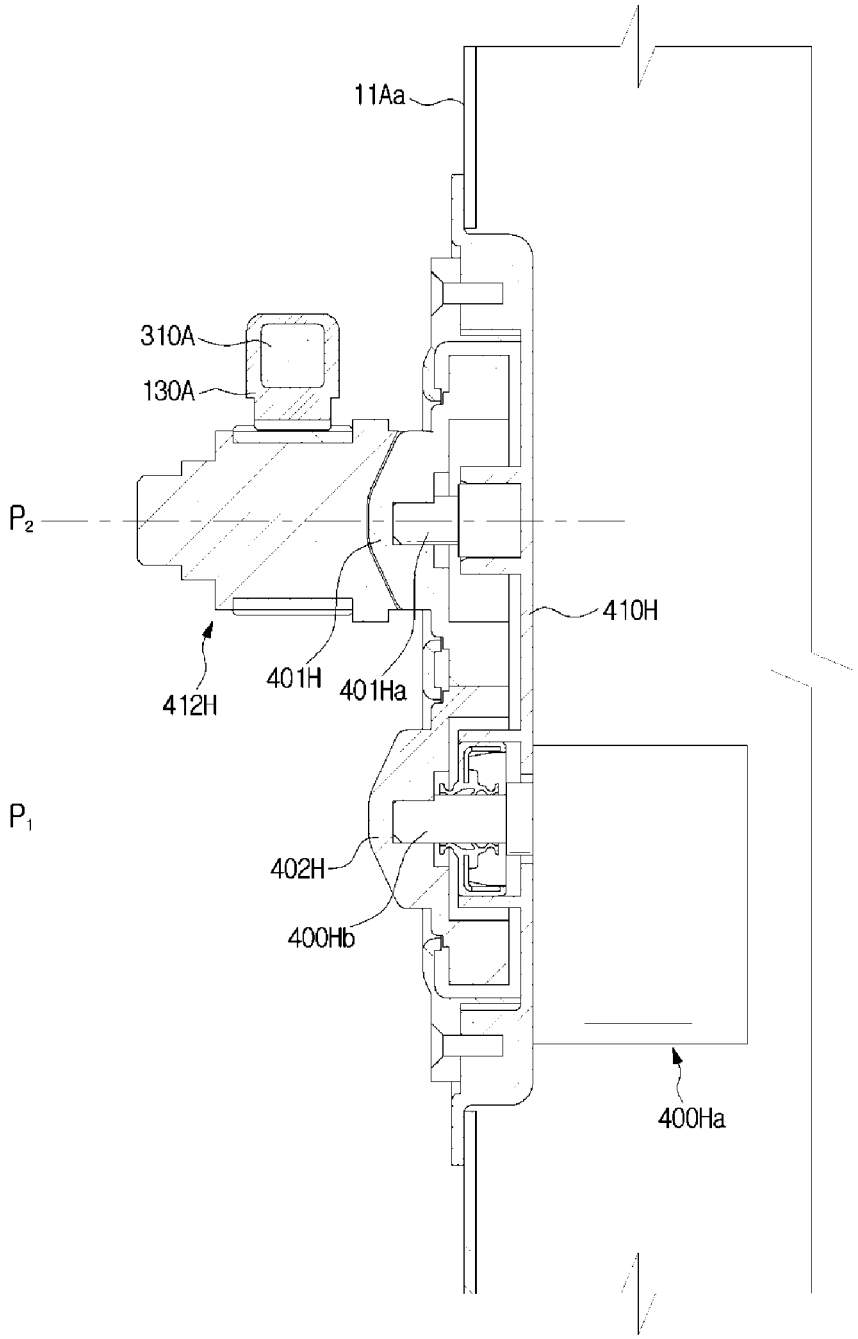

FIG. 52 is a view illustrating an injection unit and a deflection unit installed in a dish basket installable at different heights according to an eighth embodiment of the disclosure. FIG. 53 is a view illustrating a connection between a motor assembly of the deflection unit and a driving unit 400H of the washing tub 11A according to the eighth embodiment of the disclosure. FIG. 54 is an exploded perspective view of the driving unit 400H according to the eighth embodiment of the disclosure. FIG. 55 is a cross-sectional view of the driving unit 400H according to the eighth embodiment of the disclosure. FIGS. 56 and 57 are views illustrating an operation of the driving unit 400H according to the eighth embodiment of the disclosure. Hereinafter, reference numerals not illustrated in the drawings can be found with reference to FIGS. 1 to 51. Also, description s that are the same as those with reference to FIGS. 1 to 51 may be omitted.

As illustrated in FIGS. 52 to 57, a second injection unit 220H according to the eighth embodiment of the disclosure may be installed below the second dish basket 22A to deflect the washing water injected from the second injection unit 220H toward the dishes.

The second injection unit 220H may include the fixed nozzle 221A fixed to the rear wall 11Aa of the washing tub 11A and to inject the washing water, an injection case 222H installed in the second dish basket 22A connected to the fixed nozzle 221A, and an injection body 240H extending in front of the injection case 222H.

The injection case 222H may include a plurality of fixed nozzle connection openings 241H on a rear side thereof, and the injection body 240H may include a first nozzle 231H and a second nozzle 232H to inject the washing water supplied through the fixed nozzle connection openings 241H forward.

The fixed nozzle connection openings 241H may be connected to the second fixed nozzle 221A, receive the washing water from the second fixed nozzle 221A, and allow the washing water to flow into the injection case 222H. The washing water flowing into the injection case 222H may be supplied to the injection body 240H connected through the injection body connection portion 223H of the injection case 222H.

The fixed nozzle connection openings 241H may be formed at different heights to correspond to a variable position of the second dish basket 22A.

The fixed nozzle connection openings 241H may include a first fixed nozzle connection opening 241Ha located on an upper portion of the injection case 222H and a second fixed nozzle connection opening 241Hb located below the first fixed nozzle connection opening 241Ha.

That is, when the second dish basket 22A is located in the first position P1, the second fixed nozzle 221A is connected to the first fixed nozzle connection opening 241Ha. When the second dish basket 22A is located in the second position P2 higher than the first position P1, the second fixed nozzle 221A may be connected to the second fixed nozzle connection opening 241Hb.

Although not illustrated in the drawings, a valve to move between the first fixed nozzle connection opening 241Ha and the second fixed nozzle connection opening 241Hb to open and close it may be provided inside the injection case 222H.

Accordingly, when the washing water is supplied from the second fixed nozzle 221A of the second injection unit 220H, the washing water is supplied through one of the first fixed nozzle connection opening 241Ha and the second fixed nozzle connection opening 241Hb of the injection case 222H connected to the second fixed nozzle 221A and is injected through at least one of the first nozzle 231H and the second nozzle 232H of an injection nozzle 230H.

The washing water injected through the injection nozzle 230H deflects toward the dishes thereabove through the second deflection unit 120A.

The second deflection unit 120A may be provided below the second dish basket 22A and moves together with the second dish basket 22A when an installation height of the second dish basket 22A varies.

The second deflection unit 120A may include a driving unit 400H for transferring the power to the motor assembly 400A provided to move the vane unit 120A and the motor assembly 400A provided to receive the power from the driving unit 400H to move the vane unit 120A.

The driving unit 400H includes a motor 400Ha that is provided on the rear wall 11Aa of the washing tub 11A and generates a driving force.

The motor 400Ha may be installed in a motor installation portion 410H provided on the rear wall 11Aa of the washing tub 11A. The motor 400Ha may be disposed in the rear of the motor installation portion 410H. A motor shaft 400Hb of the motor 400Ha may be coupled with a rotation supporting shaft 402Ha of the motor installation portion 410H. The motor installation portion 410H may include the rotation supporting shaft 402Ha for installing the motor 400Ha and a rotation shaft 401Ha located above the rotation supporting shaft 402Ha.

A first motor connection portion 401H and a second motor connection portion 402H for transferring the torque of the motor 400Ha to the motor assembly 400A may be installed in the motor installation portion 410H. The first motor connection portion 401H may be installed on the rotation shaft 401Ha of the motor installation portion 410H, and the motor connection portion 402H is installed on the rotation supporting shaft 402Ha. The first motor connection portion 401H and the second motor connection portion 402H may be installed to be engaged with each other.

Accordingly, when the motor 400Ha on the rear wall 11Aa of the washing tub 11A rotates, the first motor connection portion 401H connected to the motor shaft 400Hb and the second motor connection portion 402H engaged with the first motor connection portion 401H rotate together.

A motor installation portion cover 411H may be coupled with a front side of the motor installation portion 410H The motor installation portion cover 411H may be provided to protect the first and second connection portions 401H and 402H. The motor installation portion cover 411H may include a first installation opening 411Ha and a second installation opening 411Hb that penetrate therethrough to connect the first motor connection portion 401H and the second motor connection portion 402H to the motor connection portion 412A of the motor assembly 400A. The first installation opening 411Ha may be disposed above the second installation opening 411Hb.

The motor connection portion 412A of the motor assembly 400A may include the first gear portion 411A in which a motor connection portion 412S may be provided to connect to any one of the first motor connection portion 401H and the second motor connection portion 402H depending on the installation position of the second dish basket 22A and the second gear 131A to be engaged with the first gear portion 411A to move the vane unit 120A.

Accordingly, when the second dish basket 22A is located in the first position P1, the motor connection portion 412A of the motor assembly 400A in the rear of the second dish basket 22A may be coupled with the first motor connection portion 401H of the washing tub 11A.

Due to the motor connection portion 412A coupled with the first motor connection portion 401H, the torque of the motor 400Ha may be transferred to the vane unit 120A through the first gear portion 411A and the first gear 411Aa of the first gear portion 411A, the second gear 131A of the moving rail 130A are engaged with each other and move together.

When the second dish basket 22A is located in the second position P2, the motor connection portion 412A of the motor assembly may be coupled with the second motor connection portion 402H of the washing tub 11A.

Due to the motor connection portion 412A coupled with the second motor connection portion 402H, the torque of the motor 400Ha may be transferred to the vane unit 120A through the first gear portion 411A and the first gear 411Aa of the first gear portion 411A and the second gear 131A of the moving rail 130A are engaged with each other and move together.

Figure 58:
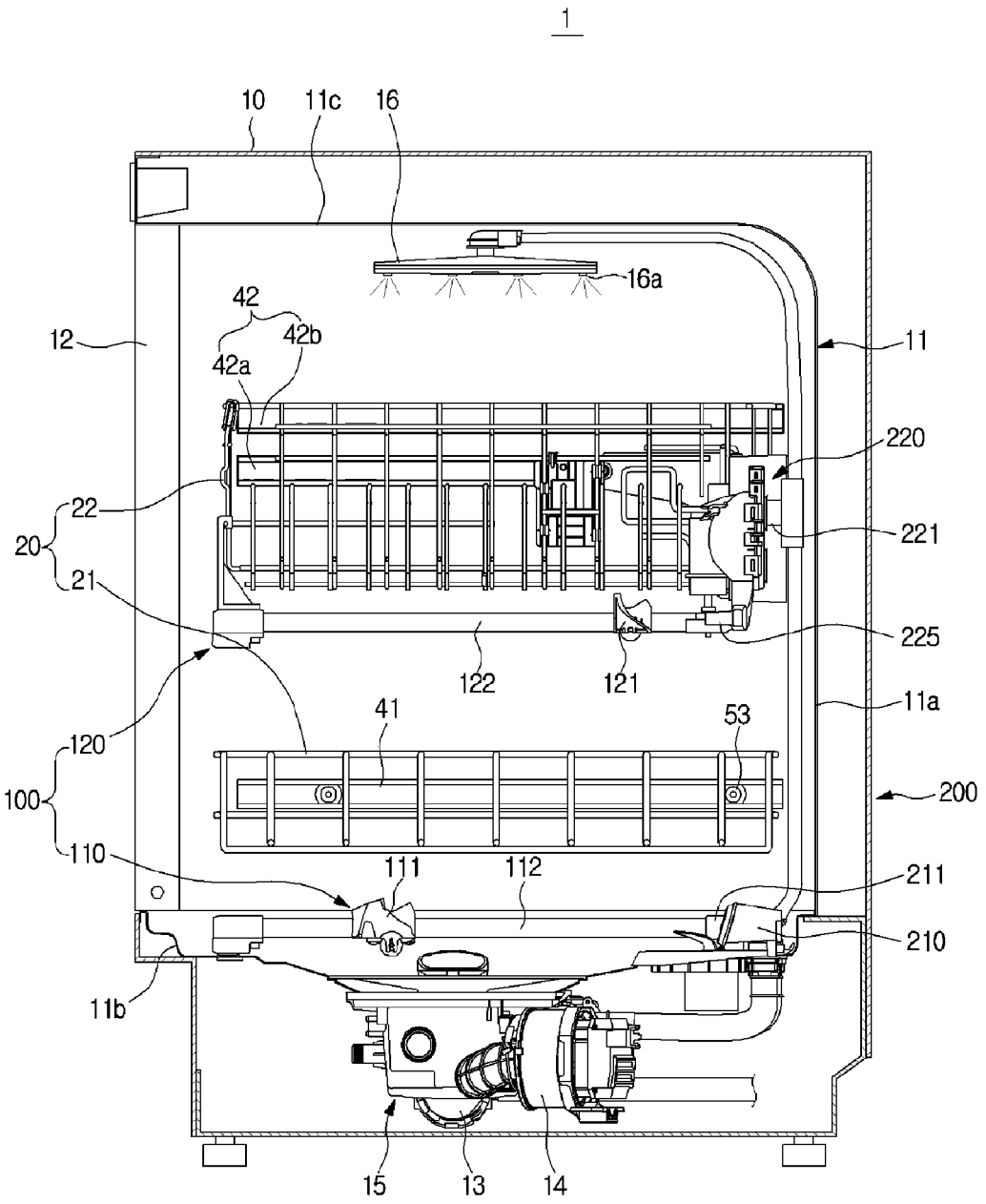
FIG. 58 is a cross-sectional view illustrating a configuration of a dish washing machine according to a ninth embodiment of the disclosure.
Figure 59:
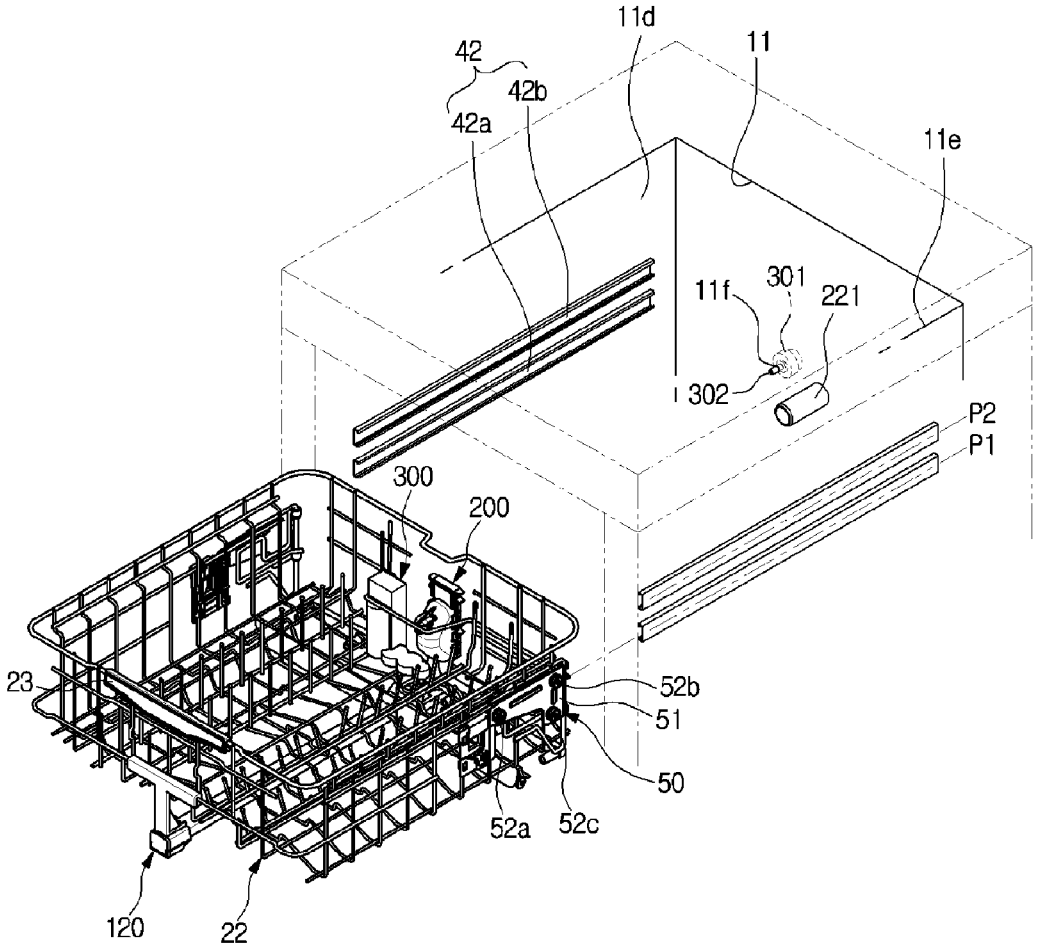
FIG. 59 is a view of a dish basket mounted in a washing tub of the dish washing machine according to the ninth embodiment of the disclosure.

The second motor connection portion 402H may be engaged and receive the torque due to the rotation of the first motor connection portion 401H connected to the motor 400Ha. Referring to FIGS. 58 and 59, a dish washing machine according to a ninth embodiment of the disclosure will be schematically described.

The dish washing machine 1 includes a cabinet 10 forming an external shape, a washing tub 11 provided inside the cabinet 10, dish baskets 20 inside the washing tub 11 to store dishes, an injection unit 200 inside the washing tub 11 to inject washing water, a deflection unit 100 to move inside the washing tub 11 to deflect the washing water toward the dishes, and a power transmission device 300 to transfer power to move the deflection unit 100.

A front side of the cabinet 10 may open to allow a user to store the dishes in the washing tub 11 or to withdraw the dishes from the washing tub 11, and a door 12 may be installed to open and close the washing tub 11.

The door 12 may be hinge-coupled with a bottom of the front side of the cabinet 10 and rotatable, and able to open and close the washing tub 11A. The washing tub 11 may include a top wall 11*c*, a rear wall 11*a*, left and right walls 11*d* and 11*e*, and a bottom plate 11*b*.

A sump 15 to store the washing water, a circulating pump 14 to pump the washing water in the sump 15, and a drainage pump 13 that discharges the washing water in the sump 15 to the outside of the cabinet 10 together with waste may be provided below the washing tub 11 of the cabinet 10.

The dish baskets 20 may be racks, for example, wire racks formed of wires to allow the washing water to pass therethrough without ponding. The dish baskets 20 may be detachably provided inside the washing tub 11. A handle 23 to permit a user to smoothly detaching the dish basket 20 may be provided on a top of a front side of the dish basket 20.

The dish baskets 20 may include a first dish basket 21 disposed on a bottom of the washing tub 11 and a second dish basket 22 disposed in the middle of the washing tub 11.

The first dish basket 21 may be coupled, for example, slidably coupled by a fixed rail 41 spaced upward from the bottom plate 11*b* of the washing tub 11.

The fixed rails 41 may be formed on the left and right walls 11*d* and 11*e* of the washing tub 11 forward and rearward in the washing tub 11. Fixed rollers 53 may be installed on both sides of the first dish basket 21 to be rotatably coupled with the fixed rails 41.

Accordingly, the fixed rollers 53 of the first dish basket 21 may be coupled with the fixed rails 41 and attachable to or detachable from the washing tub 11A forward and rearward.

An installation height of the second dish basket 22 disposed in an upper portion of the washing tub 11 may variably be provided such that various types and sizes of dishes may be stored.

Guide rails 42 for installing the second dish basket 22 in the washing tub 11 may be formed on the left and right walls 11*d* and 11*e* of the washing tub 11 forward and rearward.

The guide rails 42 may each include a first guide rail 42*a* to support the second dish basket 22 in the first position P1 and a second guide rail 42*b* spaced upward from the first guide rail 42*a*. The second dish basket 22 supported by the second guide rail 42*b* may be located in the second position P2 spaced upward from the first position P1.

Accordingly, when the second dish basket 22 is located in the first position P1, it is possible to store dishes, e.g., dishware and cookware having a large size and volume such as plates and pots. When the second dish basket 22 is located in the second position P2 located higher than the first position P1, it is possible to store dishes having a smaller size and volume such as bowls or flatware.

Guide units 50 couplable with the guide rails 42 may be provided on both sides of the second dish basket 22. The guide units 50 each may include a guide bracket 51 fixedly coupled with the second dish basket 22, a first guide roller 52*a* and a second guide roller 52*b* formed on front and rear ends on top of the guide bracket 51, and a third guide roller 52*c* disposed below the second guide roller 52*b*.

The guide bracket 51 may be disposed in the rear of the second dish basket 22 to enable the guide rail 42 and the second dish basket 22 to smoothly slide.

The first guide roller 52*a* and the second guide roller 52*b* may be formed horizontally in parallel with each other.

When the first guide roller 52*a* and the second guide roller 52*b* of the second dish basket 22 are coupled with the first guide rail 42*a* and move, the second dish basket 22 may be located in the first position P1.

When the first guide roller 52*a* and the second guide roller 52*b* of the second dish basket 22 are coupled with the second guide rail 42*b* and move, the second dish basket 22 may be located in the second position P2.

The third guide roller 52*c* may be coupled with the first guide rail 42*a* to enable the second dish basket 22 to stably slide.

The injection unit 200 may be provided to be capable of washing the dishes by injecting the washing water at a high pressure. The injection unit 200 may include a rotating nozzle 16 provided on the top wall 11*c* of the washing tub 11 to inject the washing water while rotating, a first injection unit 210 provided on the bottom of the washing tub 11, and a second injection unit 220 installed on a bottom of the second dish basket 22 to be disposed in the middle of the washing tub 11.

The rotating nozzle 16 on the top may rotate above the second dish basket 22 due to water pressure and may inject the washing water downward. A plurality of injection holes 16*a* may be provided on a bottom end of the rotating nozzle 16*a*. The rotating nozzle 16 may inject the washing water directly toward the dishes stored in the second dish basket 22.

The first injection unit 210 may be fixed to one side of the washing tub 11 and may be disposed adjacent to the rear wall 11*a* of the washing tub 11 to inject the washing water toward the front of the washing tub 11. Accordingly, the washing water injected by the first injection unit 210 may not move directly toward the dishes.

The washing water injected by the first injection unit 210 may deflect toward the dishes in the first dish basket 21 through a first deflection unit 110. The first injection unit 210 may include a first fixed nozzle 211 provided forward on the rear wall 11*a* of the washing tub 11.

The first deflection unit 110 includes a first vane 111 to deflect the washing water injected from the first fixed nozzle 211 toward the dishes in the first dish basket 21. The vane 111 may extend to the left and right of the washing tub 11. That is, a longitudinal one end of the first vane 111 may be formed adjacent to the left wall 11*d* of the washing tub 11 and a longitudinal other end of the first vane 111 may be formed adjacent to the right wall 11*e* of the washing tub 11.

The first vane 111 may be provided such that it is able to linearly reciprocate in an injection direction of the washing water injected by the first fixed nozzle 211. The first vane 111 may move along a first lane 112. Accordingly, a linear injection structure including the first fixed nozzle 211 and the first vane 111 may wash a large area, e.g., the whole area of the washing tub 11 upward from a bottom end of the washing tub 11 without a blind spot, which may be differentiated from injecting washing water only within a radius of rotation of the rotating nozzle 16.

Figure 60:
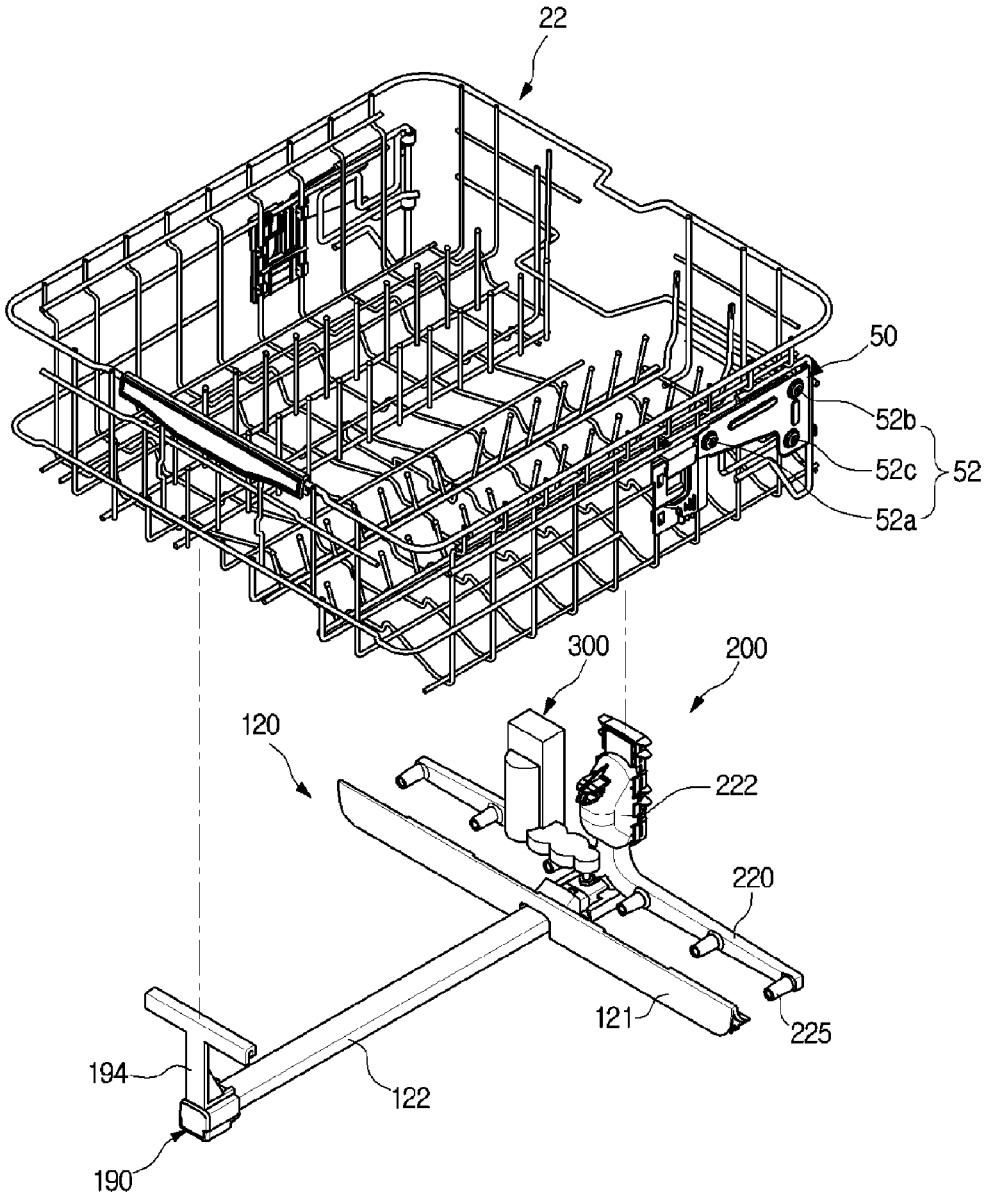
FIG. 60 is a view illustrating an injection unit, a deflection unit, and a power transmission device of the dish washing machine according to the ninth embodiment of the disclosure.
Figure 61:
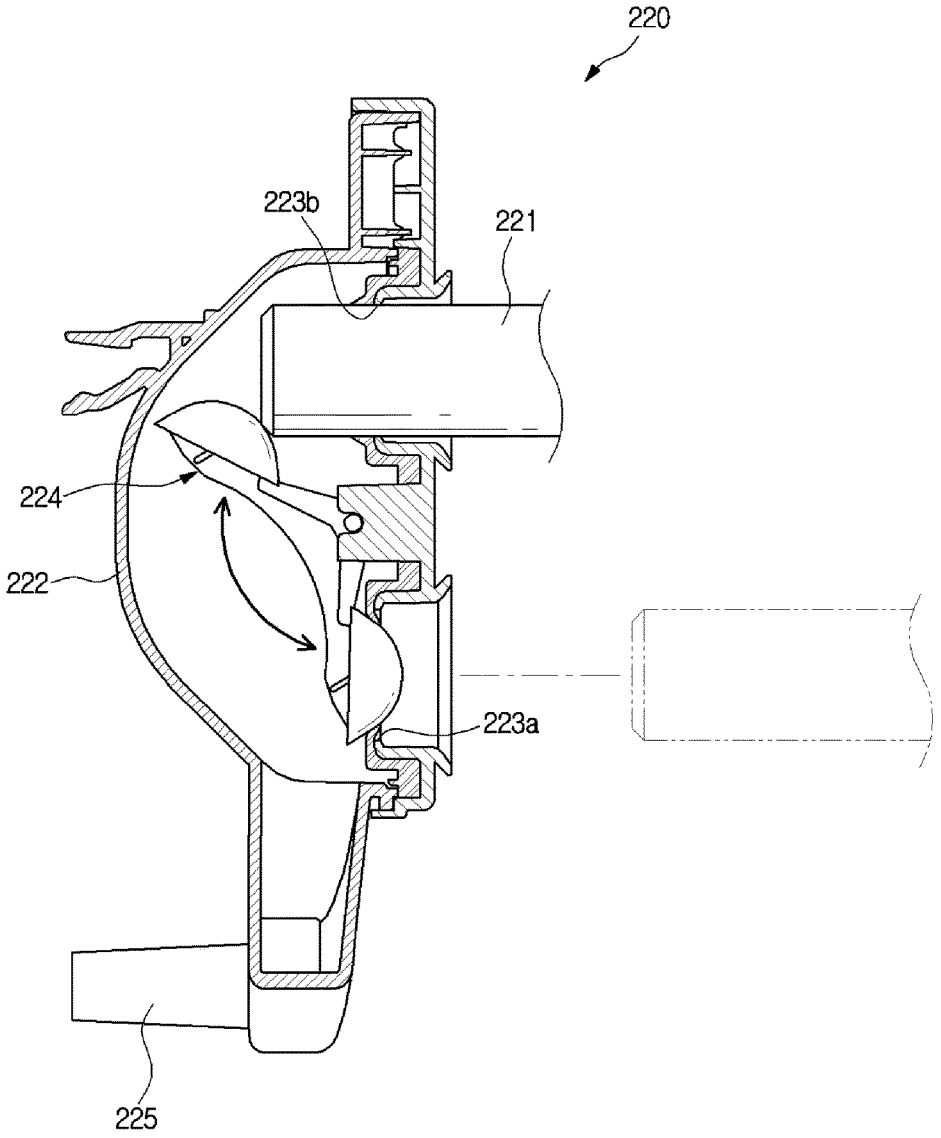
FIG. 61 is a schematic cross-sectional view of the injection unit according to the ninth embodiment of the disclosure.
Figure 62:
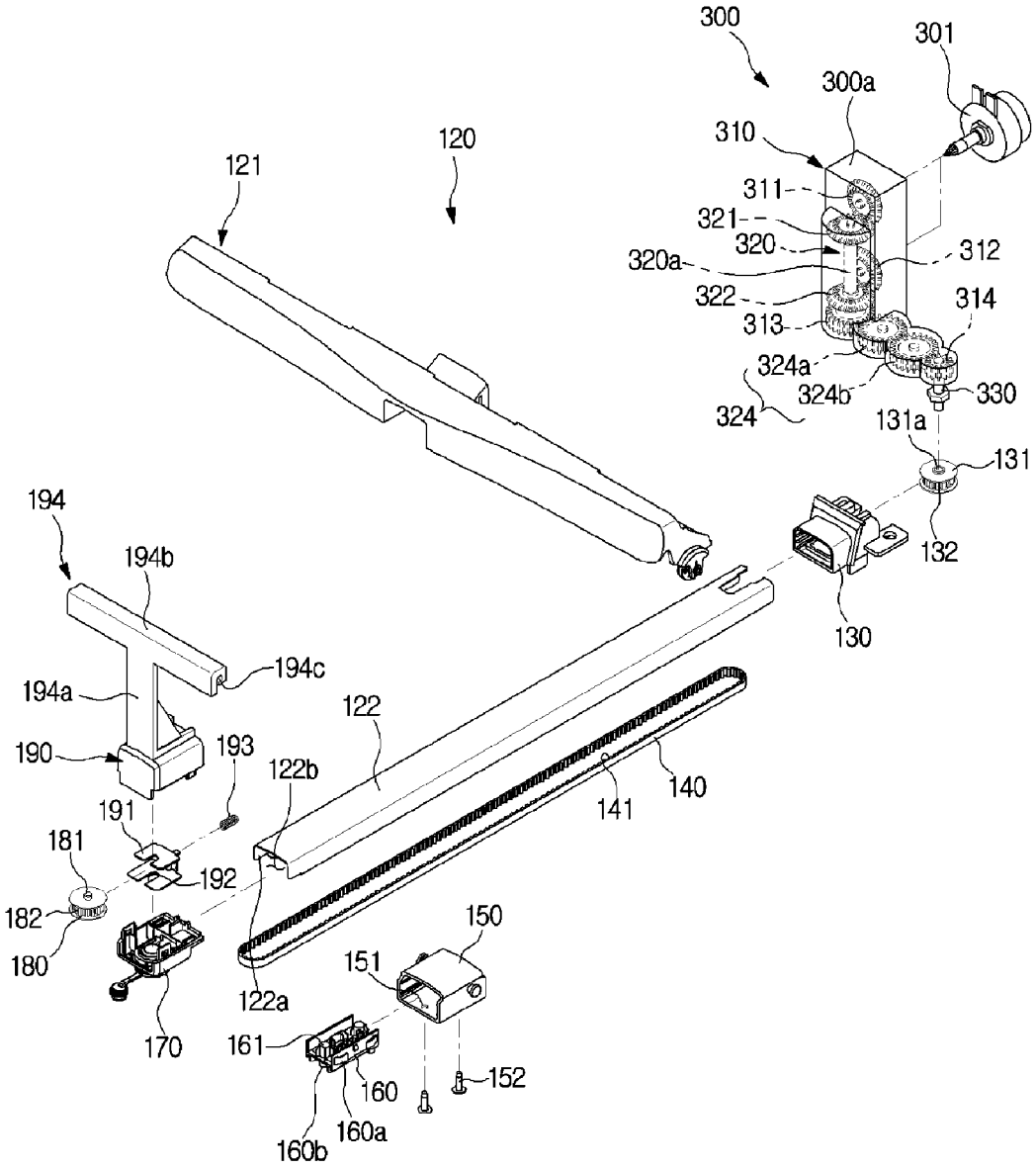
FIG. 62 is an exploded perspective view illustrating the deflection unit and the power transmission device according to the ninth embodiment of the disclosure.
Figure 63:
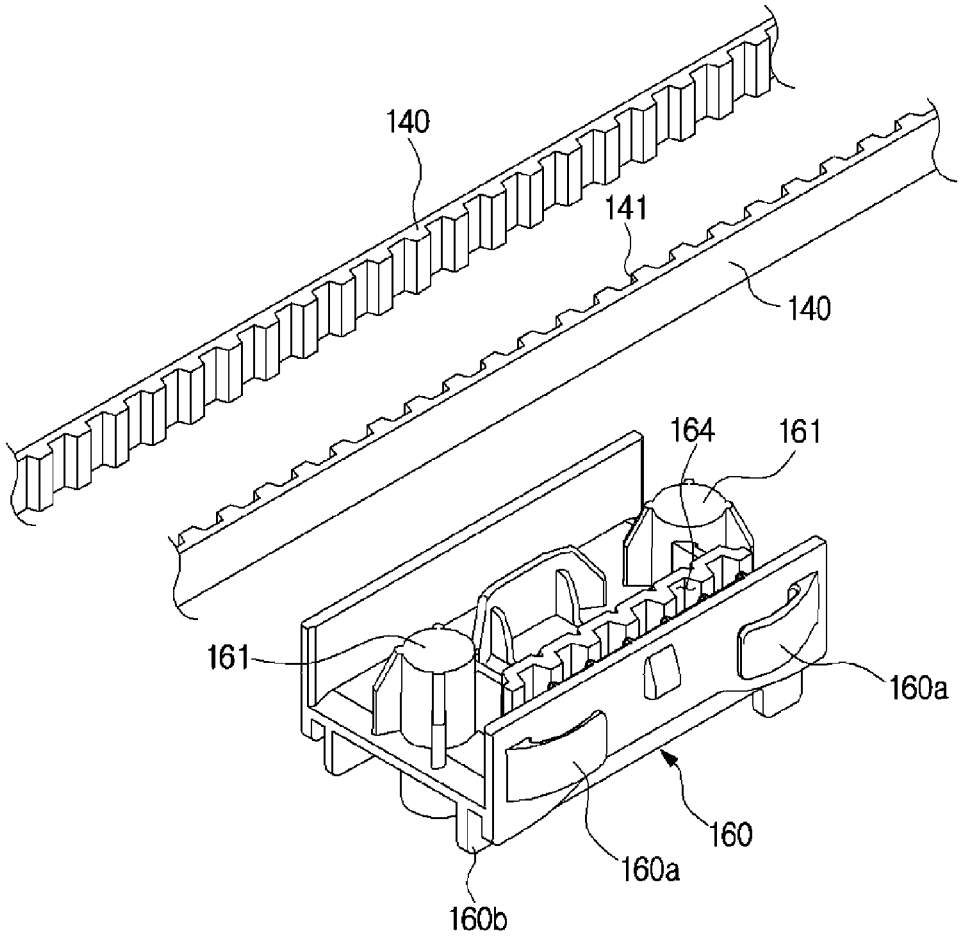
FIG. 63 is an exploded perspective view illustrating a belt and a belt holder of the deflection unit according to the ninth embodiment of the disclosure.

As illustrated in FIGS. 60 and 61, the second dish basket 22, provided in the washing tub 11 of the dish washing machine 1 such that a mounting height thereof is variable, may include the second injection unit 220 to inject the washing water and a second deflection unit 120 to deflect the washing water injected from the second injection unit 220, for example, toward the dishes.

The second injection unit 220 includes a second fixed nozzle 221 and an injection case 222, for example, integrally formed with the second dish basket 22 and connected to the second fixed nozzle 221.

The second fixed nozzle 221 may be fixed to the rear wall 11*a* of the washing tub 11 to inject the washing water. The injection case 222 may be fixedly disposed on a rear side of the second dish basket 22.

A plurality of connection openings 223*a* and 223*b* may be formed in the rear of the injection case 222. A plurality of nozzles 225 may be formed in the front of the injection case 222 to inject the washing water supplied through the connection openings 223*a* and 223*b*, for example, in a forward direction.

The injection nozzle 225 may extend below the injection case 222. The injection nozzle 225 may extend in the left and right directions of the washing tub. A plurality of injection nozzles 225 may be formed.

A plurality of connection openings 223 may be formed, for example, at different heights to correspond to a variable position of the second dish basket 22. A first connection opening 223*a* may be formed to be connectable to the second fixed nozzle 221 when the second dish basket 22 is located in the first position P1. A second connection opening 223*b* may be formed to be connectable to the second fixed nozzle 221 when the second dish basket 22 is located in the second position P2. The first connection opening 223*a* may be located above the second connection opening 223*b*.

A valve 224 to rotate, for example, between the first connection opening 223*a* and the second connection opening 223*b* to open and close an opening may be provided inside the injection case 222. The valve 224 may rotate downwards to open the first connection opening 223*a* and to close the second connection opening 223*b*, for example, when the second fixed nozzle 221 is connected to the first connection opening 223*a* of the injection case 222. The valve 224 may rotate upwards to open the second connection opening 223*b* and to close the first connection opening 223*a* when the second fixed nozzle 221 is connected to the second connection opening 223*b*.

Accordingly, when the washing water is injected from the second fixed nozzle 221 of the second injection unit 220, the washing water may be supplied through the connection opening 223 of the injection case 222 connected to the second fixed nozzle 221 and, for example, is injected through the injection nozzle 225 from the rear of the washing tub 11 toward the front.

The washing water injected forward through the second injection unit 220 may deflect upwards through the second deflection unit 120 provided to be integrally formed with the bottom of the second dish basket 22.

As illustrated in FIGS. 62 to 66, the second deflection unit 120 may deflect the washing water injected from the second injection unit 220 toward the second dish basket 22.

Since the second deflection unit 120 may be provided to be integrally formed with the bottom of the second dish basket 22, the second deflection unit 120 moves together with the second dish basket 22 when the installation height of the second dish basket 22 varies.

The second deflection unit 120 may include the power transmission device 300 transferring power to move below the second dish basket 22.

The power transmission device 300 may include a motor 301, for example, fixed to one side of the washing tub 11 and generating a driving force. A gear unit 310 may be provided to transfer the driving force of the motor 301 to the second deflection unit 120.

The motor 301 may be provided on the rear wall 11*a* of the washing tub 11. A motor installation opening 11*f* may be formed on the rear wall 11*a* of the washing tub 11 to expose a motor shaft 302 of the motor 301.

The gear unit 310 may be provided to be coupled with the motor 301 and may be fixed to the rear of the second dish basket 22. The gear unit 310 may be provided to move together when the installation height of the second dish basket varies.

The gear unit 310 includes a gear case 300*a* formed to be fixable to the second dish basket 22 and a plurality of gears 311 and 312 provided inside the gear case 300*a*.

The plurality of gears 311 and 312 may include a first gear 311 formed at different heights, a second gear 312 formed spaced from the first gear 311, and a connection gear 320 provided to connect the first gear 311 with the second gear 312.

The connection gear 320 may include a first connection gear 321 connected to the first gear 311, a second connection gear 322 connected to the second gear 312, a connection shaft 320*a* connecting the first connection gear 321 with the second connection gear 322, a third gear 313 that is coupled with the connection shaft 320*a* and rotates, and a fourth gear 314 horizontally connected to the third gear 313. The fourth gear 314 is connected to a driving pulley 131 of the deflection unit 100, which will be described below.

At least one reduction gear 324 provided to reduce the torque of the motor 301 may be formed between the third gear 313 and the fourth gear 314.

The reduction gear 324 between the third gear 313 and the fourth gear 314 may include a first reduction gear 324*a* connected to the third gear 313 and a second reduction gear 324*b* connecting the first reduction gear 324*a* with the fourth gear 314. According to an exemplary embodiment, for example, two reduction gears may be provided between the motor 301 and the driving pulley 131 but the present invention is not limited thereto. For example, according to the performance and size of a motor, the number and shape of reduction gears may vary.

The first gear 311 may be disposed on a top end of the gear case 300*a*, and the second gear 312 may be disposed spaced downward from the first gear 311.

To correspond to the first position P1 and the second position P2 of the second dish basket 22, the first gear 311 and the second gear 312 have an interval that may be the same as that between the first position P1 and the second position P2.

Accordingly, when the second dish basket 22 is located in the first position P1, the first gear 311 of the gear unit 310 may be coupled with the motor shaft 302 of the motor 301. When the second dish basket 22 is located in the second position P2, the second gear 312 of the gear unit 310 may be coupled with the motor shaft 302 of the motor 301.

Driving forces of the first connection gear 321 connected to the first gear 311 and the second connection gear 322 connected to the second gear 312 may be transferred to the third gear 313 horizontally connectable by the connection shaft 320*a*.

According to an exemplary embodiment, the driving force of the motor 301 transferred through the power transmission device 300 may be transferred to the second deflection unit 120 to drive the second deflection unit 120.

The second deflection unit 120 may include a second vane 121 provided to move inside the washing tub 11 and to deflect the washing water injected from the second injection unit 220, for example, toward the dishes and a rail 122 guiding the movement of the second vane 121.

The rail 122 may be provided to guide the movement of the second vane 121. An opening 122*a* may be formed in a bottom surface of the rail 122. An inner space 122*b* may be formed therein to be connected to the opening 122*a*.

A belt 140 may be provided In the inner space 122*b* of the rail 122. The belt 140 includes an idle pulley 180 and a driving pulley 131 provided to rotatably support the belt 140. The driving pulley 131 may be connected to the fourth gear 314 of the power transmission device 300 transferring the driving force of the motor 301.

A rotating shaft 330 coupled with the driving pulley 131 may be provided on the fourth gear 314. According to an exemplary embodiment, for example, the rotating shaft 330 may be provided on the fourth gear 314, but the present invention is not limited thereto. For example, a shaft provided for connection with a driving pulley may be provided on one of a third gear and a plurality of reduction gears connected to the third gear.

The second deflection unit 120 may include a belt holder 160 disposed, for example, inside the inner space 122*b* of the rail 122 coupled with the idle pulley 180 and to linearly reciprocate, a vane holder 150 disposed outside the rail 122 coupled with the belt holder 160 and to linearly reciprocate, with which the second vane 121 is coupled, a rear holder 130 rotatably supporting the driving pulley 131 and coupled with a rear end of the rail 122, and a front holder 190 rotatably supporting the idle pulley 180 and coupled with a front end of the rail 122.

The rail 122 may be formed of a metal material and may be formed in a lengthwise direction forward and rearward in the washing tub 11. The belt 140 may be disposed in the inner space 122*b* of the rail 122 to prevent interfering in a driving due to the contact with the dishes inside the washing tub 11 or being corroded due to the contact with the washing water.

The belt 140 may be wound on the driving pulley 131 and the idle pulley 180 to form a closed curve and may rotate in a rotation direction of the motor 301 of the power transmission device 300. The belt holder 160 may be disposed in the inner space 122*b* of the rail 122 similar to the belt 140 and be coupled with a tooth form 141 of the belt 140 to be movable move together with the belt 140. The belt holder 160 may include a tooth-shaped coupling portion 164 having a shape corresponding to the tooth form 141 of the belt 140.

The belt holder 160 may include a plurality of legs 160*a* and 160*b* supportable by the rail 122. The plurality of legs 160*a* and 160*b* may include lateral legs 160*a* laterally protruding and supported by side walls of the rail 122 and downward legs 160*b* protruding downward and supported by a bottom wall of the rail 122.

The lateral legs 160*a* may be elastically deformable to reduce noise and vibration caused by collision and friction with the rail 122 and to enable the belt holder 160 to smoothly move while the belt holder 160 is moving. The lateral legs 160*a* may include, for example, a spring, for example, a plate spring.

The belt holder 160 may include a fastening portion 161 couplable with the vane holder 150. The fastening portion 161 may include a fastening hole 151 into which a fastening member 152 may be inserted.

The vane holder 150 is couplable with the belt holder 160 to move together with the belt holder 160 and to transfer a driving force of the belt holder 160 to the second vane 121. The vane holder 150 may be provided to at an outer surface of the rail, for example, to surround an outer surface of the rail 122 to move forward and rearward in the washing tub 11.

The vane holder 150 may be coupled with the belt holder 160 through the opening 122*a* of the rail 122. The vane holder 150 may include a fastening hole 151 with the belt holder 160.

Accordingly, the fastening member 152 may be fastened to the fastening hole 151 of the vane holder 150 and the fastening hole 151 of the belt holder 160, thereby coupling the vane holder 150 with the belt holder 160.

The fastening member 152 may move upward from a bottom and may be sequentially fastened to the fastening hole 151 of the vane holder 150 and the fastening hole of the belt holder 160.

The driving pulley 131 includes a rotating shaft 131*a* connectable to the rotation shaft 330 of the power transmission device 300 to receive a driving force and a belt coupling portion 132 couplable to the belt 140.

The rear holder 130 rotatably supports the driving pulley 131 and may be coupled with a rear end of the rail 122.

The idle pulley 180 includes a rotating shaft 181 and a belt coupling portion 182 with which the belt 140 may be coupled.

The front holder 190 may be coupled with the front end of the rail 122. The front holder 190 may be provided to be movable in a longitudinal direction of the rail 122 and may include a pulley bracket 191 that rotatably supports the idle pulley 180.

The pulley bracket 191 includes a pulley supporting surface 192 supporting the rotating shaft 181 of the idle pulley 180.

The rail 122, the belt 140, the driving pulley 131, the rear holder 130, the idle pulley 180, and the front holder 190 may be assembled with one another due to the tension of the belt 140.

Due to the tension of the belt 140, the driving pulley 131 may be pressurized in a direction in which it becomes closer to the rail 122. This force may be transferred to the rear holder 130 through the pulley supporting surface 192 of the rear holder 130, thereby closely attaching the rear holder 130 to the rear end of the rail 122.

Due to the tension of the belt 140, the idle pulley 180 may be pressurized in a direction in which it becomes closer to the rail 122. This force may be transferred to the front holder 190 through the pulley supporting surface 192 of the front holder 190, thereby closely attaching the front holder 190 to the front end of the rail 122.

The front holder 190 may include an elastic member 193 for maintaining the tension of the belt 140. One end of the elastic member 193 may be supported by the front holder 190, and the other end of the elastic member 193 may be supported by the pulley bracket 191. The elastic member 193 may include a compression spring.

Due to an elastic force of the elastic member 193, the pulley bracket 191 may be pressurized in a direction in which it becomes farther from the rail 122.

Since the pulley bracket 191 may be pressurized in the direction in which it becomes closer to the rail 122 due to the tension of the belt 140, the pulley bracket 191 moves to a position in which the tension of the belt 140 and the elastic force of the elastic member 193 remain balanced.

That is, when the belt 140 stretches and decreases in tension and the elastic force of the elastic member 193 becomes greater than the tension of the belt 140, the pulley bracket 191 moves in the direction in which it becomes farther from the rail due to the elastic force of the elastic member 193. Upon the pulley bracket 191 moving in the direction in which it becomes farther from the rail 122, the belt 140 may strain again and the tension of the belt 140 is restored.

Thus, even when the belt 140 stretches, for example, due to thermal expansion, the pulley bracket 191 moves and pulls the belt 140 to maintain the constant tension of the belt 140, thereby increasing the reliability of products.

The front holder 190 may include a fixing bracket 194 to fix the second deflection unit 120 to the second dish basket 22. The fixing bracket 194 may include a first bracket 194*a* to extend upward from the front holder 190 and a second bracket 194*b* bent from the first bracket 194*a* to horizontally extend.

The second bracket 194*b* includes a fixing hole 194*c* to be fixed to the second dish basket 22. The fixing hole 194*c* may be laterally formed to insert the second bracket 194*b* into the bottom end of the second dish basket 22. According to an exemplary embodiment, for example, the second deflection unit 120 may be fixed to a dish basket using a fixing bracket, but the present invention is not limited thereto. For example, a second deflection unit may be integrally formed with a dish basket.

The second dish basket 22 mounted in the washing tub 11 may be installed in one of the first position P1 and the second position P2 depending on a position of the guide rail 42 coupled therewith.

The injection case 222 and the gear unit 310 fixed to the second dish basket 22 may be moved together due to a change in position of the second dish basket 22 and vary in position in the washing tub 11.

It may be necessary to connect the injection case 222 and the gear unit 310 to the fixed nozzle 211 and the motor shaft 302 fixed to the rear wall 11*a* of the washing tub 11.

Figure 64:
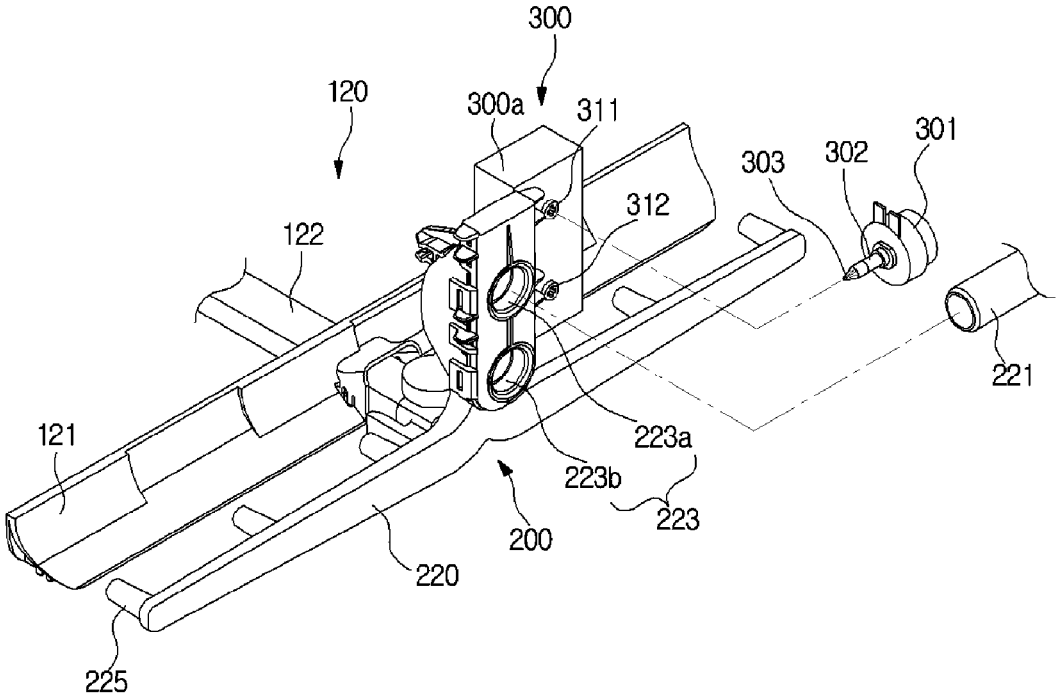
FIG. 64 is a view illustrating a washing water injection unit and the power transmission device according to the ninth embodiment of the disclosure.
Figure 65:
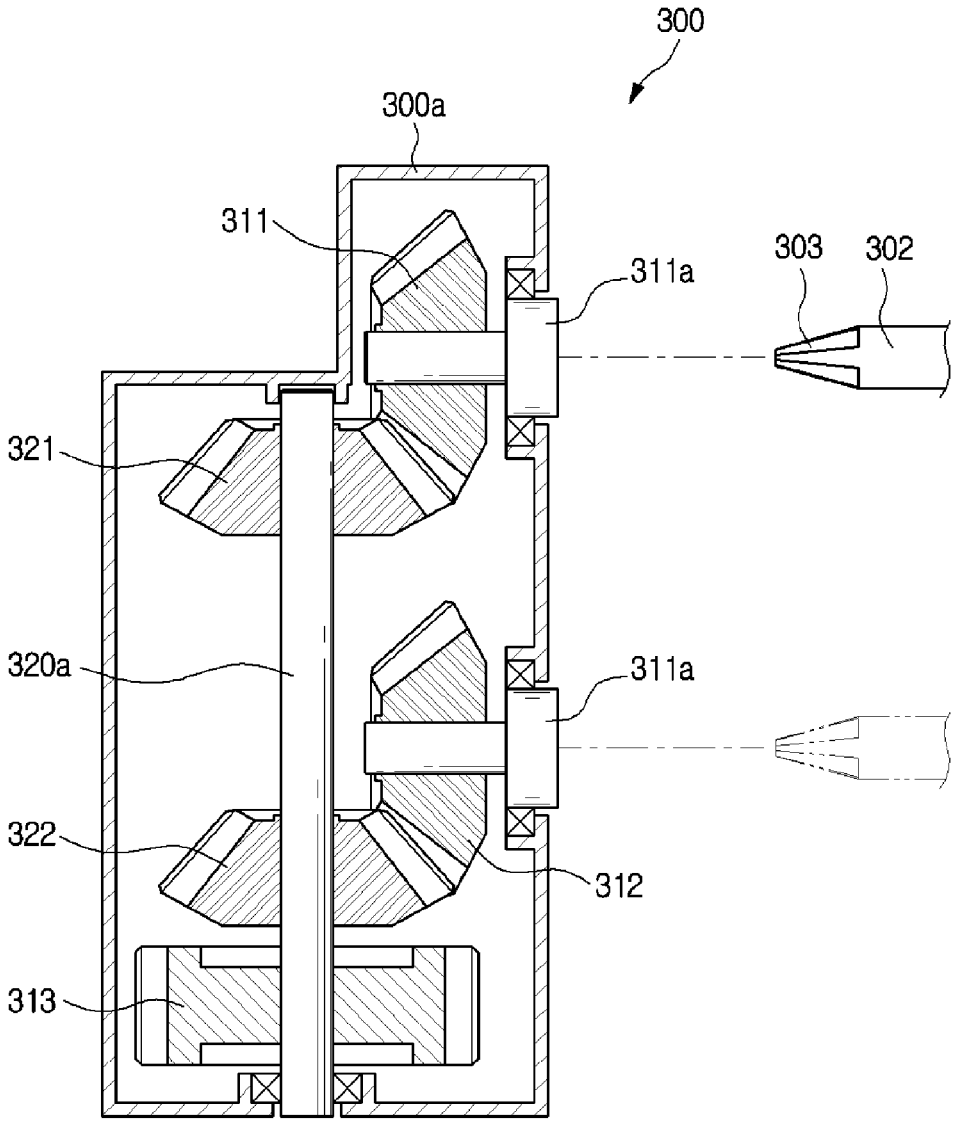
FIG. 65 is a schematic cross-sectional view of a gear unit of the power transmission device according to the ninth embodiment of the disclosure.
Figure 66:
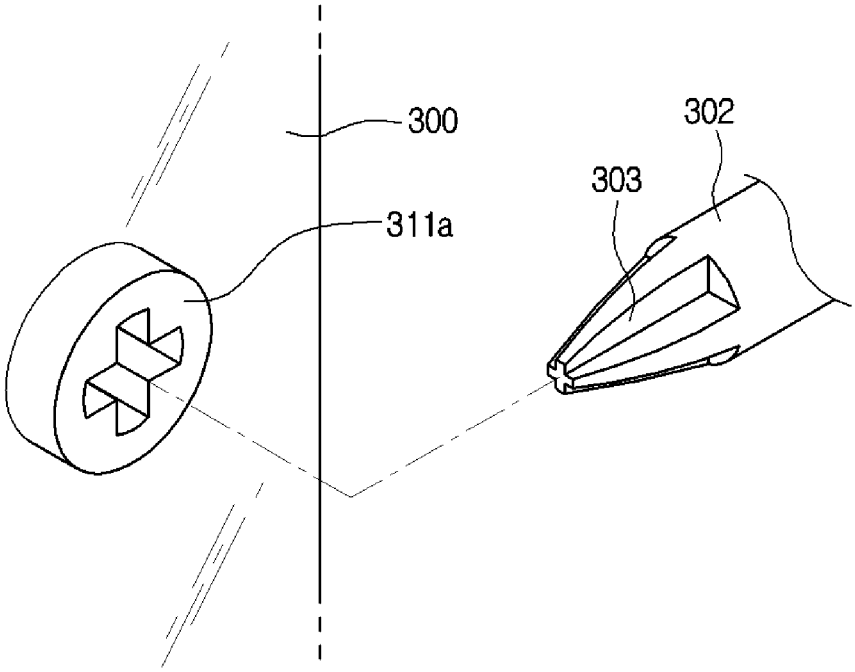
FIG. 66 is a view illustrating connection between a motor and the gear unit of the power transmission device according to the ninth embodiment of the disclosure.

As illustrated in FIG. 64, the injection case 222 may be insertable into or separable from the first connection opening 223*a* and the second connection opening 223*b* in the rear of the injection case 222, respectively, depending on an installation position of the second dish basket 22.

The first gear 311 and the second gear 312 of the gear unit 310 may be provided to be insertable into or separable from the motor shaft 302, respectively, depending the installation position of the second dish basket 22.

The first connection opening 223*a* and the second connection opening 233*b* of the injection case 222 may be formed, for example, horizontally to the first gear 311 and the second gear 312 of the gear unit 310.

Accordingly, when the second dish basket 22 is located in the first position P1, the first connection opening 223*a* of the injection case 222 may be connected to the fixed nozzle 211 to receive the washing water.

The motor shaft 302 of the motor 301 may be connected to the first gear 311 of the gear unit 310 and may receive the driving force of the motor 301. The driving force transferred through the first gear 311 may be transferred to the third connection gear 320 through the first connection gear 321 connected to the first gear 311 and the connection shaft 320*a* connected to the first connection gear 321 and transferred to the driving pulley 131 while reduced through the third connection gear 320 and a fourth connection gear 320.

When the second dish basket 22 is located in the second position P2, the second connection opening 223*b* of the injection case 222 may be connected to the fixed nozzle 211 to receive the washing water.

The motor shaft 302 may be connected to the second gear 312 of the gear unit 310 and may receive the driving force of the motor 301. The driving force transferred through the second gear 312 may be transferred to the third connection gear 320 through the second connection gear 322 connected to the second gear 312 and the connection shaft 320*a* connected to the second connection gear 322 and transferred to the driving pulley 131 while reduced through the third connection gear 320 and the fourth connection gear 320.

The motor shaft 302 of the motor 301 includes a first coupling portion 303 that includes protrusions and grooves alternating to rotate the first gear 311 and the second gear 312.

A second coupling portion 311*a* may be provided in the rear of the first gear 311 and the second gear 312 to connect the first coupling portion 303 of the motor shaft 302 with the gear unit 310

To correspond to a shape of the first coupling portion 303, the second coupling portion 311*a* may include a rear surface formed of alternating protrusions and grooves. According to an exemplary embodiment, for example, a first coupling portion and a second coupling portion have a cross shape, but the present invention it is not limited thereto.

Figure 67:
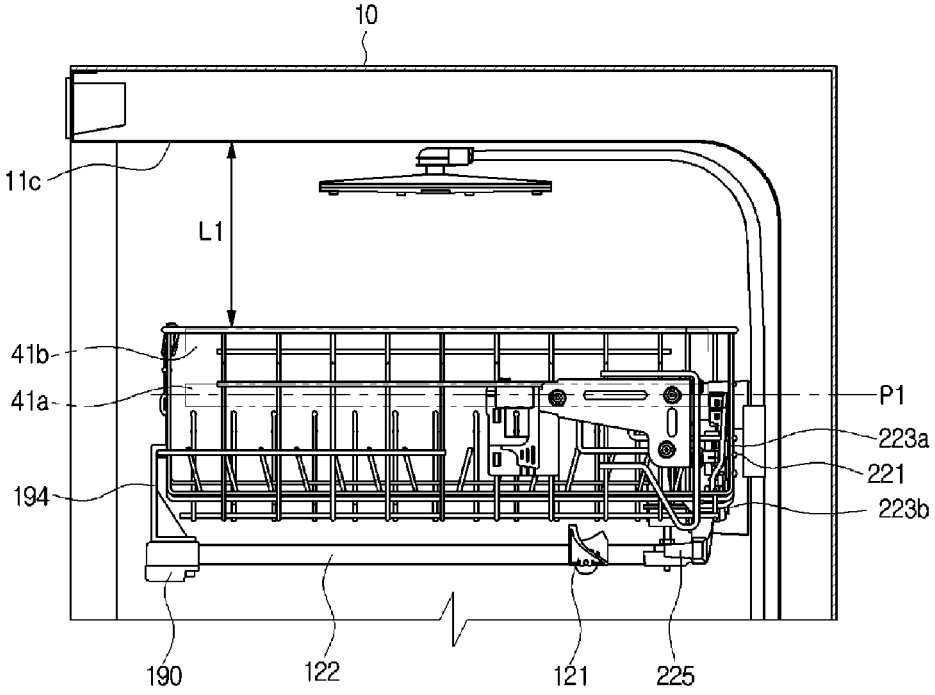
FIGS. 67 and 68 are schematic diagrams of the dish basket installed at different heights according to the ninth embodiment of the disclosure.
Figure 68:
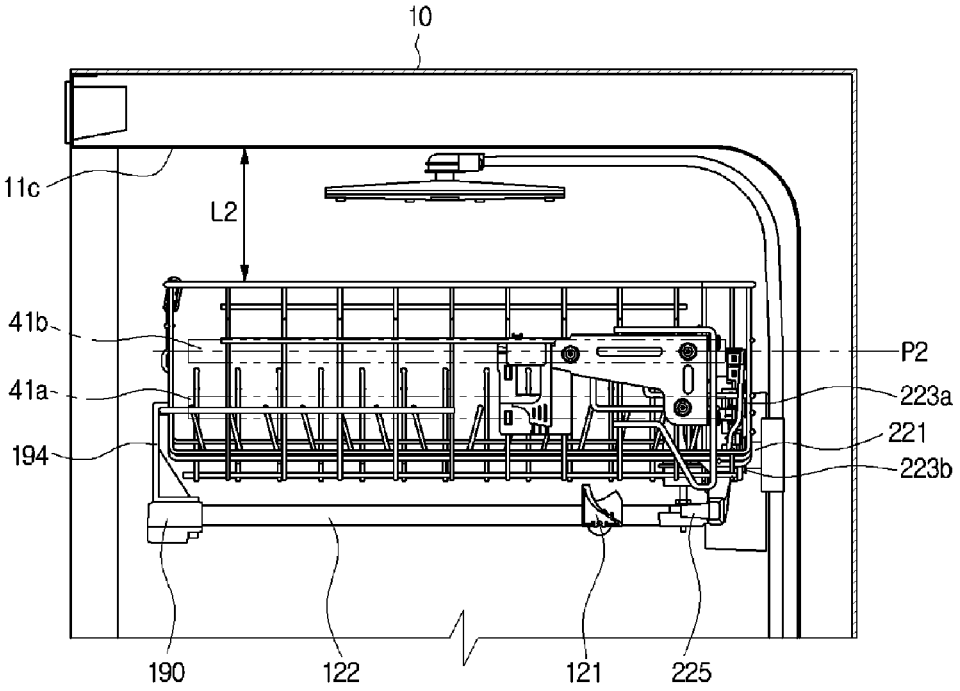

As illustrated in FIGS. 67 and 68, the second injection unit 220 and the second deflection unit 120 that are integrally formed with the second dish basket 22 of the dish washing machine 1 receive the power of the motor 301 through the power transmission device 300 and are driven when a height of the second dish basket 22 varies.

When the second dish basket 22 is located in the first position P1, a first interval L1 is formed between the top wall 11*c* of the washing tub L1 and the second dish basket 22. When the second dish basket 22 is located in the second position P2, a second interval L2 is formed between the top wall 11*c* of the washing tub 11 and the second dish basket 22. The first interval L1 may be longer than the second interval L2.

Accordingly, when the second dish basket 22 is located in the first position P1, it is possible to store dishes having a large size and volume such as plates. When the second dish basket 22 is located in the second position P2 located higher than the first position P1, it is possible to store dishes having a smaller size and volume such as bowls or flatware.

According to an exemplary embodiment, a dish washing machine may minimize areas that washing water does not reach.

According to an exemplary embodiment, a nozzle hit distance may be reduced and a height of a vane may be lowered through a vane unit and a flow channel switching device to provide a linear type compact size, thereby enlarging a dishware and cookware loading volume.

According to an exemplary embodiment, a height of a basket may be controllable through a driving unit of a height-adjustable linear type injection unit, thereby storing various types of dishware.

According to an exemplary embodiment, the injection efficiency of washing water increases due to the reciprocation of a height-adjustable injection unit provided in a basket, and it is possible to perform split injection or focused injection inside a dish basket by adjusting a position of the injection unit.

According to an exemplary embodiment, due to less loss of a flow channel power consumption may be reduced washing efficiency increased.

Although a few embodiments of the present invention have been illustrated and described, it would be appreciated by those skilled in the art that changes may be made in these embodiments without departing from the principles and spirit of the invention, the scope of that is defined in the claims and their equivalents.

What is claimed is:

1. A dish washing machine comprising:

a washing tub;

an injection unit configured to inject water into the washing tub to wash items, the injection unit including an injection nozzle; and a deflection unit movable inside the washing tub to deflect at least a portion of the water injected from the injection unit toward at least some of the items, wherein the deflection unit comprises:

a first vane that is linearly movable, the first vane being disposed on one side of the injection nozzle, and a second vane disposed parallel with the first vane in a movable direction of the first vane, the second vane being disposed on another side of the injection nozzle opposite to the one side on which the first vane is disposed.

2. The dish washing machine of claim 1, wherein the first vane is linearly movable along a rail in a first direction and a second direction opposite to the first direction, and wherein the second vane is interworkable with the first vane.

3. The dish washing machine of claim 1, wherein the water injected from the injection nozzle is injected in a first direction away from a center of the washing tub in a second direction away from the center of the washing tub.

4. The dish washing machine of claim 1, comprising a rail assembly that guides the movement of the deflection unit, wherein the rail assembly comprises:

a rail along which the first vane and the second vane are linearly movable and that extends in a first direction and a second direction, and a holder unit to hold the rail.

5. The dish washing machine of claim 4, wherein the holder unit comprises:

a holder frame connectable to the rail, a front holder on one end of the holder frame, and a rear holder on another end of the holder frame.

6. The dish washing machine of claim 5, further comprising:

a dish basket configured to store the at least some of the items, wherein at least one of the front holder and the rear holder is couplable with the dish basket.

7. The dish washing machine of claim 5, wherein the rail of the rail assembly along which the first vane and the second vane are linearly movable is a first rail, and the deflection unit further comprises:

a second rail connecting the first vane with the second vane, and a rail coupling portion to movably couple the first vane and the second vane with the first rail along which the first vane and the second vane are linearly movable.

8. The dish washing machine of claim 7, comprising a motor assembly to move the deflection unit, wherein the motor assembly comprises:

a motor to generate torque, a first gear connectable to a shaft of the motor, and a second gear connectable to the first gear and to transfer a driving force of the motor to the deflection unit.

9. The dish washing machine of claim 8, wherein the second gear is formed on at least a part of the second rail.

10. The dish washing machine of claim 5, wherein the deflection unit further comprises a vane holder to movably couple the first vane and the second vane with the rail, wherein the vane holder comprises a plurality of coupling protrusions to rotatably couple the first vane and the second vane, and wherein the first vane and the second vane each comprise a coupling groove that is rotatably coupled with a respective one of the plurality of coupling protrusions.

11. The dish washing machine of claim 1, wherein the injection unit comprises:

a fixed nozzle provided in a rear of the washing tub, the fixed nozzle being configured to inject water into the washing tub, and an injection case connectable to the fixed nozzle and comprising the injection nozzle formed to extend in a forward direction and a rearward direction in the washing tub and configured to inject the water injected from the fixed nozzle into the washing tub.

12. The dish washing machine of claim 11, wherein the injection nozzle comprises:

a first nozzle on one end of the injection case to inject a first portion of the water injected from the fixed nozzle in a first direction, and a second nozzle on another end of the injection case to inject a second portion of the water injected from the fixed nozzle in a second direction.

13. The dish washing machine of claim 12, wherein the injection case comprises:

a first injection flow channel to allow the first portion of the water to flow to be injected through the first nozzle, and a second injection flow channel to allow the second portion of the water to flow to be injected through the second nozzle, and wherein the first injection flow channel and the second injection flow channel are divided by a partition.

14. The dish washing machine of claim 11, wherein the injection case further comprises a rotation guide to rotate the first vane and the second vane.

15. The dish washing machine of claim 13, comprising:

a flow channel switching unit to supply the water injected from the fixed nozzle to at least any one of the first injection flow channel and the second injection flow channel.

16. The dish washing machine of claim 15, wherein the flow channel switching unit further comprises a motor to generate a driving force.

17. The dish washing machine of claim 15, wherein the flow channel switching unit comprises:

a flow channel switching holder movable in the first direction and the second direction and to switch a flow of the water injected from the fixed nozzle to the first injection flow channel or the second injection flow channel, and wherein the flow channel switching holder switches a moving direction of the deflection unit to an opposite direction upon being pressurized in the moving direction of the deflection unit.

18. The dish washing machine of claim 1, further comprising a sensor to limit a moving distance of the deflection unit.

19. A dish washing machine comprising:

a washing tub;

an injection unit configured to inject water into the washing tub, the water injected into the washing tub including a first portion of the water that is injected in a first direction away from a center of the washing tub and a second portion of the water that is injected in a second direction opposite to the first direction;

a first vane linearly movable inside the washing tub to deflect at least the first portion of the water to at least a part of the washing tub; and a second vane movable in parallel with the first vane to deflect at least the second portion of the water to another part of the washing tub.

20. The dish washing machine of claim 19, comprising a rail that extends in the first direction and the second direction to guide the movement of the first vane and the second vane along the rail.

21. The dish washing machine of claim 20, further comprising:

a movable rail that connects the first vane with the second vane, and a vane holder movably coupled to the movable rail.

22. The dish washing machine of claim 21, wherein the first vane and the second vane are rotatably coupled with the vane holder.

23. The dish washing machine of claim 19, wherein the injection unit comprises:

a fixed nozzle in a rear of the washing tub, the fixed nozzle being configured to inject water into the washing tub, and an injection case connectable to the fixed nozzle and comprising an injection nozzle extending forward and rearward in the washing tub and configured to inject the water injected from the fixed nozzle.

24. The dish washing machine of claim 23, wherein the injection nozzle comprises:

a first nozzle on one end of the injection case to inject the first portion of the water in the first direction, and a second nozzle on another end of the injection case to inject the second portion of the water in the second direction.

25. The dish washing machine of claim 24, wherein the injection case comprises:

a first injection flow channel to allow first portion of the water to flow to be injected through the first nozzle, and a second injection flow channel to allow the second portion of the water to flow to be injected through the second nozzle, and wherein the first injection flow channel and the second injection flow channel are divided by a partition.

26. The dish washing machine of claim 25, wherein the first injection flow channel and the second injection flow channel are each sealed using a sealing member.

27. The dish washing machine of claim 23, wherein the injection case further comprises a rotation guide to rotate the first vane and the second vane.

28. The dish washing machine of claim 25, comprising a flow channel switching unit to supply the water injected from the fixed nozzle to at least one of the first injection flow channel and the second injection flow channel.

29. The dish washing machine of claim 28, wherein the flow channel switching unit further comprises a motor to generate a driving force.

30. The dish washing machine of claim 28, wherein the flow channel switching unit comprises:

a flow channel switching holder movable in the first direction and the second direction and to switch a flow of the water injected from the fixed nozzle to the first injection flow channel or the second injection flow channel, and wherein upon being pressurized in the moving directions of the first vane and the second vane, the flow channel switching holder switchably moves directions of the first vane and the second vane to opposite directions.

31. The dish washing machine of claim 30, further comprising a sensor unit to limit moving distances of the first vane and the second vane.

32. The dish washing machine of claim 19, comprising a dish basket to store the items in the washing tub with a variable installation position, wherein the first vane and the second vane are below the dish basket and comprise a holder unit couplable with the dish basket.

33. The dish washing machine of claim 32, wherein the washing tub comprises at least one guide rail supporting the dish basket with the variable installation position.

* * * * *